US006746832B2

(12) United States Patent
Okazaki et al.

(10) Patent No.: US 6,746,832 B2
(45) Date of Patent: Jun. 8, 2004

(54) COLOR IMAGE FORMING METHOD USING SILVER HALIDE COLOR PHOTOSENSITIVE MATERIAL

(75) Inventors: Kentaro Okazaki, Minami-ashigara (JP); Takuya Yokokawa, Minami-ashigara (JP); Yasufumi Nakai, Minato-ku (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 10/393,018

(22) Filed: Mar. 21, 2003

(65) Prior Publication Data

US 2004/0038157 A1 Feb. 26, 2004

Related U.S. Application Data

(63) Continuation-in-part of application No. 10/329,527, filed on Dec. 27, 2002, now abandoned.

(30) Foreign Application Priority Data

Dec. 28, 2001 (JP) ..... 2001-401449

(51) Int. Cl.[7] ..... G03C 7/30
(52) U.S. Cl. ..... 430/363; 430/486; 430/933
(58) Field of Search ..... 430/363, 486, 430/933

(56) References Cited

U.S. PATENT DOCUMENTS

| | | | | |
|---|---|---|---|---|
| 4,564,591 | A | 1/1986 | Tanaka et al. | |
| 4,605,610 | A | 8/1986 | Klotzer | |
| 4,820,624 | A | 4/1989 | Hasebe et al. | |
| 4,865,962 | A | 9/1989 | Hasebe et al. | |
| 5,284,743 | A | 2/1994 | Ohshima et al. | |
| 5,399,475 | A | 3/1995 | Hasebe et al. | |
| 5,828,461 | A | * 10/1998 | Kubo et al. | 358/296 |
| 5,891,607 | A | * 4/1999 | Brewer et al. | 430/383 |
| 6,232,997 | B1 | * 5/2001 | Nakamura et al. | 347/232 |
| 2001/0031432 | A1 | 10/2001 | Nakai et al. | |

* cited by examiner

*Primary Examiner*—Hoa Van Le
(74) *Attorney, Agent, or Firm*—Sughrue Mion, PLLC

(57) ABSTRACT

A color image forming method that includes subjecting a silver halide color photosensitive material to an exposure, and then processing it with a processing solution, wherein at least one silver halide emulsion in the silver halide layers has silver halide grains of AgClBr, AgCeI, or AgClIBr grains, having a AgCl content of 95 mol % or more, and having at least one region where a AgBr and/or AgI content is higher than the other region; the exposure is performed based on digital image data for area modulation; and the processing solution contains at least one compound represented by formula (I) or (II):

formula (I)

formula (II)

10 Claims, No Drawings

COLOR IMAGE FORMING METHOD USING SILVER HALIDE COLOR PHOTOSENSITIVE MATERIAL

This is a continuation-in-part application of application Ser. No. 10/329,527, filed on Dec. 27, 2002, now abandoned.

FIELD OF THE INVENTION

The present invention relates to a method of producing an image on silver halide color light-sensitive materials. In particular, the present invention relates to an image-forming method that is adaptable to output an image based on digital image data for area modulation, and it provides an image that is improved in quality; that is free from scratches and unevenness in density; that has high sharpness, and that is reduced in the yellowing (yellow stain) at the white background. Further, the present invention relates to an image-forming method that is excellent in aptitudes for high intensity exposure and to rapid processing. Particularly, the present invention relates to an image-forming method that is adaptable to a direct digital color proof, using a silver halide color light-sensitive material, in which a color image is formed based on area-modulated image data (dot image data).

BACKGROUND OF THE INVENTION

The recent progress of image digitization has enabled one to use a printing process, such as CTP (Computer To Plate), in which a lith-plate need not to be formed. Along with this, the major trend of the purpose of producing proofs has changed from inspection of lith-plates for confirmation of print finish, and improvements in proof quality and high speed processing are therefore expected.

As proofs that can cope with digitization, there are low-quality proofs that almost cannot reproduce dots, though inexpensive, such as those obtained with systems represented by an ink jet system; high-quality proofs that enable the reproduction of dots and hue close to those of printed products, though expensive and reduced in productivity, such as those obtained with systems represented by a laser thermal system; and medium quality proofs, which have an intermediate cost performance between the two, and which use silver halide color light-sensitive materials.

Conventionally, the main purpose of producing a color proof is to inspect a lith-plate prior to preparing a printing plate. For this, in a proof using a silver halide light-sensitive material, a reversal light-sensitive material is generally used to obtain a positive image directly from a lith-plate (positive image). A proof using a silver halide light-sensitive material in an analogue system (contact exposure, from a lith-plate), before digital systems were put to practical use, had a certain level of qualities with respect to dot reproducibility and color reproducibility. Therefore, in practicing digital systems, a system using a conventional reversal-series light-sensitive material as the light-sensitive material and the treatment therefor, has been established (see, for example, JP-A-2000-147723 ("JP-A" means unexamined published Japanese patent application)).

The digitization of data for a plate enabled reversing by calculation, and it was not necessarily required to prepare a light-sensitive material having a reversal function. This is why studies have been started to design a proof system using a negative-type light-sensitive material (see, for example, JP-A-2002-122969).

In a color proof system, it takes time to carry out exposure, because a light-sensitive material with a size (for example, A3 size) larger than a usual photographic print (using density modulation) is exposed, and also the reproducibility of dots and high quality are required because the image is expressed by dots. In particular, reproducibility of characters coexisting in the image, and of fine characters, is strongly demanded.

To improve productivity, high-speed exposure using a multi-channel system comprising multiple exposure light sources having the same wavelengths, adjustment for high speed development processing, and the like, are carried out. However, along with improved productivity, image unevenness in a print image is easily caused.

To improve the productivity of the system, it is preferred that a silver halide emulsion with a high silver chloride content, which is suitable for rapid development processing, be used. However, such a high silver chloride content emulsion is known to have the disadvantage of being large in its high intensity reciprocity law failure. Since sensitivity reduction and gradation softening at high intensities deteriorate the suitability of printing paper to laser scanning exposure and high-intensity light-emitting diode array scanning exposure which are expected as a recording method for digital image information exhibiting a high image quality. Therefore, development of means for preventing the high intensity reciprocity law failure of silver halide emulsions having high silver chloride contents has become important. Furthermore, reducing the processing time in order to perform rapid processing generally results in an increase in passing speed of a photosensitive material through a processing apparatus, but in turn results in a shortened immersion time of the photosensitive material in the processing solution. This causes various problems that the image in the print tends to have streaks and unevenness where the density has increased, and that the white background becomes colored in yellow, and so on. Accordingly, it has been necessary to deal with these problems as well.

Under the circumstances, the inventors of the present invention have made extensive studies. As a result, they have found that the streaks and unevenness formed during the aforementioned development processing are reduced by providing regions where the content(s) of silver bromide and/or silver iodide is higher than that in the other regions at a portion or a plurality of portions between the center and the surface of grains. However, it has been found that this is not necessarily satisfactory when handling image data that is area-modulated, and that, if an emulsion containing such grains is used, the aforementioned phenomenon; yellow stain at the white background is caused significantly, and the reproducibility of characters is more deteriorated.

JP-A-58-95736, JP-A-63-89840, U.S. Pat. No. 4,820,624, U.S. Pat. No. 5,284,743 disclose that high sensitivity can be achieved by incorporating, in an emulsion with a high silver chloride content, a phase with a high silver bromide content in various forms in a localized manner. In these publications, however, no explicit mention has been made on the means for reducing yellowing of the white background:when emulsions containing a silver bromide- and/or silver iodide-containing phase are used.

In JP-A-2001-281823, on the other hand, a method for removing a residual color due to a sensitizing dye is described. However, there is nothing described as to the problem concerning the handling of area-modulated image data, and as to the problem concerning scratches and unevenness of the image.

SUMMARY OF THE INVENTION

The present invention is a color image forming method, which comprises:

subjecting a silver halide color photosensitive material to exposure; and thereafter processing the silver halide color photosensitive material with a processing solution, wherein the silver halide color photosensitive material comprises, on a support, at least one silver halide emulsion layer containing a yellow dye-forming coupler, at least one silver halide emulsion layer containing a magenta dye-forming coupler, at least one silver halide emulsion layer containing a cyan dye-forming coupler, a color mixing prevention layer, and a protective layer, wherein a silver halide emulsion in at least one of the silver halide emulsion layers comprises at least one kind of silver halide grains selected from the group consisting of silver chlorobromide grains, silver chloroiodide grains, and silver chloroiodobromide grains, each having a silver chloride content of 95mol % or more, and each having a region where a content of silver bromide and/or silver iodide is higher than other regions of the silver halide grains, wherein the exposure is performed based on digital image data that has been modulated into data for area modulation and converted into exposure-device-dependent digital data for exposure, and wherein the processing solution contains at least one compound selected from the group consisting of a compound represented by formula (I) and a compound represented by formula (II):

formula (I)

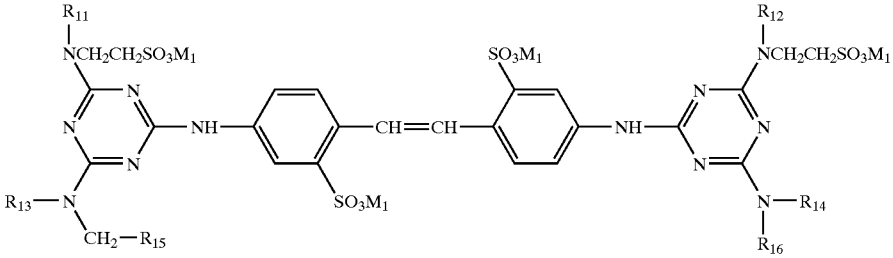

wherein $R_{11}$ and $R_{12}$ each independently represent a hydrogen atom or an alkyl group; $R_{13}$ and $R_{14}$ each independently represent a hydrogen atom, an alkyl group or an aryl group; $R_{15}$ represents an alkyl group having at least one asymmetric carbon or a group represented by formula (I-a); $R_{16}$ represents an alkyl group having at least one asymmetric carbon or a group represented by formula (I-b); $M_1$ represents a hydrogen atom, an alkali metal atom, an alkaline earth metal atom, an ammonium group, or a pyridinium group; and $R_{13}$ and $R_{15}$, and $R_{14}$ and $R_{16}$ may combine each other to form a ring;

$$—CH_2O(CH_2CH_2O)_{n_{11}}H \qquad \text{formula (I-a)}$$

wherein $n_{11}$ is an integer of 1 to 3;

$$—(CH_2CH_2O)_{n_{12}}H \qquad \text{formula (I-b)}$$

wherein $n_{12}$ is an integer of 2 to 4;

formula (II)

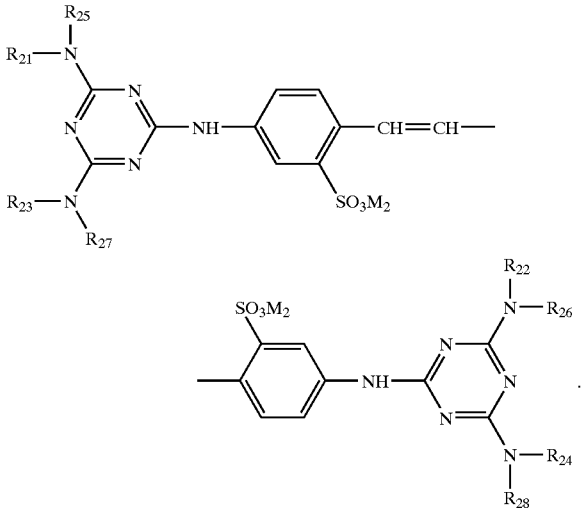

wherein $R_{21}$, $R_{22}$, $R_{23}$, and $R_{24}$ each independently represent a hydrogen atom, an alkyl group, or an aryl group; $R_{25}$ and $R_{26}$ each independently represent an alkyl group having at least one asymmetric carbon or a group represented by formula (II-a); $R_{27}$ and $R_{28}$ each independently represent an alkyl group having at least one asymmetric carbon; $M_2$ represents a hydrogen atom, an alkali metal atom, an alkaline earth metal atom, an ammonium group, or a pyridinium group; and $R_{21}$ and $R_{25}$, $R_{22}$ and $R_{26}$, $R_{23}$ and $R_{27}$, and $R_{24}$ and $R_{28}$ may combine each other to form a ring;

$$—(CH_2CH_2O)_{n_{21}}H \qquad \text{formula (II-a)}$$

wherein $n_{21}$ is an integer of 2 to 4.

Other and further features and advantages of the invention will appear more fully from the following description.

DETAILED DESCRIPTION OF THE INVENTION

According to the present invention, there is provided the following means:

(1) A color image forming method, comprising: subjecting a silver halide color photosensitive material to an exposure; and thereafter processing the silver halide color photosensitive material with a processing solution, wherein the silver halide color photosensitive material comprises, on a support, at least one silver halide emulsion layer containing a yellow dye-forming coupler, at least one silver halide emulsion layer containing a magehta dye-forming coupler, at least one silver halide emulsion layer containing a cyan dye-forming coupler, a color mixing prevention layer, and a protective layer, wherein a silver halide emulsion in at least one of the silver halide emulsion layers contains at least one kind of silver halide grains selected from the group consisting of silver chlorobromide grains, silver chloroiodide grains, and silver chloroiodobromide grains, each having a silver chloride content of 95 mol % or more, and each having a region where a content of silver bromide and/or silver iodide is higher than other regions of the silver halide grain, wherein the exposure is performed based on digital image data that has been modulated into data for area modulation and converted into exposure-device-dependent digital data for exposure, and wherein the processing solution contains at least one compound selected from the group consisting of a compound represented by formula (I) and a compound represented by formula (II):

formula (I)

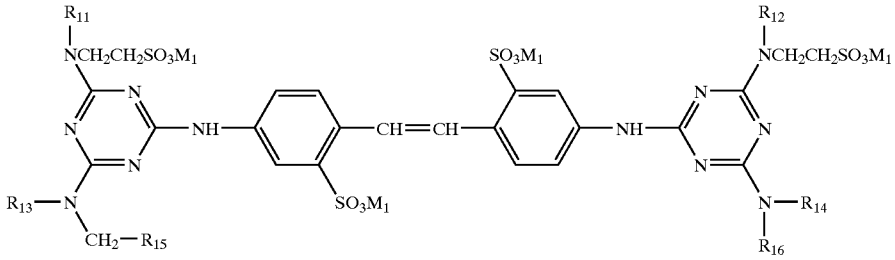

wherein $R_{11}$ and $R_{12}$ each independently represent a hydrogen atom or an alkyl group; $R_{13}$ and $R_{14}$ each independently represent a hydrogen atom, an alkyl group or an aryl group; $R_{15}$ represents an alkyl group having at least one asymmetric carbon or a group represented by formula (I-a); $R_{16}$ represents an alkyl group having at least one asymmetric carbon or a group represented by formula (I-b); $M_1$ represents a hydrogen atom, an alkali metal atom, an alkaline earth metal atom, an ammonium group, or a pyridinium group; and $R_{13}$ and $R_{15}$, and $R_{14}$ and $R_{16}$ may combine each other to form a ring;

$$—CH_2O(CH_2CH_2O)_{n_{11}}H \qquad \text{formula (I-a)}$$

wherein $n_{11}$ is an integer of 1 to 3;

$$—(CH_2CH_2O)_{n_{12}}H \qquad \text{formula (I-b)}$$

wherein $n_{12}$ is an integer of 2 to 4;

formula (II)

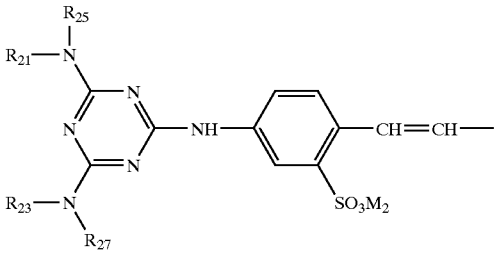

-continued

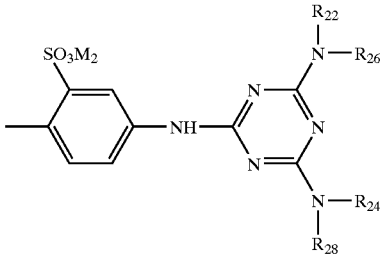

wherein $R_{21}$, $R_{22}$, $R_{23}$, and $R_{24}$ each independently represent a hydrogen atom, an alkyl group, or an aryl group; $R_{25}$ and $R_{26}$ each independently represent an alkyl group having at least one asymmetric carbon or a group represented by formula (II-a); $R_{27}$ and $R_{28}$ each independently represent an alkyl group having at least one asymmetric carbon; $M_2$ represents a hydrogen atom, an alkali metal atom, an alkaline earth metal atom, an ammonium group, or a pyridinium group; and $R_{21}$ and $R_{25}$, $R_{22}$ and $R_{26}$, $R_{23}$ and $R_{27}$, and $R_{24}$ and $R_{28}$ may combine each other to form a ring;

$$—(CH_2CH_2O)_{n_{21}}H \qquad \text{formula (II-a)}$$

wherein $n_{21}$ is an integer of 2 to 4.

(2) The color image forming method according to item (1) above, wherein a color processing composition containing at least one compound selected from the group consisting of the compound represented by formula (I) in which at least one of $R_{15}$ and $R_{16}$ has at least one hydroxyl group and the compound represented by formula (II) in which at least one of $R_{25}$, $R_{26}$, $R_{27}$, and $R_{28}$ has at least one hydroxyl group, is used.

(3) The color image forming method according to item (1) or (2) above, wherein the silver halide color photosensitive material is for color proof.

(4) The color image forming method according to any one of items (1) to (3) above, wherein the exposure is performed by scanning exposure using at least one light emission source selected from the group consisting of a gas laser, a light-emitting diode, a semiconductor laser, a solid laser, and a combination of any of these with a second harmonic generation light source.

(5) The color image forming method according to any one of items (1) to (4) above, wherein the exposure is performed through a multi-channel comprising a plurality of exposure light sources emitting light at the same wavelength.

(6) The color image forming method according to any one of items (1) to (5), wherein the silver halide grains contain an iridium compound.

(7) The color image forming method according to any one of items (1) to (6) above, wherein the silver halide grains have a silver bromide-containing phase having a maximum silver bromide-concentration inside the grains.

(8) The color image forming method according to any one of items (1) to (6) above, wherein the silver halide grains have a silver iodide-containing phase having a maximum silver iodide concentration on surfaces of the grains.

(9) The color image forming method according to any one of items (1) to (6), wherein the silver halide grains have a silver bromide-localized phase and a silver iodide-containing phase inside the grains, the silver bromide-localized phase being formed more inner than the silver iodide containing phase.

(10) The color image forming method according to any one of items (1) to (9), wherein the processing solution is a color developer.

Hereinafter, the present invention will be described in detail.

In the present invention, it is used a silver halide color photosensitive material, which has, on a support, at least one layer of a silver halide emulsion layer containing a yellow dye-forming coupler, at least one layer of a silver halide emulsion layer containing a magenta dye-forming coupler, at least one layer of a silver halide emulsion layer containing a cyan dye-forming coupler, a color mixing prevention layer, and a protective layer.

In addition, the silver halide emulsion in at least one of the silver halide emulsion layers comprises at least one kind of silver halide grains selected from the group consisting of silver chlorobromide grains, silver chloroiodide grains, and silver chloroiodobromide grains, each having a silver chloride content of 95 mol % or more, and each having a region where a content of silver bromide and/or silver iodide is higher than those in other regions in the silver halide grains.

Hereinafter, the above-mentioned silver halide emulsion is referred to as "silver halide emulsion for use in the present invention" and the above-mentioned silver halide grains are referred to as "silver halide grains for use in the present invention" and these will be explained first.

The silver halide emulsion for use in the present invention is preferably a negative-working silver halide emulsion.

The silver halide emulsion for use in the present invention includes the above silver halide grains for use in the present invention. The structure of the silver halide grains for use in the present invention is not particularly limited, but preferably cubic or tetradecahedral crystal grains (peak of these grains may be round and those grains may have a higher level plane) having substantially {100} faces or an octahedral crystal grains, or a tabular grains having {100} faces or {111} faces as main planes and having an aspect ratio of 2 or more. The aspect ratio is defined as the value obtained by dividing the diameter of a circle corresponding to the circle having the same area as projected area by the thickness of the grains. In the present invention, more preferably, the grains are cubic or tetradecahedral grains.

The silver halide grains for use in the present invention have the silver chloride content of 95 mole % or more. From the point of rapid processing suitability, the silver chloride content is preferably 98 mole % or more, and further preferably 99 mole % or more. The silver bromide content is preferably from 0.1 to 5 mole %, and more preferably from 0.5 to 5 mole %, because hard gradation and excellent latent image stability can be achieved. The silver iodide content is preferably from 0.02 to 1 mole %, more preferably from 0.05 to 0.50 mole %, and most preferably from 0.07 to 0.40 mole %, because high sensitivity and hard gradation in high illumination intensity exposure can be achieved. The silver halide grains for use in the present invention are preferably silver chloroiodobromide grains, and more preferably silver chloroiodobromide grains having the above-described halogen composition.

The silver halide grain for use in the invention has a region where a content of silver bromide and/or silver iodide is higher than those in other regions, in the silver halide grains. In some cases, the silver halide grain for use in the present invention contains silver chloride, silver bromide and/or silver iodide uniformly distributed throughout the entire grain, and it partially contains a region where the content of silver bromide and/or silver iodide is high. However, as described later, the case where most of regions are formed only with silver chloride is preferred. Hereinafter, a region where the content of silver bromide is higher than that in other regions will be referred to as a silver bromide-containing phase and likewise a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The local silver bromide content in the silver bromide-containing phase is preferably 5 mole % or more, more preferably from 10 to 80 mole %, and most preferably from 15 to 50 mole %. The local silver iodide content in the silver iodide-containing phase is preferably 0.3 mole % or more, more preferably from 0.5 to 8 mole %, and most preferably from 1 to 5 mole %. Such silver bromide- or silver iodide-containing phase may be present in plural numbers in layer form, within the grain. In this case, the phases may have different silver bromide or silver iodide contents from each other. The silver halide grain for use in the invention has at least one of the silver bromide-containing phase and silver iodide-containing phase. Preferably, it contains both at least one silver bromide-containing phase and at least one silver iodide-containing phase.

The silver bromide-containing phase or silver iodide-containing phase in the silver halide grain in the invention may be present in a layer form surrounding the grain center. Alternatively, it may be present not in a layer form but completely isolated at a specified region. That is, it may be a non-layer-form, localized phase localized in the grain; for example, it may be present at a corner or edge of the grain. In the case where a plurality of these phases is present, a layer-form phase and a non-layer-form phase may be co-existent. In the present invention, it is preferred that at least one of the silver bromide-containing phase and silver iodide-containing phase may be present in a layer form so as to be surrounding the grain center. More preferably, both of them are present so as to be surrounding the grain center. Note that in the case where plural silver bromide-containing phases are present, it is preferred that at least one silver bromide-containing phase is present in a layer form and the remaining at least one silver bromide-containing phase is non-layer form.

One preferred embodiment is that the silver bromide-containing phase or the silver iodide-containing phase formed in the layer form so as to surround the grain center has a uniform concentration distribution in the circumferential direction of the grain, in each phase. However, in the silver bromide-containing phase or silver iodide-containing phase formed in the layer form so as to surround the grain center, there may be the maximum point or the minimum point of the silver bromide or silver iodide concentration, in the circumferential direction of the grain to have a concentration distribution. For example, when a grain has a silver bromide-containing phase or silver iodide-containing phase formed in the layer form so as to surround the grain center in the vicinity of a surface of the grain, the silver bromide or silver iodide concentration of a corner portion or an edge of the grain can be different from that of a main surface of the grain. Further, aside from a silver bromide-containing phase or a silver iodide-containing phase formed in a layer form so as to surround the grain center, another silver bromide-containing phase or silver iodide-containing phase that exists in complete isolation at a specific portion of the surface of the grain, and does not surround the grain center, may exist.

When a silver halide grain for use in the present invention has a silver bromide-containing phase, the silver bromide-containing phase is preferably formed in a layer form so as to have a maximum silver bromide concentration inside the grain. Likewise, when the silver halide grain for use in the present invention has a silver iodide-containing phase, the silver iodide-containing phase is formed in a layer form so as to form a maximum concentration at the surface of the grain. Such silver bromide-containing phase or silver iodide-containing phase is constituted preferably with a silver amount of 3% to 30% of the grain volume, and more preferably with a silver amount of 3% to 15%, in the meaning to increase the local concentration with a less silver bromide or silver iodide content.

The silver halide grain for use in the present invention preferably contains both a silver bromide-containing phase and a silver iodide-containing phase, and this is a preferable mode. In this mode, the silver bromide-containing phase and the silver iodide-containing phase may exist either at the same place in the grain or at different places thereof. However, it is preferred that they exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide or silver iodide content necessary or exhibiting the effects of the present invention such as achievement of high sensitivity and realization of hard gradation, increases with the silver bromide-containing phase or silver iodide-containing phase is being formed inside a grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To a silver halide grain for use in the present invention, bromide ions or iodide ions are introduced to make the grain include silver bromide or silver iodide. In order to introduce bromide ions or iodide ions, a bromide or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in the form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, thereby an emulsion having higher sensitivity and lower fog can be obtained.

On the other hand, the addition of a bromide salt solution is preferably started at 50% or outer side of the volume of a grain, more preferably 70% or outer side of the volume of an emulsion grain.

The distribution of a bromide ion concentration and iodide ion concentration in the depth direction of a grain can be measured according to an etching/TOF-SIMS (Time of Flight-Secondary Ion Mass Spectrometry) method by means of, for example, a TRIFT II Model TOF-SIMS apparatus (trade name, manufactured by Phi Evans Co.). A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection-Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. It is preferred that the emulsion for use in the present invention has the maximum concentration of iodide ions at the surface of the grain, and the iodide ion concentration decreases inwardly in the grain. The bromide ions preferably have the maximum concentration in the inside of a grain.

The local concentration of silver bromide can also be measured with X-ray diffractometry, as long as the silver bromide content is high to some extent.

In this specification, equivalent spherical diameter is expressed as a diameter of a sphere having a volume identical to that of each grain. Preferably, the emulsions for use in the present invention comprise grains having a monodisperse particle size distribution. The variation coefficient of equivalent spherical diameter of all the grains for use in the present invention must be 20% or less; more preferably 15% or less, and still more preferably 10% or less. The variation coefficient of equivalent spherical diameter is expressed as a percentage of standard deviation of equivalent spherical diameter of each grain to an average of equivalent spherical diameter. In this connection, for the purpose of obtaining broad latitude, it is preferred that the above-mentioned monodisperse emulsions be used as blended in the same layer or coated one layer on another.

The side length of the silver halide grain for use in the invention is preferably 0.8 $\mu$m or less, and more preferably 0.5 $\mu$m or less, in the case of cubic grains. Grains other than cubic grains preferably have particle sizes corresponding to the above, in terms of equivalent spherical diameter. The silver halide emulsion for use in the invention may contain silver halide grains other than the silver halide grains for use in the present invention. However, the silver halide emulsion as defined in the present invention contains the silver halide grain for use in the invention preferably in an amount of 50% or more, more preferably 80% or more, and still more preferably 90% or more of total projected area of all the grains.

The sustained electron emission time of the silver halide emulsion for use in the invention is preferably between $10^{-5}$ to 10 seconds. Here, sustained electron emission time is, when a silver halide emulsion is exposed to light, a time during which a photoelectron generated in a silver halide crystal is trapped by an electron trap in the crystal and released again. If the sustained electron emission time is too short, high sensitivity and hard gradation in high intensity exposure are difficult to obtain. On the other hand, if the sustained electron emission time is too long, the problem of latent image sensitization occurs during the time interval between the exposure to light and processing in a short time. The sustained electron emission time is more preferably between $10^{-4}$ second and 10 seconds, and most preferably between $10^{-3}$ second and 1 second.

The sustained electron emission time can be measured with a double pulse photoconduction method. More particularly, this is performed as follows. Using microwave photoconduction method or radio wave photoconduction method, a short time exposure as a first shot is given and after a predetermined time, another short time exposure is given as a second shot. At the first shot exposure, electrons are trapped in the electron trap in the silver halide crystal, and when the second shot exposure is given immediately thereafter, photoconduction signal at the second shot becomes more intense since the electron trap is full of electrons. If the interval between two exposures is taken sufficiently long so that the electrons trapped in the electron trap at the first exposure have already been emitted, the intensity of the photoconduction signal at the second shot returns to the original level of intensity. By changing the interval of two exposures and determining exposure interval dependency of second shot photoconduction signals, the state of photoconduction signal intensity decreasing while exposure interval increasing, can be measured. This shows sustained emission time of photoelectrons from the electron trap. The sustained electron emission in some cases occurs continuously for a specified time after exposure. However, it is preferred that the sustained emission is observed between $10^{-5}$ second to 10 seconds, more preferably between $10^{-4}$ to 10 seconds, and still more preferably between $10^{-3}$ second to 1 second.

The silver halide grains for use in the present invention are preferably doped with an iridium compound. As the iridium compound, a six-coordination complex having 6 ligands and containing iridium as a central metal is preferable, for uniformly incorporating iridium in a silver halide crystal. AS an embodiment of iridium compound for use in the present invention, a six-coordination complex having Cl, Br or I as a ligand and containing iridium as a central metal is preferable. A more preferable example is a six-coordination complex in whixh all six ligands are Cl, Br, or I and which has iridium as a central metal. In this case, Cl, Br and I may coexist in the six-coordination complex. It is especially preferable that a six-coordination complex having Cl, Br or I as a ligand and containing iridium as a central metal is contained in a silver bromide-containing phase, in order to obtain a hard gradation in a high illumination intensity exposure.

Specific examples of the six-coordination complex in which all of 6 ligands are Cl, Br or I and iridium is a central metal are shown below. However, the iridium compound for use in the present invention is not limited thereto.

$[IrCl_6]^{2-}$
$[IrCl_6]^{3-}$
$[IrBr_6]^{2-}$
$[IrBr_6]^{3-}$
$[IrI_6]^{3-}$

As another embodiment of the iridium compound that can be used in the present invention, a six-coordination complex having at least one ligand other than a halogen or a cyan and containing iridium as a central metal, is preferable. A six-coordination complex having $H_2O$, OH, O, OCN, thiazole or a substituted thiazole as a ligand and containing iridium as a central metal is preferable. A six-coordination complex in which at least one ligand is $H_2O$, OH, O, OCN, thiazole or substituted thiazoles and the remaining ligands are Cl, Br or I, and iridium is a central metal, is more preferable. A six-coordination complex in which one or two ligands are 5-methylthiazole and the remaining ligands are Cl, Br or I, and iridium is a central metal, is most preferable.

Specific examples of the six-coordination complex in which at least one ligand is $H_2O$, OH, O, OCN, thiazole or a substituted thiazole and the remaining ligands are Cl, Br or I, and iridium is a central metal, are listed below. However, the iridium compound for use in the present invention is not limited thereto.

$[Ir(H_2O)Cl_5]^{2-}$
$[Ir(H_2O)_2Cl_4]^{-}$
$[Ir(H_2O)Br_5]^{2-}$
$[Ir(H_2O)_2Br_4]^{-}$
$[Ir(OH)Cl_5]^{3-}$
$[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)Br_5]^{4-}$
$[Ir(O)_2Br_4]^{5-}$
$[Ir(OCN)Cl_5]^{3-}$
$[Ir(OCN)Br_5]^{3-}$
$[Ir(thiazole)Cl_5]^{2-}$
$[Ir(thiazole)_2Cl_4]^{-}$ $[Ir(thiazole)Br_5]^{2-}$
$[Ir(thiazole)_2Br_4]-$
$[Ir(5\text{-methylthiazole})Cl_5]^{2-}$
$[Ir(5\text{-methylthiazole})_2Cl_4]^{-}$
$[Ir(5\text{-methylthiazole})Br_5]^{2-}$
$[Ir(5\text{-methylthiazole})_2Br_4]^{-}$ The effects of the present invention is preferably exhibited by using singly any one of a hexa-coordinated complex with Ir as a central metal atom, all of six ligands of which are Cl, Br or I, and a hexa-coordinated complex with Ir as a central metal atom, having at least one ligand other than halogen or cyan. However, in order to further increase the effect of the present invention, it is preferred to use in combination the hexa-coordinated complex with Ir as a central metal atom, all of six ligands of which are Cl, Br or I, and the hexa-coordinated complex with Ir as a central metal atom, having at least one ligand other than halogen or cyan. Furthermore, hexa-coordinated complexes with Ir as a central metal atom, having at least one ligand selected from the group consisting of $H_2O$, OH, O, OCN, thiazole and substituted thiazoles and the remaining ligand or ligands of Cl, Br or I, are preferable. In this case, those complexes having two kinds of liqands (one from the group consisting of $H_2O$, OH, O, OCN, thiazole and a substituted thiazole and one from the group consisting of Cl, Br and I) are preferably used.

The foregoing metal complexes are anionic ions. When these are formed into salts with cationic ions, counter cationic ions are preferably those easily soluble in water. Preferable examples thereof include an alkali metal ion such as a sodium ion, a potassium ion, a rubidium ion, a cesium ion and a lithium ion, an ammonium ion and an alkyl ammonium ion. These metal complexes can be used being dissolved in water or in a mixed solvent of water and an appropriate water-miscible organic solvent (such as alcohols, ethers, glycols, ketones, esters and amides). These iridium complexes are added in amounts of, preferably $1\times10^{-10}$ mole to $1\times10^{-3}$ mole, most preferably $1\times10^{-8}$ mole to $1\times10^{-5}$ mole, per mole of silver, during grain formation.

In the present invention, the above-mentioned iridium complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Furthermore, it is also preferable to employ a method in which the iridium complex is doped into a silver halide grain by preparing fine particles doped with the complex in advance and adding the particles for carrying out physical ripening. Further, these methods may be combined, to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the position (portion) where the complexes are incorporated, is not particularly limited, but the six-cordination complex whose central-metal is Ir and whose all six-ligands are Cl, Br, or I is preferably incorporated in a silver bromide concentration maximum portion.

In the present invention, a metal ion other than iridium can be doped in the inside and/or on the surface of the silver halide grains. As the metal ion to be used, a transition metal is preferable, and iron, ruthenium, osmium, lead, cadmium or zinc is especially preferable. It is more preferable that these metal ions are used in the form of a six-coordination complex of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. In the present invention, one of these compounds is preferably used in combination with the iridium compound. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver. In case of a ruthenium complex and an osmium complex, nitrosyl ion, thionitrosyl ion, water molecule and chloride ion are preferably used as ligands, singly or in combination. More preferably these ligands form a pentachloronitrosyl complex, a pentachlorothionitrosyl complex, or a pentachloroaquo complex. The formation of a hexachloro complex is also preferred. These complexes are preferably added, during grain formation, in an amount of $1\times10^{-10}$ mol to $1\times10^{-6}$ mol, more preferably $1\times10^{-9}$ mol to $1\times10^{-6}$ mol, per mol of silver.

Among the compounds for use in the present invention, those structures represented by formula (I) are encompassed in the scope of the claims in JP-A-6-332127, JP-A-7-140625, and JP-A-10-104809. However, the specifications of these publications contain no specific compounds corresponding to the compounds for use in the present invention at all, and hence it is impossible to predict the structure and properties of the compounds for use in the present invention from the specifications of the publications.

The formula (I) and formula (II) will be explained in detail below.

The alkyl group represented by $R_{11}$ or $R_{12}$ is a substituted or unsubstituted alkyl group having preferably 1 to 20 carbon atoms, more preferably 1 to 8 carbon atoms, and particularly preferably 1 to 4 carbon atoms. Examples of the substituent include a hydroxyl group, an alkoxy group (for example, methoxy, ethoxy, etc.), a sulfonic acid group, an ethyleneoxy group, and the like. These substituents may be further substituted with any of the above-mentioned substituents. Examples of the alkyl group represented by $R_{11}$ or $R_{12}$ include, specifically, a methyl group, an ethyl group, an n-propyl group, an i-propyl group, an n-octyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy)ethoxy]ethyl group and a 2-(2-[2-(2-hydroxyethoxy)ethoxy]ethoxy)ethyl group. $R_{11}$ and $R_{12}$ are independently preferably a hydrogen atom, a methyl group, an ethyl group, an n-propyl group, an n-butyl group or a 2-sulfoethyl group, more preferably a hydrogen atom, a methyl group, an ethyl group or a 2-sulfoethyl group, and especially preferably a hydrogen atom or a methyl group.

The preferable carbon number, substituent, and specific examples, of the alkyl group represented by $R_{13}$, $R_{14}$, $R_{21}$, $R_{22}$, $R_{23}$, or $R_{24}$, are the same as those shown for $R_{11}$, or $R_{12}$, provided that $R_{21}$ and $R_{22}$ are not $—CH_2CH_2SO_3M_1$ (where $M_1$ has the same meaning as that in formula (I)). The alkyl group represented by $R_{13}$, $R_{14}$, $R_{21}$, $R_{22}$, $R_{23}$, or $R_{24}$ is a substituted or unsubstituted aryl group having preferably 6 to 20 carbon atoms, more preferably 6 to 10 carbon atoms, and particularly preferably 6 to 8 carbon atoms. Examples of the substituent include a hydroxyl group, an alkoxy group (e.g. methoxy, ethoxy), a carboxyl group, an alkyl group (e.g. a methyl group, an ethyl group, a propyl group), a sulfonic acid group, an amino group and a carbamoyl group. These substituents may be further substituted with any of the above-mentioned substituents. Examples of the aryl group represented by $R_{13}$, $R_{14}$, $R_{21}$, $R_{22}$, $R_{23}$ or $R_{24}$ include a phenyl group, a naphthyl group, a 3,5-dicarboxyphenyl group, a 4-methoxyphenyl group and 3-isopropylphenyl group. $R_{13}$, $R_{14}$, $R_{21}$, $R_{22}$, $R_{23}$, and $R_{24}$ are independently preferably a hydrogen atom, a methyl group, an ethyl group, an n-propyl group, a 2-hydroxyethyl group, a 3-hydroxypropyl group, a 2-hydroxypropyl group, 2-sulfoethyl group, 2-(2-hydroxyethoxy)ethyl group, or a 2-[2-(2-hydroxyethoxy)ethoxy]ethyl group, more preferably a hydrogen atom, a methyl group, an ethyl group, a 2-hydroxyethyl group, a 2-hydroxypropyl group or 2-(2-hydroxyethoxy)ethyl group, and especially preferably a hydrogen atom or a methyl group.

The alkyl group having at least one asymmetric carbon atom and represented by $R_{15}$ has preferably 1 to 20 carbon atoms, more preferably 1 to 8 carbon atoms, and particularly preferably 1 to 4 carbon atoms, and may be any one of linear, branched and cyclic alkyl groups. Examples of the substituent include a hydroxyl group, an amino group, a carboxyl group, and the like, with a hydroxyl group being preferred. Specific examples of the alkyl group having at least one asymmetric carbon atom and represented by $R_{15}$ include those alkyl groups having the following formulae.

1)

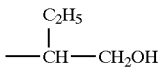

-continued

2)

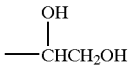

3)

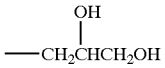

4)

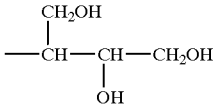

5)

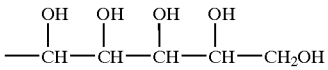

6)

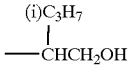

7)

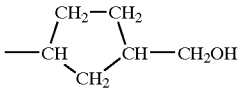

8)

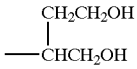

9)

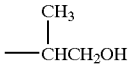

10)

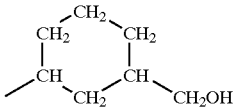

11)

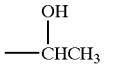

12)

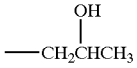

13)

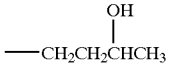

14)

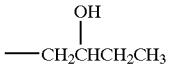

15)

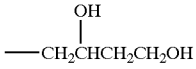

Among them, preferred examples of the alkyl group represented by $R_{15}$, having at least one asymmetric carbon atom, include 2), 3), 5), 8), 9) and 11) above, and more preferred ones are 2), 5) and 11) above. In the case where $R_{15}$ is a group represented by formula (I-a), preferably $n_{11}$ is 1 or 2, and more preferably $n_{11}$ is 1.

$$—CH_2O(CH_2CH_2O)_{n_{11}}H \qquad \text{Formula (I-a)}$$

The alkyl group having at least one asymmetric carbon atom and represented by $R_{16}$, $R_{25}$, $R_{26}$, $R_{27}$, or $R_{28}$ has preferably 1 to 20 carbon atoms, more preferably 1 to 9 carbon atoms, and particularly preferably 1 to 5 carbon atoms, and may be any one of linear, branched and cyclic alkyl groups. As examples of the substituent, those mentioned as examples of the substituent for $R_{15}$ can be mentioned, and a hydroxy group is preferable. Specific examples of the alkyl group having at least one asymmetric carbon atom and represented by $R_{16}$, $R_{25}$, $R_{26}$, $R_{27}$, or $R_{28}$ include those alkyl groups having the following formulae.

16) $-CH_2CH(C_2H_5)-CH_2OH$

17) $-CH_2CH(OH)-CH_2OH$

18) $-CH_2CH_2CH(OH)-CH_2OH$

19) $-CH_2CH(CH_2OH)CH(OH)-CH_2OH$

20) $-CH_2-CH(OH)-CH(OH)-CH(OH)-CH(OH)-CH_2OH$

21) $-CH_2CH((i)C_3H_7)CH_2OH$

22) 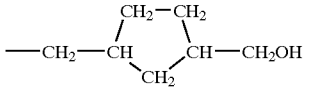

23) $-CH_2CH(CH_2CH_2OH)CH_2OH$

24) $-CH_2CH(CH_3)CH_2OH$

25) 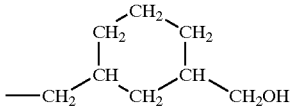

26) $-CH_2CH(OH)CH_3$

27) $-CH_2CH_2CH(OH)CH_3$

28) $-CH_2CH_2CH_2CH(OH)CH_3$

29) $-CH_2CH_2CH(OH)CH_2CH_3$

30) $-CH_2CH_2CH(OH)CH_2CH_2OH$

Among them, preferred examples of the alkyl group represented by $R_{16}$, $R_{25}$, $R_{26}$, $R_{27}$ or $R_{28}$, having at least one asymmetric carbon atom, include 17), 18), 20), 23), 24) and 26) above, and more preferred ones are 17), 20) and 26) above. In the case where $R_{16}$ is a group represented by formula (I-b), preferably $n_{12}$ is 2 or 3, and more preferably $n_{12}$ is 2.

$$-(CH_2CH_2O)_{n_{12}}H \qquad \text{Formula (I-b)}$$

In the case where $R_{25}$ or $R_{26}$ is a group represented by formula (II-a), preferably $n_{21}$ is 2 or 3, more preferably $n_{21}$ is 2.

$$-(CH_2CH_2O)_{n_{21}}H \qquad \text{Formula (II-a)}$$

Particularly preferred examples of the alkali metal atom and alkaline earth metal atom represented by $M_1$ and $M_2$ include Na and K. The ammonium group is preferably a tetraalkylammonium group, examples of which include tetraethylammonium and tetrabutylammonium. As $M_1$ and $M_2$, Na and K are most preferred. $M_1$s and $M_2$s each may be the same or different.

Among the compounds represented by the formula (I) above, those compounds, in which either one of or both of $R_1$s and $R_{16}$ have at least one hydroxyl group, are preferred. Also, among the compounds represented by the formula (II) above, those compounds, in which at least one of the groups represented by $R_{25}$ to $R_{28}$ has at least one hydroxyl group, are preferred.

The most preferred compounds among the compounds represented by the formula (I) include those compounds in which $R_{11}$, $R_{12}$, $R_{13}$ and $R_{14}$ each are a hydrogen atom or a methyl group; $R_{15}$ is the alkyl group shown in 2), 5) or 11) above or the group represented by the formula (I-a) where $n_{11}$ is 1; $R_{16}$ is the alkyl group shown in 17), 20) or 26) above or the group represented by the formula (I-b) where $n_{12}$ is 2; and $M_1$ is Na or K. On the other hand, the most preferred compounds among the compounds represented by the formula (II) include those compounds in which $R_{21}$, $R_{22}$, $R_{23}$ and $R_{24}$ each are a hydrogen atom or a methyl group; $R_{25}$ and $R_{26}$ each are the alkyl group shown in 17), 20) or 26) above or the group represented by the formula. (II-a) where $n_{21}$is 2; $R_{27}$ and $R_{28}$ each are the alkyl group shown in 17), 20) or 26) above; and $M_2$ is Na or K.

Since the compound for use in the present invention has a plurality of asymmetric carbon atoms in the molecule, a plurality of stereoisomers exist for the same structure. The present invention embraces all the possible stereoisomers, and only one of the plurality of stereoisomers may be used or a mixture of several of them may be used.

In the present invention, along with the compound represented by the formulae (I) or (II) above, a plurality of kinds of other diaminostilbene-series compounds may be used in combination. The compounds used in combination are preferably the diaminostilbene-series compounds represented by the formula (III) described in JP-A-6-329936.

As the diaminostilbene-series compounds that can be used in combination in the present invention, known or commercially available diaminostilbene-series optical brighteners may also be used. The commercially available compounds are described in, for example, "Senshoku Note (Note on Staining)", 19$^{th}$ edition (Shikisensha co., Ltd.), p.165–168. Among the products described in this publication, Blankophor BSUliq (trade name) and Hakkol BRK (trade name) are preferred.

Hereinafter, specific examples of representative compounds represented by the formula, (I) or (II) that can be used in the present invention are shown. In the formulae below, He indicates a methyl group and Et indicates an ethyl group.

I-1)
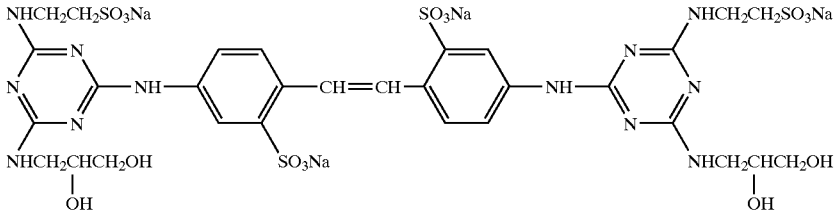
I-2)
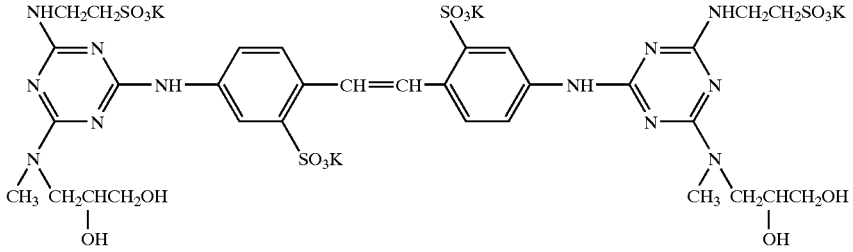
I-3)
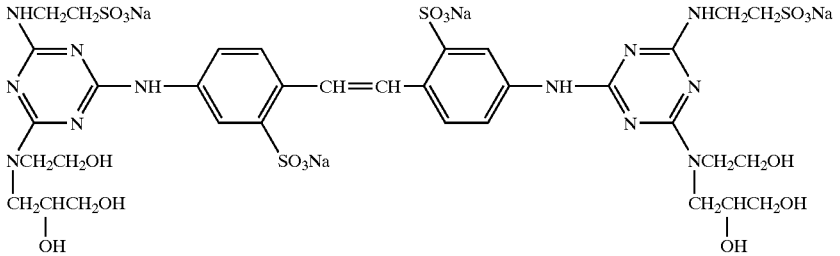
I-4)
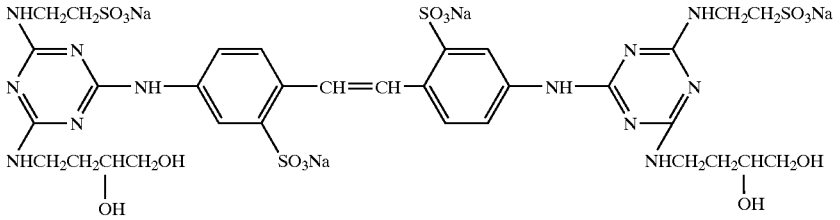
I-5)
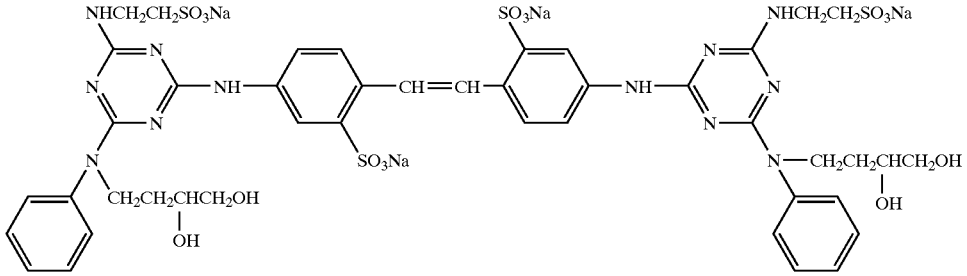
I-6)
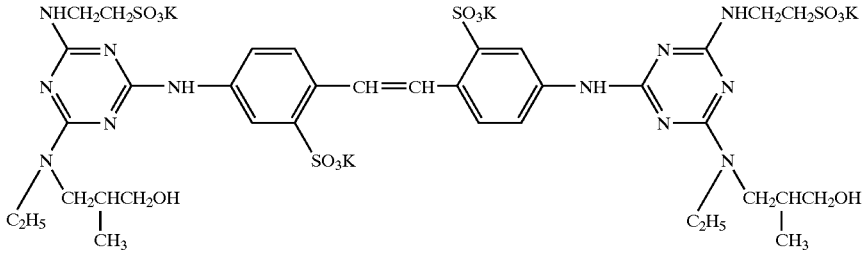

-continued
I-7)
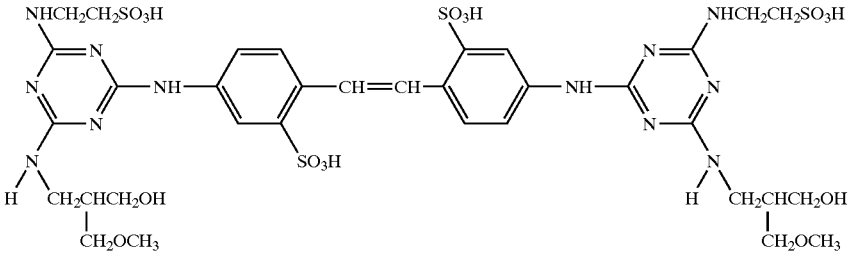
I-8)
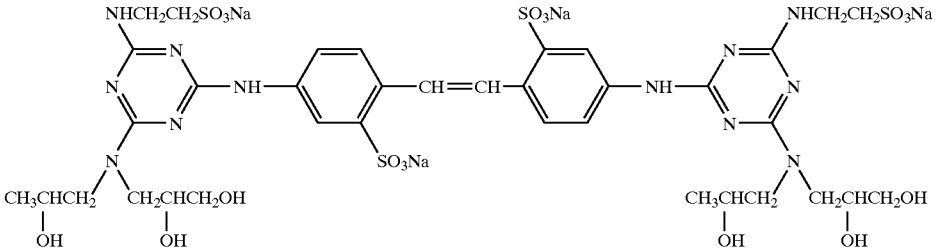
I-9)
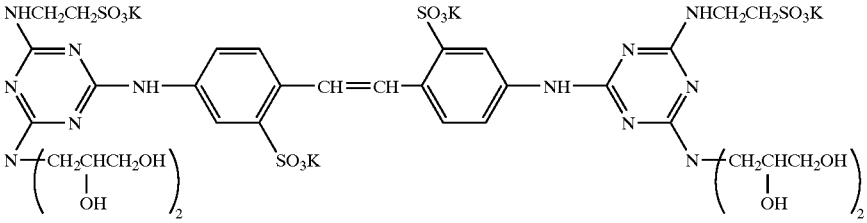
I-10)
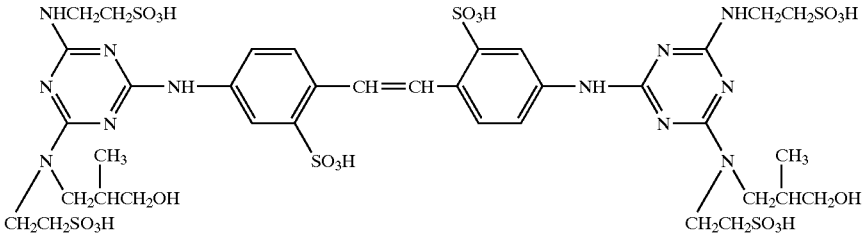
•6$Et_3N$
I-11)
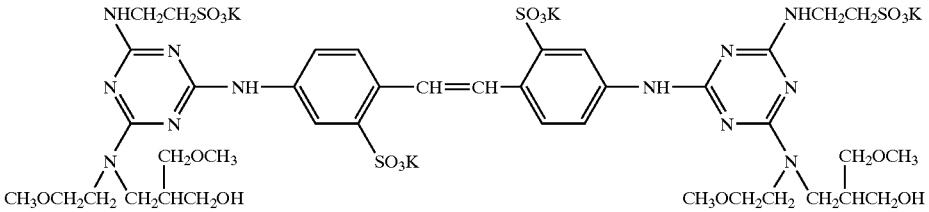
I-12)
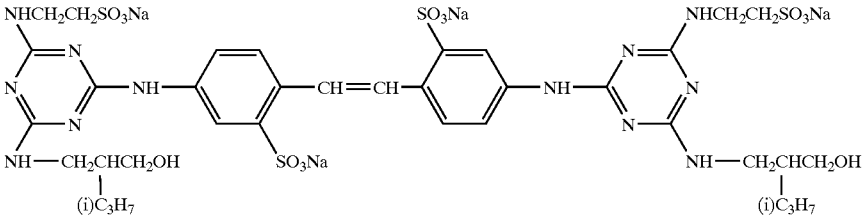

-continued
I-13)
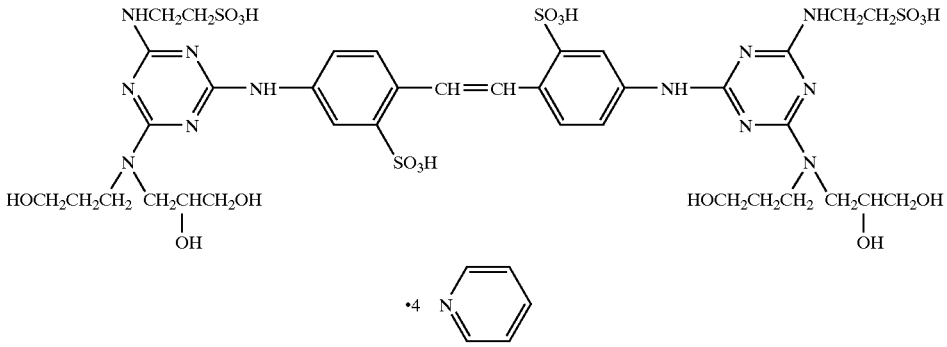
I-14)
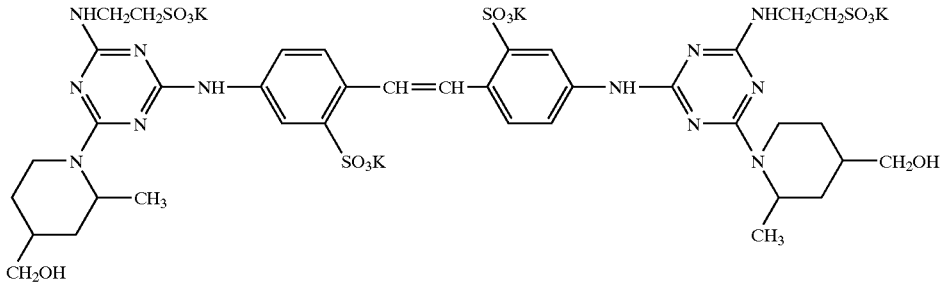
I-15)
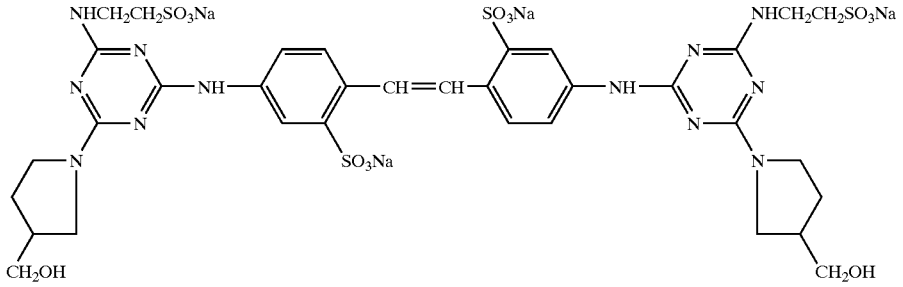
I-16)
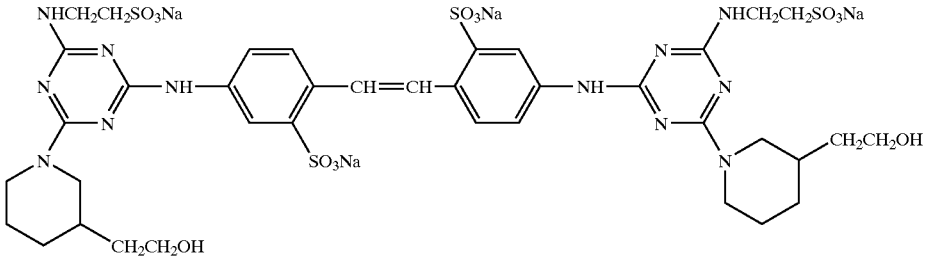
I-17)
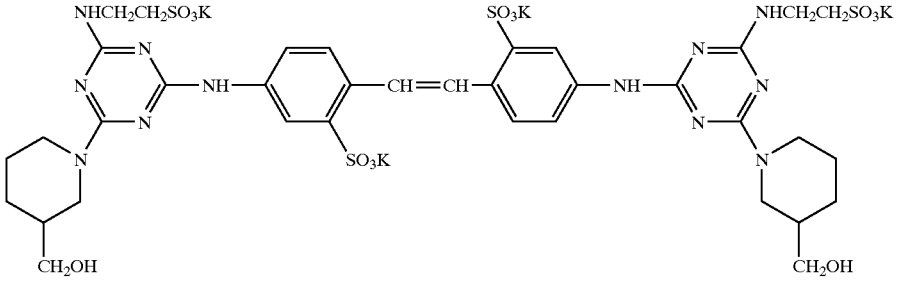

-continued
I-18)
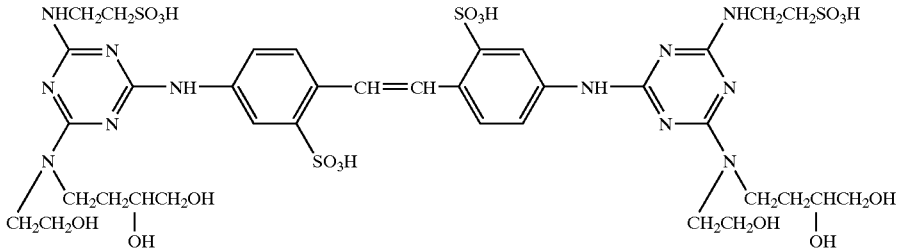
I-19)
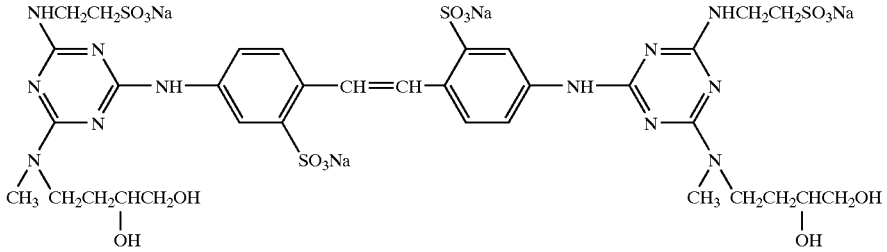
I-20)
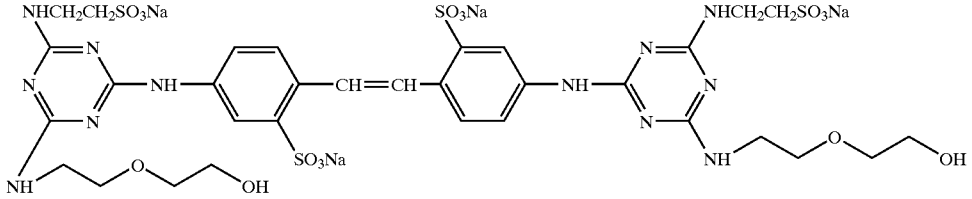
I-21)
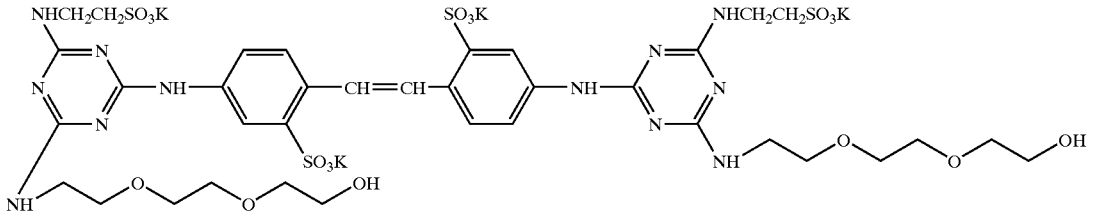
I-22)
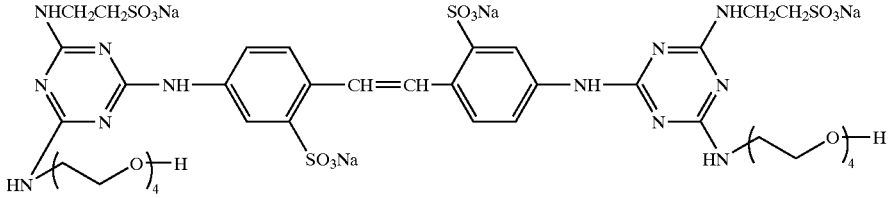
I-23)
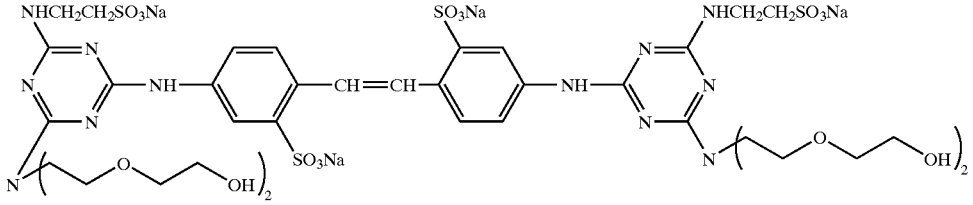
I-24)
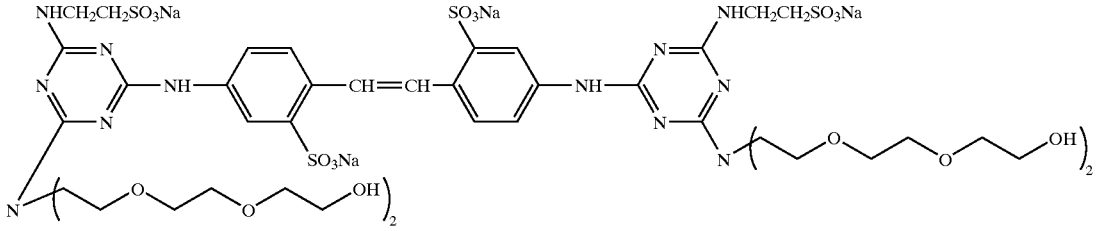

-continued
I-25)
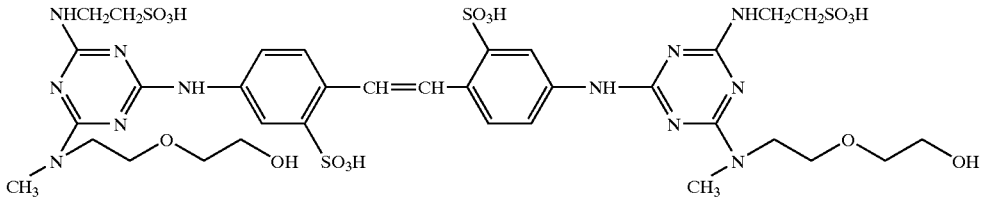
•4NMe$_3$
I-26)
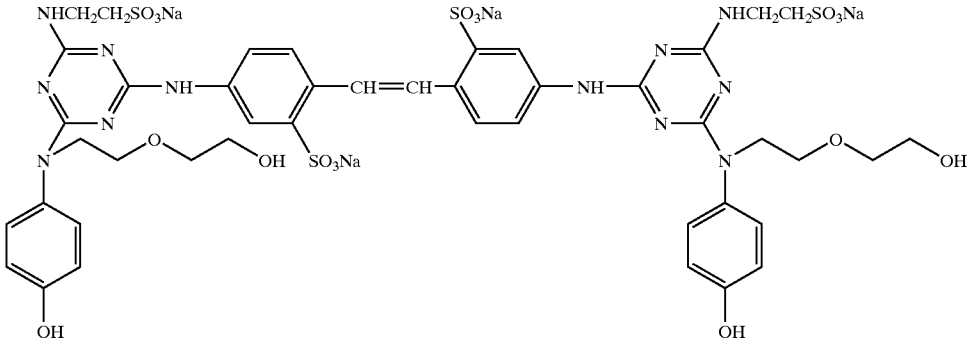
I-27)
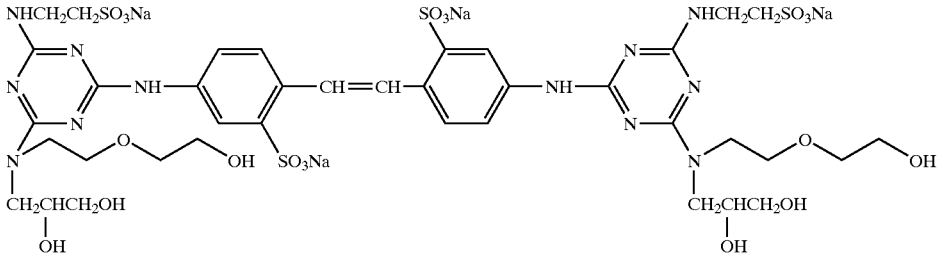
I-28)
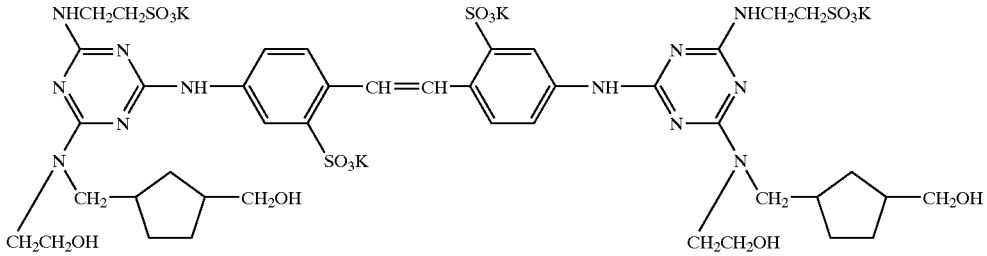
I-29)
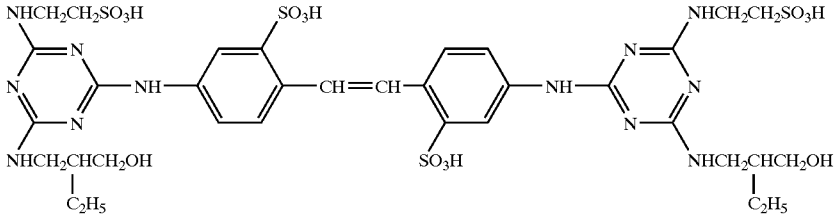
I-30)
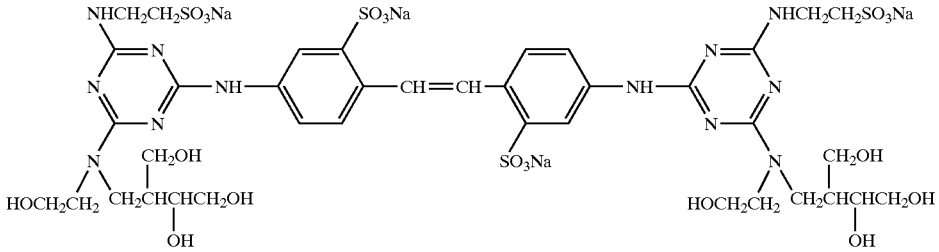

-continued
I-31)
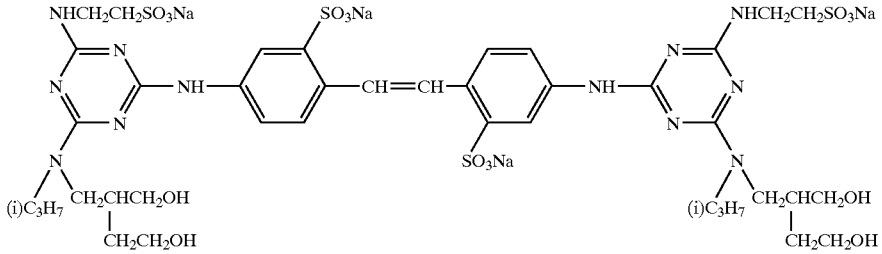
I-32)
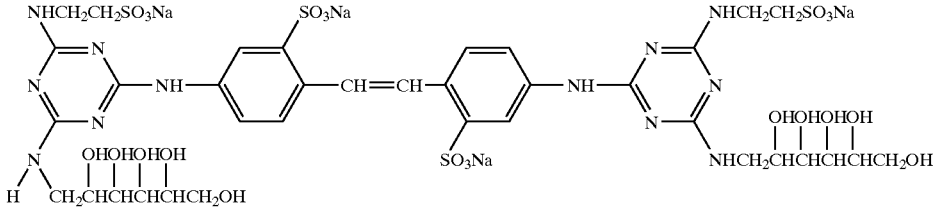
I-33)
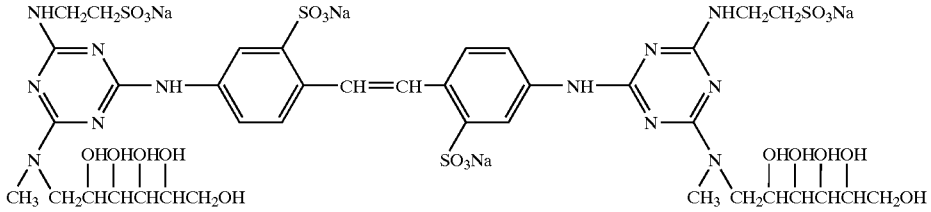
I-34)
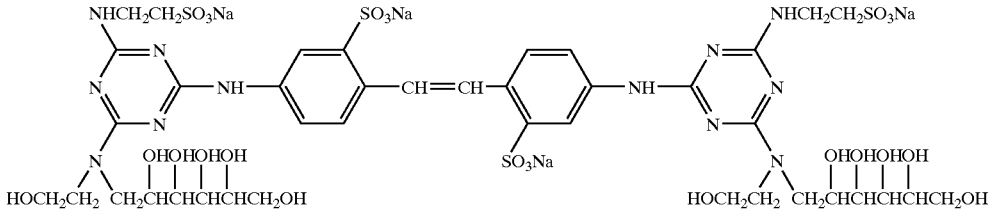
I-35)
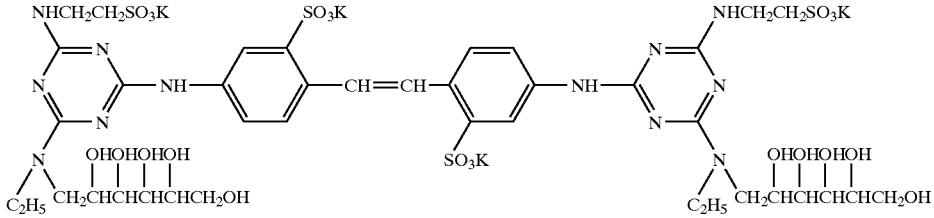
I-36)
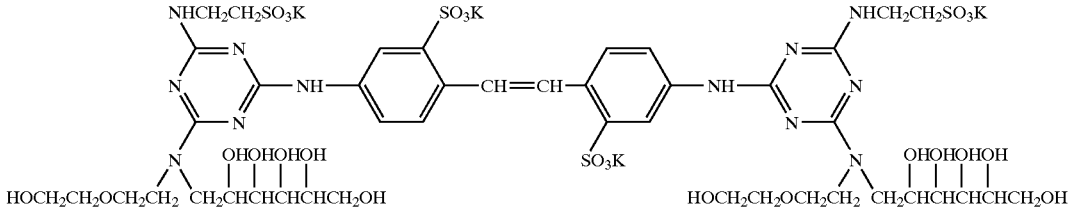
I-37)
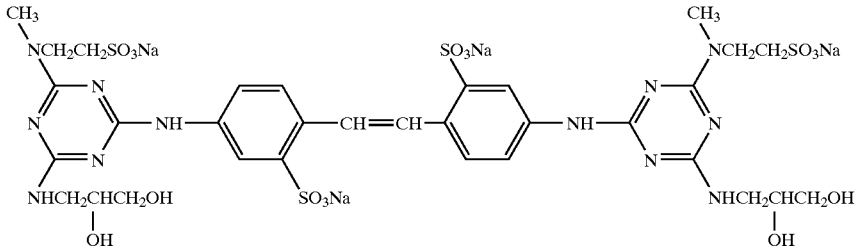

-continued
I-38)
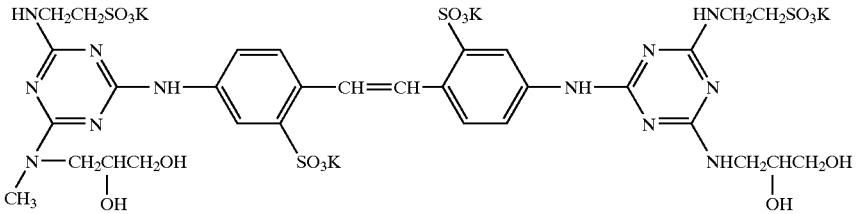
I-39)
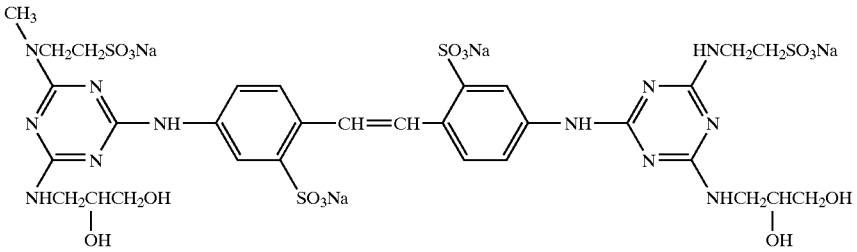
I-40)
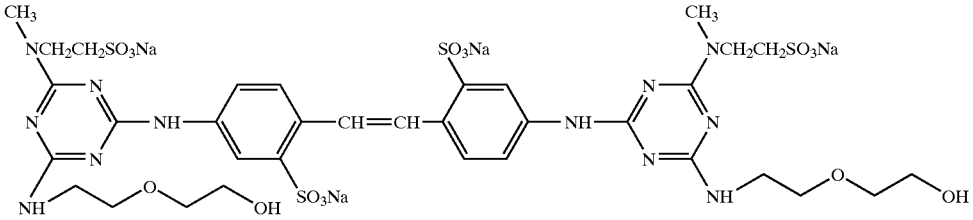
I-41)
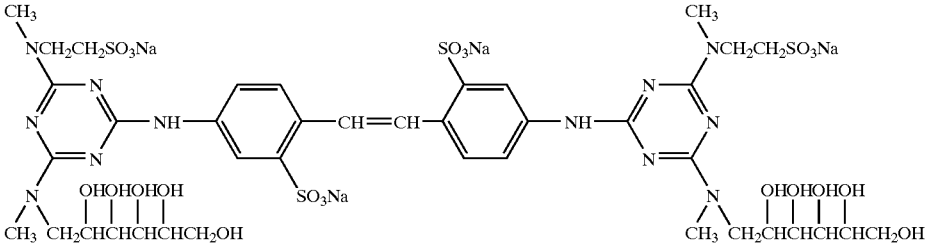
I-42)
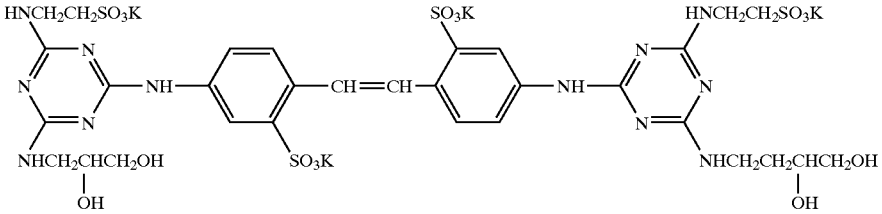
I-43)
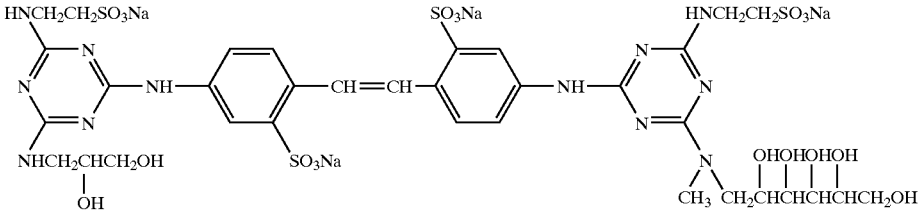

-continued
I-44)
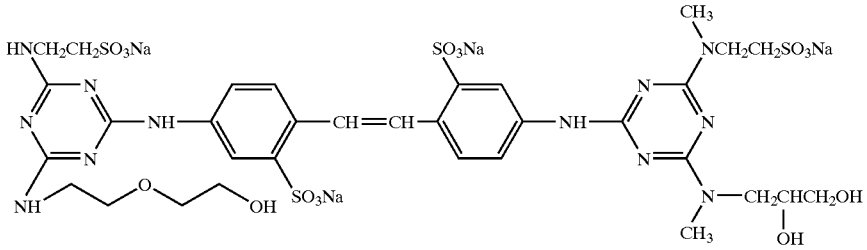
I-45)
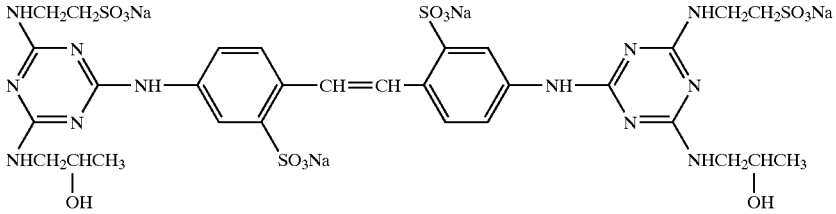
I-46)
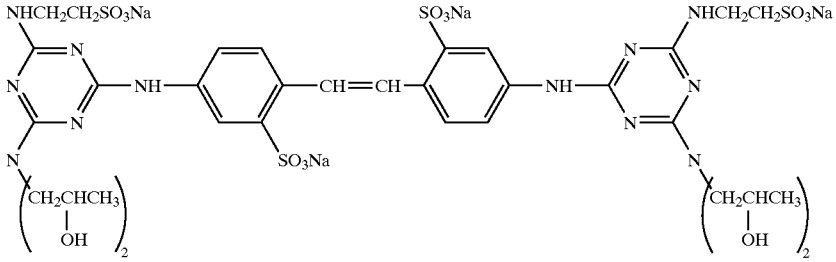
I-47)
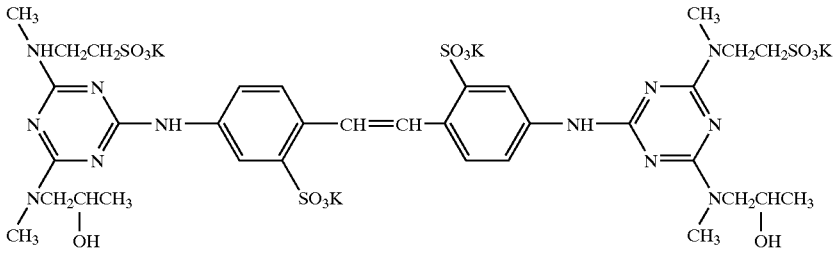
I-48)
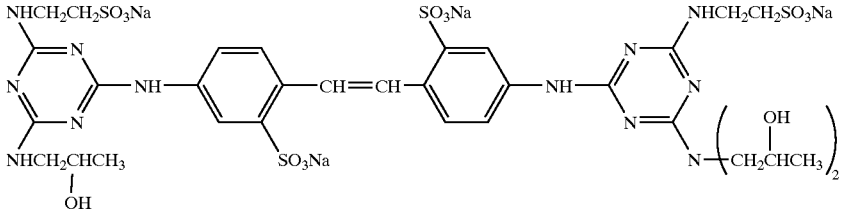
II-1)
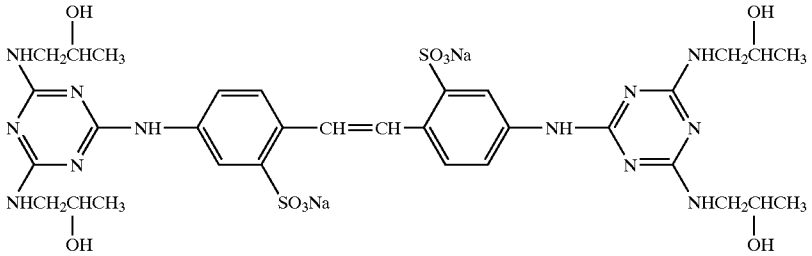

-continued
II-2)
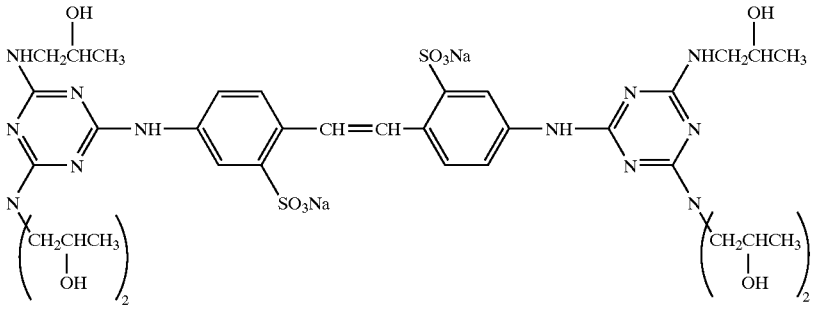
II-3)
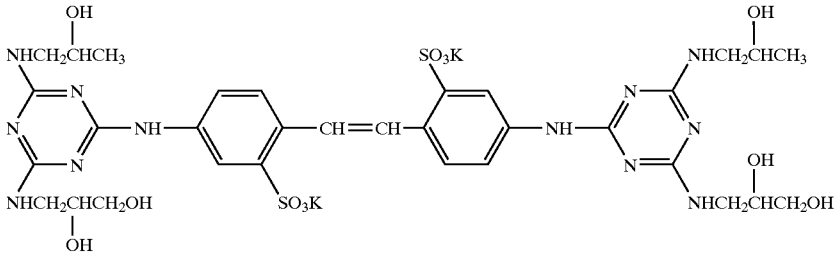
II-4)
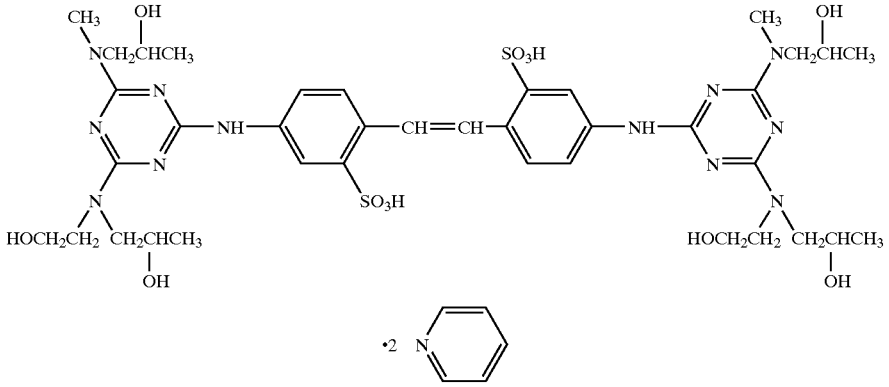
II-5)
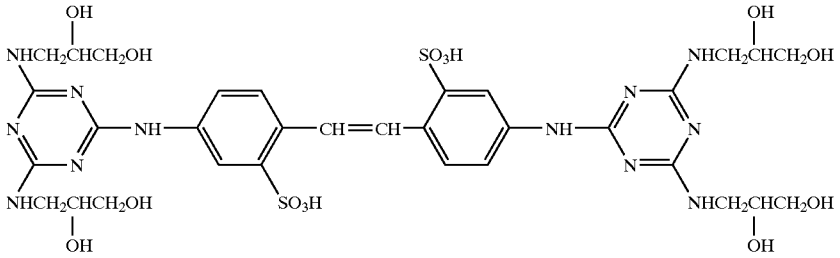
II-6)
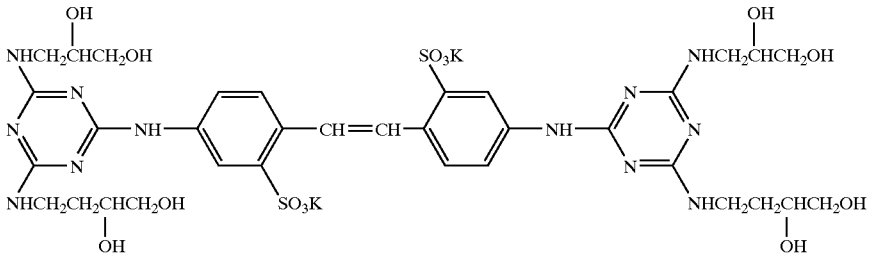

-continued
II-7)
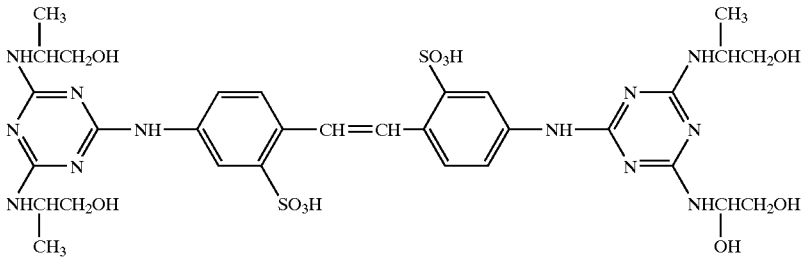
•2 $Et_3N$
II-8)
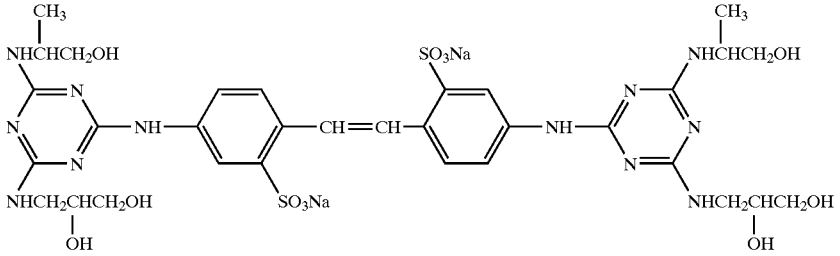
II-9)
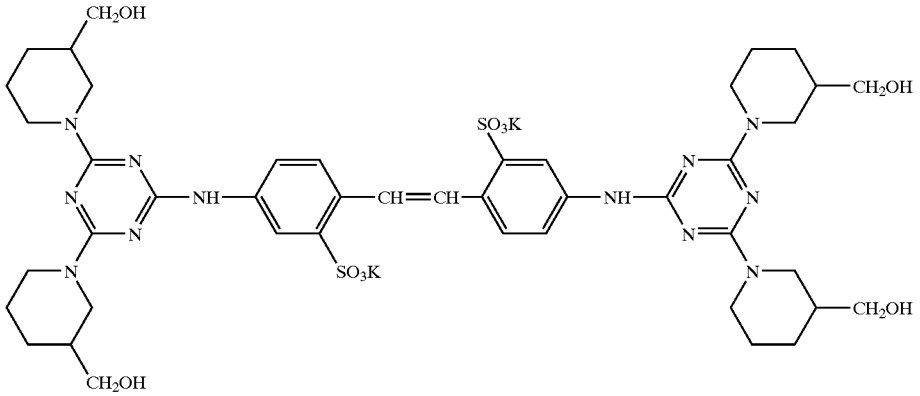
II-10)
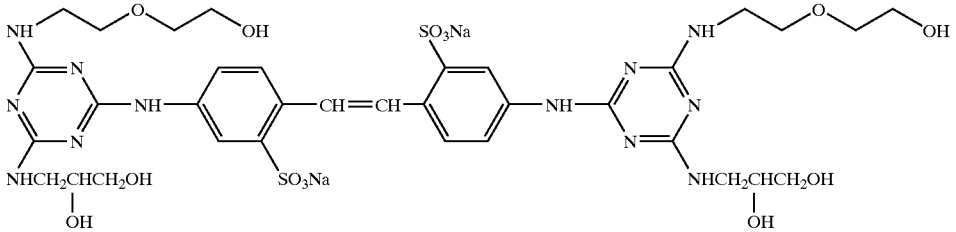
II-11)
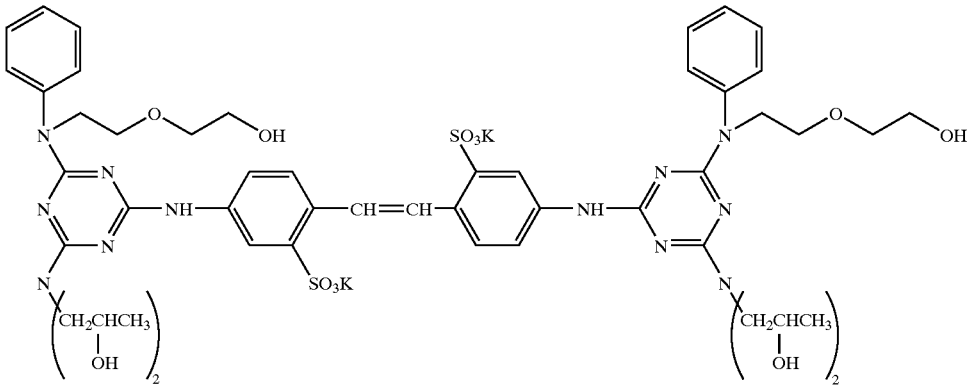

-continued

II-12)

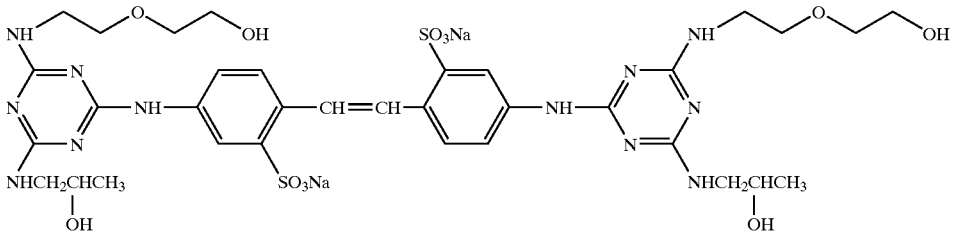

II-13)

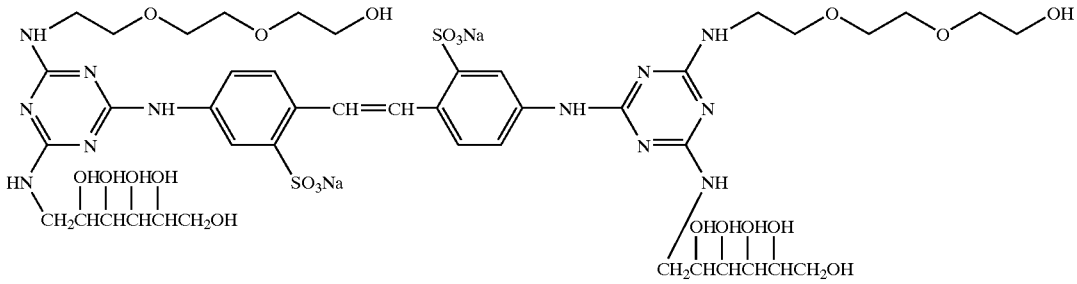

II-14)

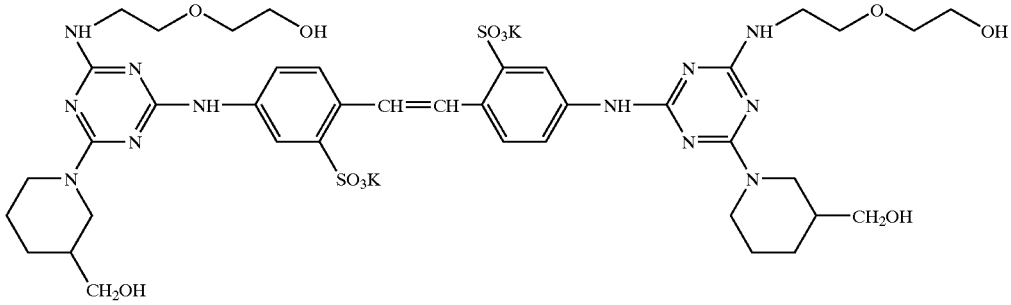

II-15)

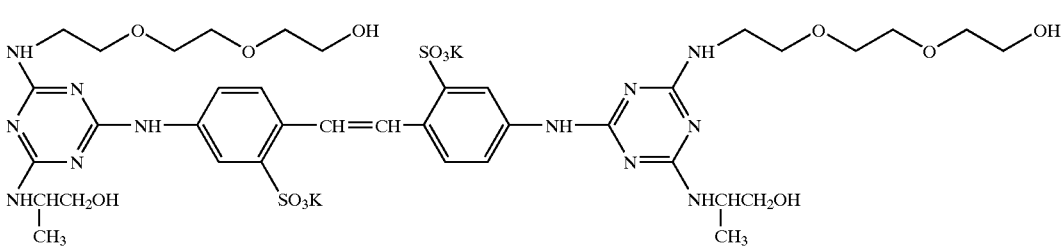

II-16)

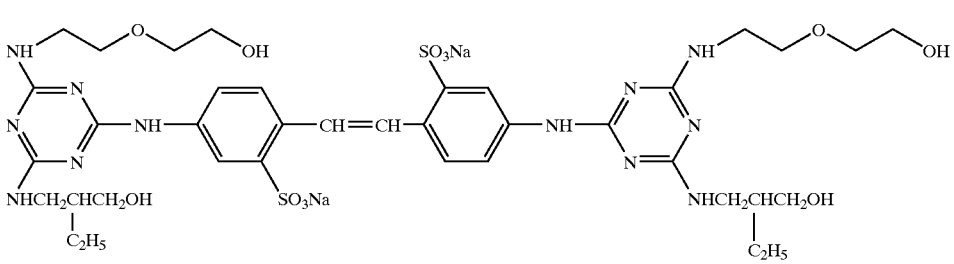

The compounds represented by the formulae (I) or (II) can be synthesized referring to, for example, Kouji Matsui, Yuki Kagaku Gosei Kagaku Kyokai-shi (Journal of Synthetic Organic Chemistry, Japan), Vol. 17, p. 528 (1959), and Japanese Patent No. 2,618,748. Namely, a method in which cyanuric chloride is sequentially reacted first with a diaminostilbene derivative and then with an amine is preferred. Alternatively, it is also preferable that a dialkylaminostilbene derivative is reacted lastly. Examples of the solvent to be used in this reaction include, for example, water and organic-solvents such as alcohols, ketones, ethers and amides. Water and water-soluble organic solvents are preferred. Mixed solvents of these solvents may also be used. Among them, mixed solvent systems of water and acetone are most preferred. Examples of the base in this reaction include organic bases such as triethylamine, pyridine, 1,8-diazabicyclo[5,4,0]-7-undecene; inorganic bases such as sodium hydroxide, potassium hydroxide, sodium carbonate, potassium carbonate, sodium hydrogencarbonate, and sodium hydride. Inorganic bases are preferred. Among them, sodium hydroxide, potassium hydroxide, sodium carbonate, and potassium carbonate are preferred. The reaction can proceed at a temperature within the range of from −20° C. to 120° C., and preferably from −10° C. to 90° C. More specifically, the reaction temperature is preferably from −10° C. to 10° C. in a first stage, from 0° C. to 40° C. in a second stage and from 50° C. to 90° C. in a third stage.

SYNTHETIC EXAMPLE 1

The exemplified compound (I-1) was synthesized according to the following route:

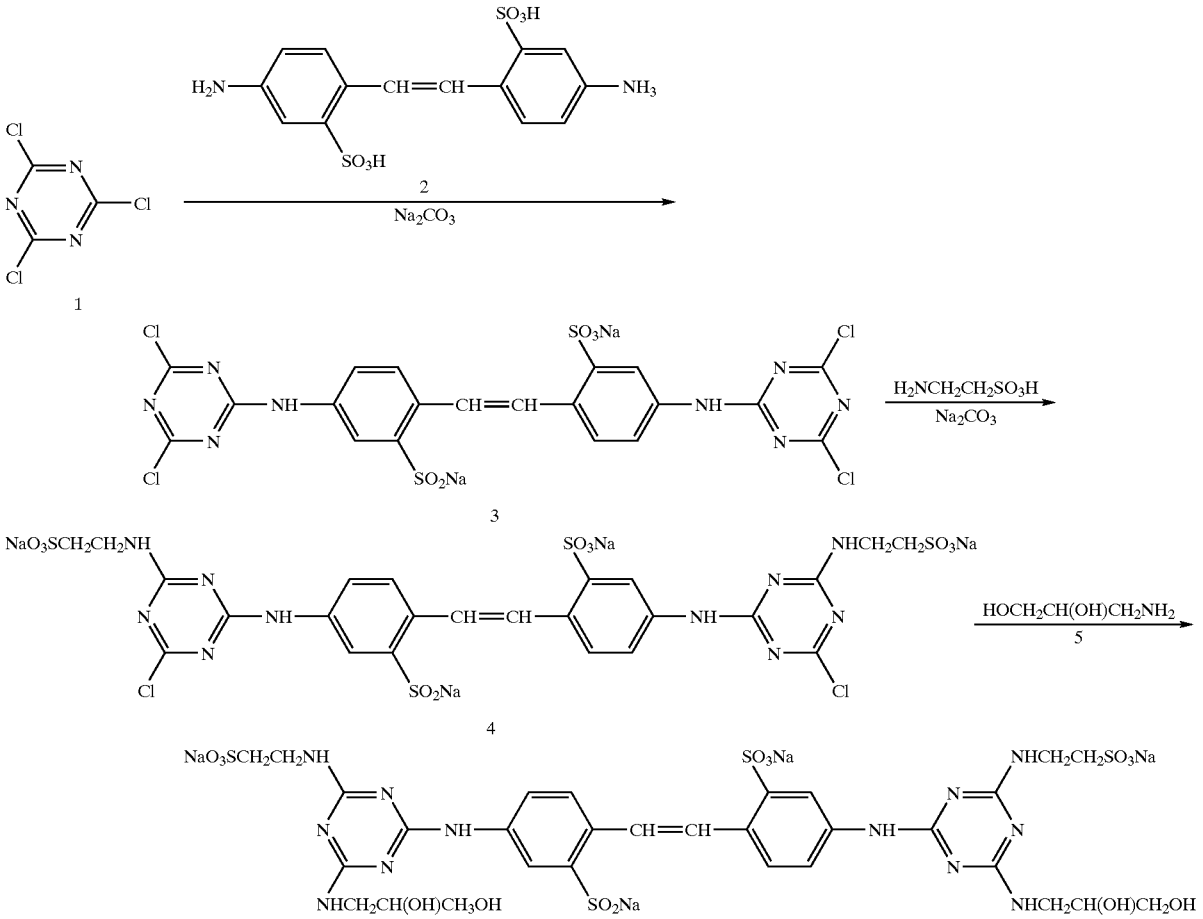

Exemplified compound (I-1)

(Synthesis of Compound (3))

In a three-neck flask, 103.5 g of compound (1) and 680 ml of acetone were charged, and the mixture was cooled to an inner temperature of −5° C. on an ice/acetone bath. To this, an aqueous solution composed of 101.9 g of compound (2), 58.3 g of sodium carbonate and 960 ml of water was dripped over 1 hour while stirring. On this occasion, the inner temperature of the resulting mixture increased to −1° C. After completion of the dripping, the ice/acetone bath was removed, and, in this state, stirring was continued for 1 hour. Thereafter, the crystals that precipitated were suction-filtered to obtain the objective compound (3). This was provided as it was to the subsequent step without drying or purification.

(Synthesis of Compound (4))

In a three-neck flask, Compound (3) obtained in the previous step and 1.9 liters of water were charged. While stirring the mixture in a water bath, 68.8 g of taurine was added, and, subsequently, an aqueous solution of 58.3 g of sodium carbonate dissolved in 275 ml of water was dripped over 1 hour. After completion of the dripping, the water bath was removed, and, in this state, stirring was continued for 3 hours. To the obtained mixture, 550 g of sodium chloride was added and an additional 1 hour of stirring was performed. The crystals that precipitated were suction-filtered to obtain the objective compound (4). This was provided as it was to the subsequent step without drying or purification.

(Synthesis of: Exemplified Compound (I-1))

In a three-neck flask, Compound (4) obtained in the previous step and 825 ml of water were charged. While stirring the mixture at room temperature, 125.3 g of compound (5) was dripped over 10 minutes. After completion of the dripping, the resulting mixture was stirred at an inner temperature of 85° C. for 3 hours, and the obtained reaction mixture was concentrated with using a rotary evaporator. When the residue became about 800 ml, crystals started to precipitate, so the concentration was stopped and the mixture was stirred as it was under ice cooling. The crystals that precipitated were suction-filtered. To the thus-obtained crystals, 1.5 liters of methanol was added, and the mixture was stirred under reflux with heating for 1 hour. This was cooled to room temperature and then filtered by suction to obtain 206.0 g of the objective compound (I-1) (yield 72%).

$\lambda max(H_2O)=346.3$ nm ($\epsilon=4.83\times10^4$)

Further, by examination of the obtained compound with liquid chromatography, its purity was found to be 96.0%. The conditions for liquid chromatography were as follows.

Column: TSK-gel ODS-80TM (trade name, manufactured by Tosoh Corporation)

Eluant: Solution A, 20 ml of PIC A reagent (trade name, manufactured by waters Investments, Ltd.) was added to 1 liter of water; Solution B, 20 ml of PIC A reagent was added to a mixed solution of 800 ml of methanol and 200 ml of water; A gradient of solution A/solution B=50/50 (O min)→0/100 (35 min) was formed.

Detection wavelength: 346 nm

The purity was obtained from the area of peak recorded on the chart obtained under the above-mentioned conditions.

SYNTHETIC EXAMPLE 2

The exemplified compound (I-20) was synthesized according to the following route:

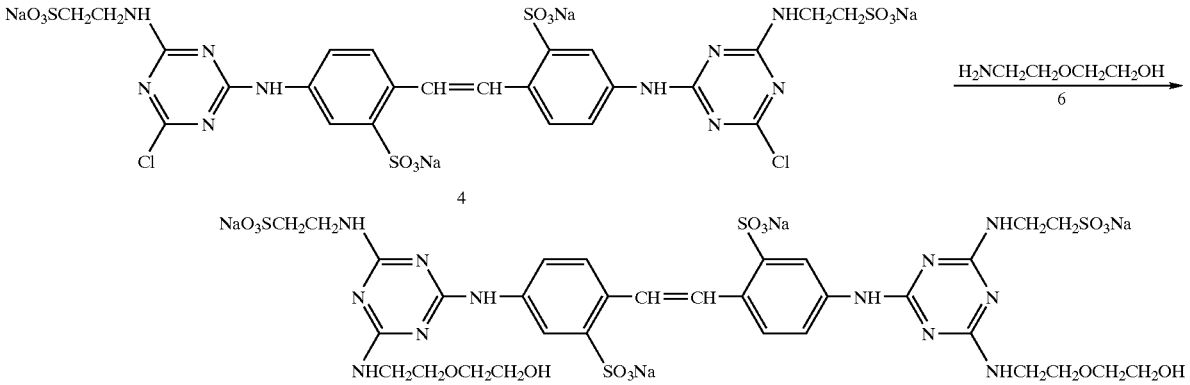

Exemplified compound (I-20)

(Synthesis of Exemplified Compound (I-20))

In a three-neck flask, Compound (4) obtained in the same scale and by the same synthesis method as those in Synthesis example 1, and 825 ml of water were charged. While stirring the mixture at room temperature, 144.4 g of compound (6) was dripped over 10 minutes. After completion of the addition, the resulting mixture was stirred at an inner temperature of 85° C. for 3 hours, and the obtained reaction mixture was concentrated with using a rotary evaporator until the residue became about 800 ml. The mixture was stirred as it was under ice cooling, and the crystals that precipitated were suction-filtered. To the thus-obtained crystals, 1.5 liters of methanol was added and the mixture was stirred under reflux with heating for 1 hour. This mixture was cooled to room temperature, and then filtered by suction to obtain 249.7 g of the objective exemplified compound (I-20) (yield 85%).

$\lambda max(H_2O)=354.5\ nm(\epsilon=4.92\times10^4)$

Further, by examination of the obtained compound with liquid chromatography, its purity was found to be 97.3%.

The conditions for liquid chromatography were the same as those in Synthetic Example 1.

SYNTHETIC EXAMPLE 3

The exemplified compound (I-33) was synthesized according to the following route:

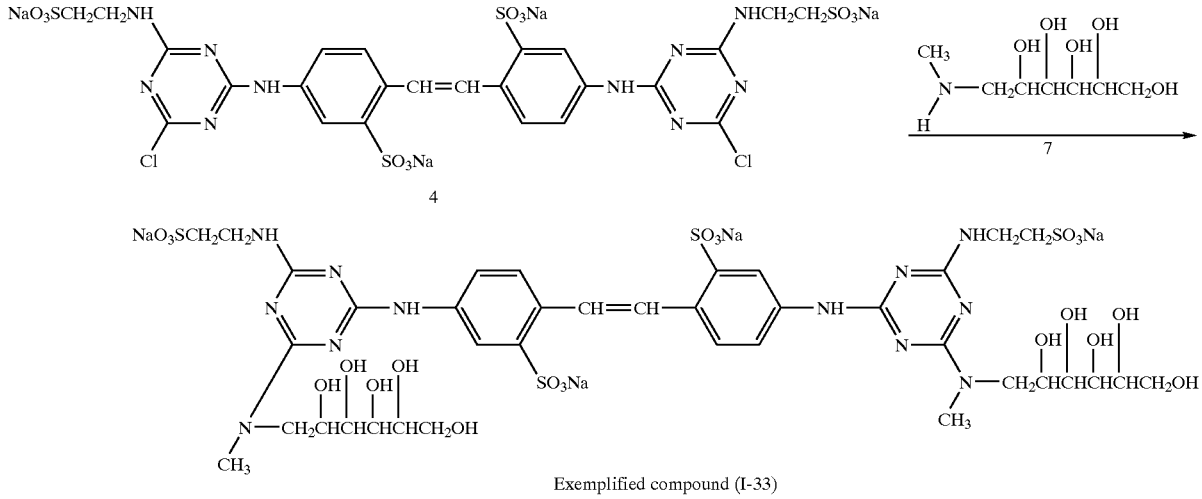

Exemplified compound (I-33)

(Synthesis of Exemplified Compound (I-33))

In a three-neck flask, Compound (4) obtained in the same scale and by the same synthesis method as in Synthetic Example 1 and 825 ml of water were charged. While stirring the mixture at room temperature, 268.5 9 of compound (7) was added over 10 minutes. After completion of the addition, the resulting mixture was stirred at an inner temperature of 85° C. for 3 hours, the obtained reaction mixture was concentrated by using a rotary evaporator. The concentration was stopped when the residue became about 900 ml, and the mixture was stirred as it was under ice cooling. The crystals that precipitated were filtered by suction. To the thus-obtained crystals, 1.5 liters of methanol was added, and the mixture was stirred under reflux with heating for 1 hour. This was cooled to room temperature and then filtered by suction to obtain 302.4 g of the objective exemplified compound (I-33) (yield 88%).

$\lambda max(H_2O)=348.6$ nm ($\epsilon=4.36\times10^4$)

Further, by examination of the obtained compound with liquid chromatography, its purity was found to be 96.1%. The conditions for liquid chromatography were the same as those in Synthetic Example 1.

SYNTHETIC EXAMPLE 4

The exemplified compound (II-5) was synthesized according to the following route:

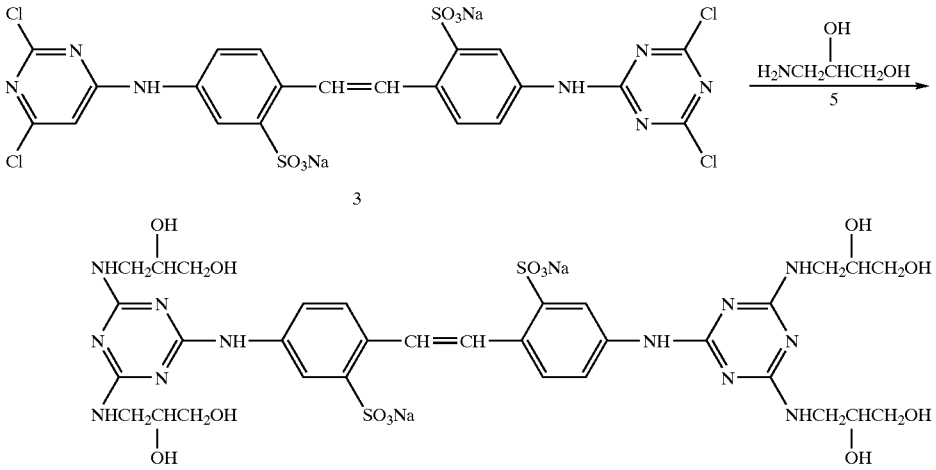

Exemplified compound (II-5)

(Synthetic of Exemplified Compound (II-5)

In a three-neck flask, Compound (3) obtained on the same scale and by the same synthesis method as in. Synthetic Example 1 described above, and 825 ml of water were charged, and, under ice cooling, 256.0 g of compound (5) was dripped to the resulting mixture over 30 minutes. Thereafter, the obtained mixture was stirred at room temperature for 3 hours, and further stirred with heating at an inner temperature of 85° C. for 5 hours. Subsequently, while maintaining the inner temperature of the reaction mixture at 15° C. or less on an ice bath, 500 ml of concentrated hydrochloric acid was added to the reaction mixture. Further, 2 liters of acetone was added thereto, and the ice bath was removed. After stirring for 2 hours, crystals that formed were filtered by suction. To the crystals thus obtained, 1 liter of methanol was added. The obtained mixture was stirred with heating under reflux and then cooled to an inner temperature of 30° C. The crystals formed were suction-flittered and then dried, to obtain 216 g of the objective exemplified compound (II-5) (yield 87%).

$\lambda max(H_2O)=346.3$ nm ($\epsilon=4.86\times10^4$)

Further, by examination of the obtained compound with liquid chromatography, its purity was found to be 93.5%. The conditions for liquid chromatography were the same as that in Synthesis example 1.

Next, processing compositions for silver halide color photosensitive materials (hereinafter, referred to as "processing compositions") for use in the present invention will be described in detail. In the present invention, the term "processing composition" means a processing composition required in the process for performing image formation of a silver halide color photographic photosensitive material. Specific examples thereof include a color-development composition, a bleaching composition, a bleach-fixing composition, a fixing composition, a washing composition and a stabilizing composition. Furthermore, the processing composition may be a black-and-white development composition and a reversal composition and a pre-bleaching composition. These processing compositions may be prepared as tank solutions or replenishers in working solution concentrations or as concentrated solutions. In the case where the processing composition for use in the present invention is a concentrated solution, it is mixed with water in a predetermined ratio when in use, and employed as a replenisher or a tank solution. The compound for use in the present invention is characterized by having excellent stability without causing deposition, in a composition being in a state of solution. However, it can also be used in processing compositions of various forms, such as granules, tablets, powder and slurry. The term "processing solution" in the present invention means a tank solution or a replenisher, for any one of the above processing compositions.

In the processing composition that can be used in the present invention, the concentration of the compound of the formula (I) and/or compound of the formula (II) in a working solution is generally 0.05 to 20 mmol/l, preferably 0.15 to 15 mmol/l, and more preferably 0.2 to 10 mmol/l. When the processing composition in the present invention is used after diluted with water, the concentration of the compound(s) in the processing composition is expressed as a value obtained by multiplying the concentration of the compound(s) in the working solution by a concentration factor.

The image forming method of the present invention uses the processing composition for use in the present invention in at least one processing step. The processing composition for use in the invention may be used in a plurality of processing steps or in all the processing steps.

The processing composition for use in the present invention can be produced by various production methods. Among them, the following three methods give good results. However, in implementing the present invention, the production method for the processing composition is not limited to the following three methods.

[Method A] A method in which a small amount of water is introduced into a mixing tank in advance, and then constituent chemicals are sequentially charged while stirring.

[Method B] A method in which constituent chemicals are mixed in a mixing tank in advance, and then a small amount of water is charged to the tank at one time.

[Method C] A method in which constituent chemicals are divided into:appropriate groups in advance, and each group is dissolved in water or a hydrophilic organic solvent to form a concentrated solution, and the thus obtained concentrated solutions are mixed.

Alternatively, production methods which partially incorporating the above-mentioned methods may also be employed.

Next, it will be described on the cases where the processing composition for use in the invention is any one of a color development composition, a bleaching composition, a bleach-fixing composition, a fixing composition, a washing composition, or a stabilizing composition.

The color development composition for use in the present invention contains a color developing agent, which is preferably a known aromatic primary amine color developing agent, and particularly preferably a p-phenylenediamine derivative. Hereinafter, representative examples thereof will be shown. However, the present invention should not be considered to be limited thereto. In addition, in recent years, some black-and-white photosensitive materials contain a coupler for developing black color, and develop black-and-white images with a general-purpose color developer. The processing compositions for use in the present invention are also applicable to this type of photosensitive materials.

N-1) N,N-diethyl-p-phenylenediamine
N-2) 4-amino-N,N-diethyl-3-methylaniline
N-3) 4-amino-N-(β-hydroxyethyl)-N-methylaniline
N-4) 4-amino-N-ethyl-N-(β-hydroxyethyl)aniline
N-5) 4-amino-N-ethyl-N-(β-hydroxyethyl)-3-methylaniline
N-6) 4-amino-N-ethyl-N-(3-hydroxypropyl)-3-methylaniline
N-7) 4-amino-N-ethyl-N-(4-hydroxybutyl)-3-methylaniline
N-8) 4-amino-N-ethyl-N-(β-methanesulfonamidoethyl)-3-methylaniline
N-9) 4-amino-N,N-diethyl-3-(β-hydroxyethyl)aniline
N-10) 4-amino-N-ethyl-N-(β-methoxyethyl)-3-methylaniline
N-11) 4-amino-N-(β-ethoxyethyl)-N-ethyl-3-methylaniline
N-12) 4-amino-N-(3-carbamoylpropyl)-N-n-propyl-3-methylaniline
N-13) 4-amino-N-(4-carbamoylbutyl)-N-n-propyl-3-methylaniline
N-14) N-(4-amino-3-methylphenyl)-3-hydroxypyrrolidine
N-15) N-(4-amino-3-methylphenyl)-3-hydroxymethylpyrrolidine
N-16) N-(4-amino-3-methylphenyl)-3-pyrrolidinecarboxamide Among the p-phenylenediamine derivatives described above, exemplified compounds N-5), N-6), N-7), N-8) and N-12) are preferred, with N-5) and N-8) being particularly preferred. These p-phenylenediamine derivatives are generally in the form of sulfates, hydrochrorides, p-toluenesulfonates, naphthalenedisulfonates, N,N-bis(sulfonatoethyl)hydroxylamines, in a solid state. Alternatively, they may be added as free forms having no counter salt.

The concentration of the aromatic primary amine developing agent in a working solution is generally 4 to 100 mmol/l, preferably 6 to 50 mmol/l, and more preferably 8 to 25 mmol/l.

A compound that prevents deposition of the color developing agent may be added to the color developer in accordance with the present invention. Examples thereof include polyethylene glycols, arylsulfonic acids, alkylsulfonic acids and the urea compounds described in JP-A-11–174643. Among these, particularly preferred are those compounds that give particularly less influence on photographic properties and exhibit good effects, such as diethylene glycol, polyethylene glycol 300, p-toluenesulfonic acid and its salt, a linear alkylsulfonic acid having 5 to 9 carbon atoms or its salts, and ethylene urea.

The color development composition for use in the present invention preferably contains a compound that prevents deterioration by air oxidation of a color developing agent, i.e., a preservative. As an inorganic preservative, sulfites and hydroxylamine are preferred. They exhibit significant preserving action. Also, it is preferred that the inorganic preservative is used in combination with an organic preservative. Since in some cases, depending on the objective photosensitive material, sulfites and hydroxylamine give an undesirable influence on the photographic properties in the process of color development, the color development composition may contain only one of them in one case or it may contain substantially none of them and contains only an organic preservative in another case.

As the organic preservative, hydroxylamine derivatives, hydroxam acids, hydrazides, phenols, α-hydroxyketones, α-aminoketones, saccharides, monoamines, diamines, polyamines, quaternary ammoniums, nitroxy radicals, alcohols, oximes, diamides, condensed ring amines, cyclic amides, salicylic acids, polyethyleneimines, alkanolamines and aromatic polyhydroxy compounds are effective.

Among the above-mentioned organic preservatives, those hydroxylamine derivatives described in JP-A-3–56456 and JP-A-3–33845 and those compounds described in JP-A-3-33846 and JP-A-6-148841 are particularly preferred.

Preferably, a hydroxylamine derivative is used in combination with an alkanolamine, in consideration of improvement in stability of the color developer in continuous processing. The compounds that are particularly preferred for combined use with a hydroxylamine include trisisopropanolamine and triethanolamine. Also, combined use with a cyclic amide compound is also preferable. Among cyclic amide compounds, ε-caprolactam is particularly preferred.

The pH of the color development composition for use in the present invention is preferably 9.5 to 13.5. The color developer prepared therefrom preferably has pH of 9.0 to 12.2, and more preferably pH of 9.9 to 11.2. To maintain the pH, it is preferred to add a buffer to the color developer. As the buffer, potassium or sodium salts of inorganic salts such as carbonates, hydrogen carbonates, phosphates, borates, and tetraborates are preferred. Also, organic compounds such as 5-sulfosalicylic acid, β-alanine, proline, and tris (hydroxyamino)methane can also be preferably used. However, the present invention should not be considered to be limited to these compounds. Preferably, the above buffer is added so that, for example, the concentration of the above-mentioned buffer in a color developer replenisher becomes 0.1 mol/l or more, and particularly 0.1 to 0.4 mol/l.

The color development composition that can be used in the present invention may contain various chelating agents, which are precipitation inhibitors for calcium, magnesium, and the like. The chelating agents may be used singly or in combination of two or more of them. Preferred compounds as the chelating agent include nitrilotriacetic acid, diethylenetriaminepentaacetic acid, ethylenediaminetetraacetic acid, N,N,N-trimethylenephosphonic acid, ethylenediamine-N,N,N', N'-tetramethylenesulfonic acid, ethylenediaminesuccinic acid (s,s-form), 2-phosphonobutane-1,2,4-tricarboxylic acid, 1-hydroxyethylidene-1,1-diphosphonic acid, 1,2-dihydroxybenzene-4,6-disulfonic acid, and the like. It is just needed to add the chelating agent to a developer in an amount that is enough to mask metal ions in the color developer. Usually, the chelating agent is added so that its concentration becomes about 0.1 g/l to 10 g/l.

An arbitrary development accelerator may be added to the color development composition for use in the present invention as needed. Examples of the development accelerator include polyalkylene oxides, 1-phenyl-3-pyrazolidones, alcohols, carboxylic acids, and the like.

An arbitrary antifoggant may be added to the color development composition for use in the present invention as needed. Examples of the antifoggant include metal halides such as sodium chloride, potassium bromide, and potassium iodide, and organic antifoggants represented by nitrogen-containing heterocyclic compounds. Examples of the organic antifoggant include benzotriazole, 6-nitrobenzimidazole, 5-nitroisoindazole, 5-methylbenzotriazole, 5-nitrobenzotriazole, 5-chlorobenzotriazole, 2-thiazolylbenzoimidazole, 2-thiazolylmethylbenzimidazole, indazole, hydroxyazaindolizine, adenine, and the like. Besides these, alkylcarboxylic acids, arylcarboxylic acids and succharides may be added as needed.

A color development applied to the present invention is carried out under the following conditions. In the case of color print photosensitive materials, the processing temperature is preferably 30 to 55° C., more preferably 35 to 50° C., and still more preferably 38 to 45° C. The developing time is preferably 5 to 90 seconds, more preferably 8 to 60 seconds, and still more preferably 10 to 45 seconds. Smaller replenisher volumes are preferred. However, the replenisher volume is appropriately 15 to 200 ml, preferably 20 to 120 ml, and more preferably 30 to 60 ml, per $m^2$ of the photosensitive material.

In the case of color negative films, the processing temperature is preferably 30 to 55° C., more preferably 35 to 50° C., and more preferably 38 to 45° C. The developing time is preferably 45 seconds to 5 minutes, more preferably 60 seconds to 4 minutes, and more preferably 90 seconds to 3 minutes and 15 seconds. Smaller replenisher volumes are preferred, but the replenisher volume for one 24-exp. film is appropriately 10 to 200 ml, preferably 12 to 60 ml, and more preferably 15 to 30 ml.

The color development compositions obtained by concentrating the replenishers described in JP-A-11-174643, JP-A-11-194461, and JP-A-11-194462 are examples of a preferred mode of the present invention.

The bleaching agent to be used in the bleaching composition and bleach-fixing composition for use in the present invention may be a known bleaching agent. In particular, organic complex salts of iron (III) (for example, complex salts of aminopolycarboxylic acids or of organic acids such as citric acid, tartaric acid, and malic acid), persulfates, hydrogen peroxide, and the like are preferred. A mixture of two or more bleaching agents may be used.

Among these, organic complex salts of iron (III) are particularly preferred from the viewpoint of rapid processability and prevention of environmental pollution. Examples of aminopolycarboxylic acid or its salts useful for forming organic complex salts of iron (III) include such compounds as, ethylenediaminesuccinic acid (s,s-form), N-(2-carboxylatoethyl)-L-aspartic acid, β-alaninediacetic acid, and methyliminodiacetic acid, which are all biodegradable, as well as ethylenediaminetetraacetic acid, diethylenetriaminepentaacetic acid, 1,3-propylenediaminetetraacetic acid, nitrilotriacetic acid, cyclohexanediaminetetraacetic acid, iminodiacetic acid, glycol ether diamine tetraacetic acid and the like. These compounds may be any one of sodium, potassium, lithium and ammonium salts. Among these compounds, ethylenediaminesuccinic acid (s,s-form), N-(2-carboxylatoethyl)-L-aspartic acid, β-alaninediacetic acid, and methyliminodiacetic acid, as well as ethylenediaminetetraacetic acid, diethylenetriaminepentaacetic acid, and 1,3-propylenediaminetetraacetic acid are preferable since the resulting iron (III) salt has good photographic properties. The ferric ion complex salts may be used in the form of a complex salt. Alternatively, a ferric iron salt, for example, ferric sulfate, ferric chloride, ferric nitrate, ferric ammonium nitrate, ferric phosphate, or the like and a chelating agent such as aminopolycarboxylic acid may be mixed to form a ferric iron ion complex salt in a solution. Alternatively, a chelating agent may be used in an excessive amount that is more than what is necessary for forming a ferric iron complex salt. The concentration of a bleaching agent in a working solution of a bleach solution or bleach-fixer solution is generally 0.01 to 1.0 mol/l, preferably 0.05 to 0.5 mol/l, and more preferably 0.1 to 0.5 mol/l.

It is also preferred that a buffer is added to the bleach solution or bleach-fixer solution. The buffer is selected according to intended pH values. Preferred examples of a compound suitable as a buffer include organic acids such as succinic acid, maleic acid, glycolic acid, malonic acid, fumaric acid, succinic acid, sulfosuccinic acid, and acetic acid; organic bases such as imidazole and dimethylimidazole; compounds represented by the formula (A-a) or (B-b) described in JP-A-9-211819. The addition amount of these compounds in a working solution is preferably 0.005 to 3.0 mol/l, and more preferably 0.05 to 1.5 mol/l. The pH range of the bleach solution is preferably pH 2 to 7, and particularly preferably pH 3 to 6. In the case of the bleach-fixer solution, the pH range is preferably pH 3 to 8, and more preferably 4 to 7.

In bleach-fixing of color print photosensitive materials applied to the present invention, the processing temperature is preferably 30 to 55° C., more preferably 35 to 50° C., and still more preferably 38 to 45° C. The bleach-fixing time is preferably 5 to 90 seconds, more preferably 8 to 60 seconds, and further more preferably 10 to 45 seconds. Smaller replenisher volumes are preferred. However, the replenisher volume is appropriately 20 to 200 ml, preferably 25 to 120 ml, and more preferably 30 to 50 ml, per $m^2$ of the photosensitive material to be processed.

In the case of bleaching color negative films, the processing temperature is preferably 30 to 55° C., more preferably 35 to 50° C., and further more preferably 38 to 45° C. The bleaching time is preferably 12 seconds to 2 minutes, more preferably 15 seconds to 1 minute and 15 seconds, and more preferably 18 seconds to 60 seconds. Smaller replenisher volumes are preferred, and the replenisher volume for one 24-exp. film is appropriately 2.5 to 50 ml, preferably 3 to 25 ml, and more preferably 4 to 12 ml.

The fixing agents to be used in the bleach-fixing composition and fixing composition for use in the present invention are known fixing agents, i.e., thiosulfates, such as sodium thiosulfate and ammonium thiosulfate; thiocyanates, such as sodium thiocyanates and ammonium thiocyanate; ethylenebisglycolic acid, 3,6-dithia-1,8-octanediol, thioureas, thioether compounds described in JP-A-4-317055; and water-soluble silver halide solubilizing agents, such as mesoionic compounds described in JP-A-4-143757 and JP-A-4-230749. These fixing agents may be used singly, or two or more of them may be used as a mixture. As the fixing agent, use of thiosulfates, in particular ammonium thiosulfate, is preferred. The concentration of fixing agent in the fixer solution or bleach-fixer solution is preferably 0.3 to 2 mol/l, and more preferably 0.5 to 1.5 mol/l.

It is preferred that a buffer is added to the bleach-fixing composition or fixing composition for use in the present invention. Preferred examples of the buffer include heterocyclic organic bases, such as imidazole and dimethylimidazole; aminoalkylenesulfonic acids, such as taurine;: and dibasic acids, such as succinic acid, maleic acid and malonic acid. The pH of the compositions is preferably 3 to 8, and more preferably 4 to 7.

The bleach-fixing composition or fixing composition for use in the present invention preferably contains a compound that releases a sulfite ion, i.e., sulfites, bisulfites, metabisulfites, and the like, as a preservative. Preferably, these compounds are added in the form of potassium salts, sodium salts or ammonium salts. It is also preferred that the compositions for use in the present invention contain an arylsulfinic acid, such as p-toluenesulfinic acid, m-carboxybenzenesulfinic acid, and p-aminobenzenesulfinic acid. Preferably, a working solution contains these compounds in an amount of 0.02 to 1.0 mol/l. As the preservative, besides the above-mentioned ones, ascorbic acid, carbonyl bisulfite adducts or a carbonyl compound may also be added.

For improving image preservability, the bleach-fixing composition or fixing composition for use in the present invention may contain mercapto nitrogen-containing heterocyclic compounds, such as mercaptotriazole, aminomercaptotriazole, and N-methylmercaptoimidazole, that form stable silver ions; monoamidines or bisguanidines and bisamidines as described in JP-A-5-303185, which accelerate washing-off of the developing agent. In addition, the bleach-fixing composition or fixing composition for use in the present invention may contain polymers, such as polyethylene glycol and polyvinylpyrrolidone, chelating agents, antifoaming agents, mildewproofing agents, and the like as needed.

The processing composition in the present invention is advantageously formulated into a form that contains all the components to be contained in a working solution, in a single composition, i.e., a one-pack constitution. However, in the case where it is undesirable to allow the components being contacting with each other for a long period of time, in a color-development composition, bleach-fixing composition or the like, the components may be divided into two or more liquid agents, thereby forming a two-pack or three-pack constitution processing composition. These are usually-called 1-, 2- and 3-part constitutions, respectively, according to the naming by international standard ISO 5989. The processing compositions for use in the present invention do not lose the effects or characteristics of the invention by dividing the composition into some parts. Among the constituents, 1-part constitution is particularly preferable for the color-development composition.

For a container for the processing composition for use in the present invention, known materials appropriate for the content can be used. The container may be made of a single material or a composite material, for example, a composite material of a material having a high gas permeability and a material having a high alkali stability. From the viewpoint of reuse and recyclability, it is preferred that the container is composed of a single raw material. Examples of the material to be used for the container include polyester resins, polyolefin resins, acrylic resins, ABS resins, epoxy resins, polyamide resins including nylons, polyurethane resins, polystyrene resins, polycarbonate resins, PVA (polyvinyl alcohols), polyvinyl chlorides, polyvinylidene chlorides, polyethylene resins, and the like. Among them, polyester resins, such as polyethylene terephthalate and polyethylene naphthalate, and polyolefin resins, such as polyethylenes and polypropylenes, are preferred when a container is made of a single material selected therefrom. Of these, polyethylene resins are preferred, with high-density polyethylene (HDPE) resins being particularly preferred as a container material.

To the container material that can be used in the present invention, carbon black, titanium white, a pigment, calcium carbonate, a plasticizer having compatibility with the material, and so on may be added, so far as they do not affect the processing composition. Preferably, the container material is one which has a ratio of polyethylene in the material of 85% or more and contains no plasticizer, more preferably one which has a ratio of polyethylene in the material of 95% or more and contains no plasticizer.

The shape and structure of the container for packing the processing composition according to the present invention may be designed arbitrary depending on the purpose. In addition to a standard bottle, the container with a telescopic type as described in JP-A-1-235950, the container with a flexible partition wall as described in JP-A-62-134626, and so on may also be used. The container described in JP-A-11-282148 is particularly preferred as a container for the processing composition according to the present invention, from the viewpoints of capacity, space efficiency, self-supporting property, and form retention as well as easiness in reuse and recycling. A kit according to one preferred mode of the present invention includes a single cartridge having incorporated therein a plurality of containers made of a single material and having the same shape and volume, in which a corresponding plurality of kinds of the processing compositions for use in the present invention are filled, respectively. One example is the cartridge described in JP-A-2000-3014. In the present invention, any desired combination of the processing compositions in a cartridge may be selected. A preferred mode is a cartridge in which a development composition, a bleaching composition and a fixing composition are incorporated therein as described in JP-A-11-295858 or JP-A-11-288068.

In order to prevent generation of stains or color fading of a dye, due to a remaining magenta coupler, it is preferable to add formalin, acetaldehyde, pyruvic aldehyde, the formaldehyde bisulfite adduct described in US Pat. No. 4,921,779, the N-methylol compound described in JP-A-5-34889, to the washing composition or stabilizing composition according to the present invention. Also, it is preferred that the composition contains an arylsulfinic acid such as p-toluenesulfinic acid, m-carboxybenzenesulfinic acid, and p-aminobenzenesulfinic acid. The composition may also contain a surfactant as a drainage agent, a chelating agent as a hard water softener, a buffer for adjusting pH, an antifoam agent, a mildewproofing agent, a microbicide, and the like, as needed.

A preferred pH is 4 to 10, and more preferably 5 to 8. The temperature may be set variously depending on the purpose, properties and so on of photosensitive materials. Generally, it is 20 to 50° C., and preferably 25 to 45° C.

The exposure system device (in this specification and the claims, referred to as exposure device) in the present invention refers to a group of apparatuses for irradiating light for exposure onto a photosensitive material in an image forming system. The device includes an exposure apparatus provided with a light source, an optical system, a modulating means, and a scanning means and with a control apparatus for controlling the actions thereof. The exposure-device-dependent digital data for exposure refers to data of a digital type converted by a so-called driver of an exposure device to be used so that a desired dot density can be reproduced at a desired place after development processing. The area modulation means expressing the intensity (light and shade) of image density with varying size of area of regions having a prescribed density. More specifically, it means modulating macroscopically observed density by an area ratio between dots of an ink or color dye having a prescribed density, and a white background. The digital image data for area modulation means dot image as well as vector data such as thin lines, characters, and graphics, generated by a raster image processor (RIP) or the like, which are exposure-device-independent data. Therefore, among the image forming methods of the present invention, the image forming method in which exposure is made based on digital image data, which is modulated into data for area modulation and converted into exposure-device-dependent digital data for exposure, is characterized by the following. That is, at least two stages of data conversion to convert from an original, which is expressed at least by density modulation (i.e. amounts of ink, color dye or the like are modulated to perform light-and-shade expression and light-and-shade reproduction), are performed. Such data conversion stages can be performed in an arbitrary order. Further, the above-mentioned method does not include a method in which area modulation exposure is performed in one stage as in an image setter. In the case of a color proof silver halide photosensitive material according to one preferred embodiment of the present invention, it is preferred that the scanning exposure is performed based on the above-mentioned digital image data.

In the present invention, a silver halide color photosensitive material (hereinafter, sometimes referred to simply as "photosensitive material") which has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, is preferably used.

In the present invention, the silver halide emulsion layer containing a yellow dye-forming coupler functions as a yellow color developing layer, the silver halide emulsion layer containing a magenta dye-forming coupler functions as a magenta color developing layer, and the silver halide emulsion layer containing a cyan dye-forming coupler functions as a cyan color developing layer. Preferably, the silver halide emulsions contained in the yellow color developing layer, the magenta color developing layer, and the cyan color developing layer may have photosensitivities to mutually different wavelength regions (for example, light in a blue region, light in a green region and light in a red region).

In addition to the yellow color developing layer, the magenta color developing layer, and the cyan color developing layer, the photosensitive material according to the present invention may have a hydrophilic colloid layer, an antihalation layer, an intermediate layer and coloring layer as desired.

The silver halide photosensitive material preferably used in the present invention will be described in detail hereinbelow.

The silver halide grains contained in the silver halide emulsion for use in the present invention have an average grain size (the grain size herein means the diameter of the circle equivalent to the projected area of the grain, and the number average is taken as the average grain size) of preferably from 0.01 $\mu$m to 2 $\mu$m.

With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer or to form a multilayer structure using the monodisperse emulsions.

Various compounds or precursors thereof can be included in the silver halide emulsion for use in the present invention to prevent fogging from occurring or to stabilize photographic performance, during manufacture, storage or photographic processing of the photosensitive material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0447647 can also be preferably used.

Further, in order to enhance storage stability of the silver halide emulsion for use in the present invention, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description at paragraph Nos. 0036 to 0071 of JP-A-11-327094 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts of these acids); water-soluble reducing agents represented by formula (I), (II), or (III) of JP-A-11-102045.

Spectral sensitization can be carried out for the purpose of imparting spectral sensitivity in a desired light wavelength region to the light-sensitive emulsion in each layer of the photosensitive material for use in the present invention.

Examples of spectral sensitizing dyes, which are used in the photosensitive material for use in the present invention, for spectral sensitization of blue, green and red light regions include, for example, those disclosed by F. M. Harmer, in *Heterocyclic Compounds—Cyanine Dyes and Related*

*Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide emulsions for use in the present invention are generally chemically sensitized. Chemical sensitization can be performed by utilizing a sulfur sensitization, represented by the addition of an unstable sulfur compound, noble metal sensitization represented by gold sensitization, and reduction sensitization, each singly or in combination thereof. Compounds that are preferably used for chemical sensitization include those described in JP-A-62-215272, from page 18, right lower column to page 22, right upper column. Of these, gold-sensitized silver halide emulsion are particularly preferred, since a change in photographic properties which occurs when scanning exposure with laser beams or the like is conducted, can be further reduced by gold sensitization.

In order to conduct gold sensitization to the silver halide emulsion to be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand, the bis gold (I) mesoionic heterocycles described in JP-A-4-267249, for example, gold (I) tetrafluoroborate bis(1,4,5-trimethyl-1,2,4-triazolium-3-thiolate), the organic mercapto gold (I) complexes described in JP-A-11-218870, for example, potassium bis(1-[3-(2-sulfonatobenzamido) phenyl]-5-mercaptotetrazole potassium salt) oleate (I) pentahydrate, and the gold. (I) compound with a nitrogen compound anion coordinated therewith described in JP-A-4-268550, for example, gold (I) bis (1-methylhydantoinate) sodium salt tetrahydrate may be used. Also, the gold (I) thiolate compound described in U.S. Pat. No. 3,503,749, the gold compounds described in JP-A-8-69074, JP-A-8-69075 and JP-A-9-269554, and the compounds described in US Pat. Nos. 5,620,841, 5,912,112, 5,620,841, 5,939,245, and 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{31\ 6}$ mole to $5\times10^{-4}$ mole, per mole of silver halide.

The silver halide emulsion for use in the present invention is preferably subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1996). Colloidal gold sulfide having various grain sizes are applicable, and even those having a grain diameter of 50 nm or less are also usable. The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

In the present invention, gold sensitization may be used in combination with other sensitizing methods, for example, sulfur sensitization, selenium sensitization, tellurium sensitization, reduction sensitization, or noble metal sensitization using a noble metal compound other than gold compounds.

The silver halide color photosensitive material for use in the present invention may be any one so far as it is a color photosensitive material. Preferably, it is a color paper, a color proof silver halide color photosensitive material, or a display color photosensitive material. Preferably, the silver halide color photosensitive material for use in the present invention is applied, among these, to a silver halide color photosensitive material having a reflective support, and especially to a silver halide color photosensitive material for a color proof.

The light-sensitive material for use in the present invention preferably contains, in their hydrophilic colloid layers, dyes (particularly oxonole dyes and cyanine dyes) that can be discolored by processing, as described in European Patent No. 0337490 A2, pages 27 to 76, in order to prevent irradiation or halation or enhance safelight safety (immunity). Further, dyes described in European Patent No. 0819977 are also preferably used in the present invention. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with a light-sensitive emulsion layer directly, or indirectly through an interlayer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, only one layer selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is within the range of 0.2 to 3.0, more preferably 0.5 to 2.5, and particularly preferably 0.8 to 2.0.

The colored layer described above may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used as described in JP-A-1-239544. As to a method of dispersing fine-powder of a dye in solid state, for example, JP-A-2-308244, pages 4 to 13 describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the methods of incorporating fine particles of dye and of using a colloidal silver.

The light sensitive material in the present invention preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer and the cyan color-forming silver halide emulsion layer.

However, another layer arrangement which is different from the above, may be adopted.

In the present invention, a yellow coupler-containing silver halide emulsion layer may be disposed at any position on a support. However, in the case where silver halide tabular grains are contained in the yellow coupler-containing layer, it is preferable that the yellow coupler-containing layer be positioned more apart from a support than at least one of a magenta coupler-containing silver halide emulsion layer and a cyan coupler-containing silver halide emulsion layer. Further, it is preferable that the yellow coupler-containing silver halide emulsion layer be positioned most apart from a support than other silver halide emulsion layers, from the viewpoint of color-development acceleration, desilvering acceleration, and reducing residual color due to a sensitizing dye. Further, it is preferable that the cyan doupler-containing silver halide emulsion layer be disposed in the middle of other silver halide emulsion layers, from the viewpoint of reducing blix fading. On the other hand, it is preferable that the cyan coupler-containing silver halide emulsion layer be the lowest layer, from the viewpoint of reducing light fading. Further, each of the yellow-color-forming layer, the magenta-color-forming layer and the cyan-color-forming layer may be composed of two or three layers. It is also preferable that a color forming layer be formed by disposing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) for use in the present invention, photographic constitutional layers (arrangement of the layers or the like), and processing methods for processing the photographic materials and additives for processing are disclosed in JP-A-62-215272, JP-A-2-33144 and European Patent No. 0355660 A2 Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye image stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following tables are particularly preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |

TABLE 1-continued

| Element | JP-A-7-104448 | JP-A-7-77775 | JP-A-7-301895 |
|---|---|---|---|
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coated film of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As cyan, magenta and yellow couplers which can be used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) described in JP-A-10-221825.

As the cyan dye-forming coupler (hereinafter also referred to as "cyan coupler") which can be used in the present invention, pyrrolotriazole-series couplers are preferably used, and more specifically, couplers represented by any of formulae (I) and (II) in JP-A-5-313324 and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. As cyan couplers other than the foregoing cyan couplers, there are pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, the cyan dye-forming coupler according to the present invention can also be a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in EP 0333185 A2; a cyclic active methylene-series cyan coupler (particularly couplers 3, 8, and 34 enumerated as specific examples are particularly preferable) described in JP-A-64-32260; a pyrrolopyrozole cyan coupler described in European Patent No. 0456226 A1; and a pyrroloimidazole cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated in the present specification by reference.

The magenta dye-forming couplers (which may be referred to simply as a "magenta coupler" hereinafter) that can be used in the present invention are 5-pyrazolone magenta couplers and pyrazoloazole magenta couplers such as those described in the above-mentioned patent publications in the above tables. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 0226849 A2 and 0294785 A, in view of the hue and stability of image to be formed therefrom and color-forming property of the couplers. Particularly as the magenta coupler, pyrazoloazole couplers represented by formula (M–I) described in JP-A-8-122984 are preferred. The descriptions of paragraph Nos. 0009 to 0026 of the patent publication JP-A-8-122984 are entirely applied to the present invention and therefore are incorporated in the specification of this application as a part thereof by reference. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as a "yellow coupler" hereinafter), preferably used in the present invention are acylacetamide yellow couplers in which the acyl group has a 3-membered to 5-membered cyclic structure, such as those described in European Patent No. 0447969 A1; malondianilide yellow couplers having a cyclic structure, as described in European Patent No. 0482552 A1; pyrrol-2 or 3-yl or indol-2 or 3-yl carbonyl acetic acid anilide-series couplers, as described in European Patent (laid open to public) Nos. 953870 A1, 953871 A1, 953872 A1, 953873 A1, 953874 A1 and 953875 A1; acylacetamide yellow couplers having a dioxane structure such as those described in U.S. Pat. No. 5,118,599, in addition to the compounds described in the above-mentioned tables. Above all, acylacetamide yellow couplers in which the acyl group is an 1-alkylcyclopropane-1-carbonyl group, and malondianilide yellow couplers in which one anilide constitute an indoline ring are especially preferably used. These couplers may be used singly or as combined.

It is preferred that couplers for use in the present invention, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic solvent-soluble polymer which can be preferably used, include the homopolymers and co-polymers as disclosed in U.S. Pat. No. 4,857,449, from column 7 to column 15 and WO 88/00723, from page 12 to page 30. The use of methacrylate-series or acrylamide-series polymers, especially acrylamide-series polymers are more preferable in view of color-image stabilization and the like.

In the present invention, known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent No. 19629142 A1, may be used. Particularly, in order to accelerate developing speed by increasing the pH of a developing solution, redox compounds described in, for example, German Patent No. 19,618,786 A1, European Patent Nos. 0,839,623 A1 and 0,842,975 A1, German Patent No. 19,806,846 A1 and French Patent No. 2,760,460 A1, are also preferably used.

In the present invention, as an ultraviolet ray absorbent, it is preferred to use compounds having a high molar extinction coefficient and a triazine skeleton. For example, those described in the following patent publications can be used. These compounds are preferably added to the light-sensitive layer or/and the light-nonsensitive layer. For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As the binder or protective colloid which can be used in the light-sensitive material according to the present invention, gelatin is used advantageously, but another hydrophilic colloid can be used singly or in combination with gelatin. It is preferable for the gelatin that the content of heavy metals, such as Fe, Cu, Zn and Mn, included as impurities, be reduced to 5 ppm or below, more preferably 3 ppm or below. Further, the amount of calcium contained in the light-sensitive material is preferably 20 $mg/m^2$ or less, more preferably 10 $mg/m^2$ or less, and most preferably 5 $mg/m^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image.

Further, the pH of the film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is particularly preferred. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but generally in the range of $1\times10^{-5}$ to 1 $g/m^2$, preferably in the range of $1\times10^{-4}$ to $1\times10^{-1}$ $g/m^2$, and more preferably in the range of $1\times10^{-3}$ to $1\times10^{-2}$ $g/m^2$.

The photosensitive material for use in the present invention can form an image by an exposure step in which the photosensitive material is irradiated with light according to image information, and a development step in which the photosensitive material irradiated with light is developed.

The light-sensitive material for use in the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green and blue, and fluorophoroes which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred from the viewpoint of high quality enhancement, because a cathode ray tube having a high resolving power can be used.

The light-sensitive material for use in the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material for use in the present invention can be arbitrarily set up in accordance with the wavelength of a scanning exposure light source to be used. Since oscillation wavelength of a laser can be made half, using a SHG light source (a second harmonic generation light source) obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red. Examples of the semiconductor laser include blue light semiconductor laser having a wavelength of 430 to 450 nm (Presentation by Nichia Corporation at the $48^{th}$ Applied Physics Related Joint Meeting in March of 2001), a blue laser at about 470 nm obtained by wavelength modulation of a semiconductor laser (oscillation wavelength about 940 nm) with a SHG crystal of $LiNbO_3$ having a reversed domain structure in the form of a wave guide, a green laser at about 530 nm obtained by wavelength modulation of a semiconductor laser (oscillation wavelength about 1,060 nm) with a SHG crystal of $LiNbO_3$ having a reversed domain structure in the form of a wave guide, a green laser at 532 nm obtained by wavelength modulation of a $YVO_4$ solid laser (oscillation wavelength 1,064 nm) obtained using a GaAlAs semiconductor laser (oscillation wavelength 808.7 nm) as an excitation light source, with a SHG crystal of $LiNbO_3$ having a reversed domain structure, and further as red semiconductor lasers, AlGaInP {(oscillation wavelength about 680 nm: Type No. LN9R20 (trade name), manufactured by Matsushita Electric Industrial Co., Ltd.), (oscillation wavelength about 650 nm: Type No. HL6501MG (trade name), manufactured by Hitachi, Ltd.), and (oscillation wavelength about 685 nm: ML101J10 (trade name), manufactured by Mitsubishi Electric Corporation)} and in addition thereto a red semiconductor laser having a wavelength of about 685 nm (Type No. HL6738MG (trade name), manufactured by Hitachi, Ltd.) and the like. In particular, use of a blue semiconductor laser having 420 to 460 nm for blue exposure wavelength makes the exposure apparatus compact and hence is preferable. The exposure time in such a scanning exposure is defined as the time necessary to expose the size of the picture element (pixel) with the density of the picture element being 400 dpi, and preferred exposure time is $10^{-4}$ sec or less and more preferably $10^{-6}$ sec or less. For color proof uses, it is preferable that exposure is performed at a high density as high as 2,400 dpi, for an exposure time in a range of from $10^{-4}$ to $10^{-7}$ second per pixel, details of which will be described hereinbelow. However, the present invention should not be construed as being limited thereto.

The silver halide color photosensitive material for use in the present invention is preferably used in combination with the exposure and development systems described in the following known materials. Example of the development system include the automatic print and development system described in JP-A-10-333253, the photosensitive material conveying apparatus described in JP-A-2000-10206, a recording system including the image reading apparatus described in JP-A-11-215312, exposure systems with the color image recording method described in JP-A-11-88619 and JP-A-10-202950, a digital photo print system including the remote diagnosis method described in JP-A-10-210206, and a photo print system including the image recording apparatus described in Japanese Patent Application No. 10-159187.

The preferred scanning exposure methods which can be applied to the present invention are described in detail in the tables shown above.

It is preferred to use a band stop filter, as described in U.S. Pat. No. 4,880,726, when the photographic material for use in the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

The present invention is preferably applied to a light-sensitive material having rapid processing suitability. In the case of conducting rapid processing, the color-developing time is preferably 60 sec or less, more preferably from 50 sec to 6 sec, and further preferably from 30 sec to 6 sec. Likewise, the blix time is preferably 60 sec or less, more preferably from 50 sec to 6 sec, and further preferably from 30 sec to 6 sec. Further, the washing or stabilizing time is preferably 150 sec or less, and more preferably from 130 sec to 6 sec.

Herein, the term "color-developing time" as used herein means a period of time required from the beginning of dipping a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material has left the solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

Examples of a development method applicable to the light-sensitive material for use in the present invention after exposure, include a conventional wet system, such as a development method using a developing solution containing an alkali agent and a developing agent, and a development method wherein a developing agent is incorporated in the light-sensitive material and an activator solution, e.g., a developing agent-free alkaline solution is employed for the development, as well as a heat development system using no processing solution. In particular, the activator method is preferred over the other methods, because the processing solutions contain no developing agent, thereby it enables easy management and handling of the processing solutions and reduction in waste disposal load to make for environmental preservation.

The preferable developing agents or their precursors incorporated in the light-sensitive materials in the case of adopting the activator method include the hydrazine compounds described in, for example, JP-A-8-234388, JP-A-9-152686, JP-A-9-152693, JP-A-9-211814 and JP-A-9-160193.

Further, the processing method in which the photographic material reduced in the amount of silver to be applied undergoes the image amplification processing using hydrogen peroxide (intensification processing), can be employed preferably. In particular, it is preferable to apply this processing method to the activator method specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536–541 (September 1994), and JP-A-8-234388 can be used in the present invention.

The present invention can be particularly preferably applied to color photosensitive materials for digital direct color proof (hereinafter, referred to as "color proof photosensitive materials"), digital direct color proof systems, and their image forming methods.

The color proof photosensitive material is generally a silver halide color photosensitive material that has, on a support, silver halide photosensitive layers forming at least a yellow dye, a magenta dye, and a cyan dye; has a hue resembling that of printing ink; and is exposed with using three or more light source units having wavelengths different from each other, based on dotted image information to form an area modulated image. A fourth photosensitive layer may be provided, for the purpose of making black (chromaticity and Dmax) and single color solid print (chromaticity and Dmax) consist each other (improvement of color reproduction), and for the purpose of the discrimination of a black printer. In this case, three or four light sources with different wavelengths from each other are used as exposure light sources. The exposure light sources in many cases have a plurality (preferably 8 or more and 500 or less) of light source units for each color. LED, LD, or other devices can be used as the exposure light source. For the exposure light source, light sources of any desired wavelengths in visible light region, such as blue, green and red, and infrared region can be used. Also, these may be used in any desired combinations. In the present invention, the number of light source units for each color in an exposure light source is particularly preferably 20 to 200.

As the system, preferred are direct digital color proof system and image forming method having the following features: A color photosensitive material is automatically drawn out of a magazine, cut into a form of a sheet, and the sheet is wound around an exposure outer drum and rotated. Then the sheets is subjected to scanning exposure based on dotted image information with using an exposure array light source that has eight or more light source units each unit having three or more types of light sources with different wavelengths, respectively, in combination, to record dot images by area gradation with dots of a resolution of 2,000 dpi or more. Thereafter, the exposed color photosensitive material is automatically developed with an automatic processor to output a dot color proof image of A3 size or more (also a system that outputs a B1 size image is also possible as needed). However, adaptation of the present invention to color proof is not limited to the above-mentioned color proof photosensitive material, system or image formation.

The effect of the present invention can also be obtained in those direct digital color proof systems, image forming methods, and color proof photosensitive materials, having one or more characteristics described below. That is, the resolution is 2,400 dpi or more and exposure beam diameter of one dot is 0.5 $\mu$m or more to 50 $\mu$m in terms of half width of light intensity; exposure time required to expose one dot by at least one exposure light source is $10^{-8}$ second or more and $10^{-2}$ second or less; the number of rotation of the outer drum is 100 rpm or more and 4,000 rpm or less; the wavelength of at least one exposure light source is 700 nm or more; the exposure amount of at least one exposure light source is of two stages or more; the exposure energy of the exposure light source having the longest wavelength is equal to or more than 1.1 times that of the other light sources; after exposure, the photosensitive material is peeled off from the outer drum and conveyed so that the exposed side is facing downward; the photosensitive material is conveyed so that the emulsion side is turned in a downward direction in the color developer, bleach-fixer and washing bath in an automatic processor; the time required from completion of the exposure of a photosensitive material to entering of the tip thereof in the color developer is 20 seconds or more and 3 minutes or less; a difference between the time from completion of the exposure to entering of the head of an exposed photosensitive material in the direction of transport in the color developer and the time from completion of the exposure to entering of the end of the material in the direction of transport in the color developer is 1 minute or more and 10 minutes or less, the processing times of color developer and bleach fixer are each 10 seconds or more and 100 seconds or less, and a difference between these processing times is within 30 seconds; the volumes of processing tanks for color developer and bleach-fixer are each 8 liters or more and 20 liters or less; two or more and five or less washing tanks are provided; color developer and bleach-fixer are provided by an integrated kit, and the replenisher volume of the color developer is 50 ml or more and 300 ml or less per 1 $m^2$ of photosensitive material, the replenisher volume of the bleach-fixer is 30 ml or more and 250 ml or less per 1 $m^2$ of photosensitive material, and the replenisher volume of the wash water is 50 ml or more and 1,000 ml or less with respect to the whole wash water, with replenishment being performed by automatically sensing the area of the photosensitive material to be processed; the automatic processor has at least one automatic washing mechanism for washing air turn transport rollers; at least one guide plate that contacts the emulsion side of a photosensitive material is made of a Teflon material; the system has a calibration mechanism to correct changes in sensitivity that occur due to the lot-to-lot difference, change with lapse of time, temperature and humidity at the time of exposure of the photosensitive material, and change in the states of processing solutions, by writing a specific image in a proof print or in a separate output print and measuring the density or chromaticity of the obtained image or visually comparing it with an objective image, so that calibration can be performed by a continuous gradation image having a density lower than Dmax of the photosensitive material; calibration of an even tone dot image of 20% or more and 80% or less can be performed by visual determination, density measurement, or color difference measurement; photosensitive material of the same size is fed from two or more magazines and when one of the magazines becomes empty, automatically the photosensitive material is fed from another magazine; photosensitive materials of two or more sizes are simultaneously fed from different magazines, respectively, and switch of size is automatically performed; the winding length of one photosensitive material is 30 m or more and 100 m or less; the time from completion of drawing the photosensitive material out of the magazine to start of exposure is 10 seconds or more and 100 seconds or less;.black printer image is formed from yellow, magenta and cyan; a difference in dot gain between colors forming dots of a black printer is within 5%; the total thickness of the support used for the photosensitive material is 50 μm or more and 150 μm or less; the front side laminate of the support used for the photosensitive material has:a thickness of 10 μm or more to 50 μm; the back side laminate of support used for the photosensitive material has a thickness of 10 μm or more and 50 μm or less; a backing layer of a thickness of 0.1 μm or more and 30 μm or less is provided on the side of the photosensitive material, opposite to the side where a photosensitive layer is coated; the side of the photosensitive material having the photosensitive silver halide has a total film thickness of 3 μm or more and 30 μm or less; a difference between the total film thickness of the side of the photosensitive material having the photosensitive silver halide and the total film thickness of the back side thereof is within 10 μm; the photosensitive silver halide used in the photosensitive material has a silver chloride content of 90% or more; the photosensitive material processed into a form of a roll so that the emulsion side faces outside is used; the peak wavelength of maximal spectral sensitivity of at least one layer is 700 nm or more; the photosensitive material cut into a form of sheet by a squeeze roller is automatically wound around a drum; and so on.

Furthermore, the shape of spot may be any one of circle, ellipse, and rectangle. The distribution of quantity of light of one spot may be a Gauss distribution or a trapezoid of relatively constant intensity. Although one light source is enough, a multi-channel array having a plurality of (preferably 1.0 to 100, more preferably 40 to 80) light sources with the same wavelength is particularly preferred.

The exposing method and image forming method using a laser, LED or array thereof as a light source are described in detail in JP-A-10-142752, JP-A-11-242315, JP-A-2000-147723, JP-A-2000-246958, JP-A-2000-354174, JP-A-2000-206654, EP 1048976 A, and the like. These methods may be preferably used in the present invention.

More specifically, the above-mentioned methods are as follows.

Preferred modes of the exposure light source are described in the paragraph 0022 of JP-A-2000-147723 and the paragraphs 0053, 0059-0061, and 0064-0067 of JP-A-2000-206654, and these are preferably applied to the present invention.

Preferred modes of the beam form of exposure light source and preferred modes of exposure light source array are described in the paragraphs 0022-0023 of JP-A-2000-147723 and the paragraphs 0025-0030 of JP-A-2000-206654, and these are preferably applied to the present invention.

To improve the productivity at the time of exposure, a method in which a photosensitive material is wound around a drum and is subjected to scanning exposure is advantageous. A preferred mode of light source for this method is the LED array described in JP-A-2000-246958, and the image recording apparatus described in JP-A-2000-246958 having the LED array is preferably applied to the present invention. Furthermore, the method of winding a photosensitive material around a drum is described in the paragraphs 0057-0058 and 0062-0063 of JP-A-2000-206654, and in the same way this method is preferably applied to the present invention.

Furthermore, performing calibration by the method described in EP 1048976 A to form an image stably is also preferably applied to the present invention.

For the method of converting digital image data to exposure image data and the method of exposure, which is preferably used in preparing a color proof, in the present invention, those described in JP-A-2000-354174 and JP-A-

2000-147723 may be used as they are. More specifically, the color proof preparing apparatus shown in FIG. 1 of JP-A-2000-354174 may be used, and FIGS. 1 to 4, and descriptions in paragraphs 0011-0021, the first sentence in paragraph 0022, and paragraphs 0034-0057 in JP-A-2000-354174 are preferably incorporated in the present specification by reference.

The color image forming method of the present invention is suitable for image output based on digital data and for high intensity exposure. In particular, by the method of the present invention, it is possible to improve image quality, and to prevent unevenness in density, and coloring of white background, at the time of rapid processing.

The present invention solves various problems underlying image output based on digital data for area modulation, and can provide an image forming method that is suitable for outputting image based on digital data for area modulation and is improved in image quality. Hence, the method is competitive on market. Specifically, the present invention can construct an image forming method that causes less sensitivity reduction and less gradation softening at high intensity exposure, that is excellent in sharpness, that generates less yellowing of white background, and less uneven density, at the time of rapid development processing, and that is excellent in reproducibility of characters.

Hereinafter, the present invention will be illustrated in more detail by way of examples, but the present invention should not be limited thereto.

EXAMPLES

Example 1

Preparation of a Color Paper (Preparation of Inventive Blue Sensitive Layer Emulsions A-1 and A-2)

To 1.06 L of deionized distilled water containing 5.7 mass % of deionized gelatin, 46.3 ml of 10% NaCl solution, 46.4 ml of $H_2SO_4$ (1N), and then 0.012 g of compound (X) were added in the order cited. Thereafter, the temperature of the solution was adjusted to 60° C. and immediately after this, 0.1 mol of silver nitrate and 0.1 mol of NaCl were added to the reaction vessel over 10 minutes, while performing rapid stirring. Subsequently, 1.5 mol of silver nitrate and a NaCl solution were added over 60 minutes by a flow rate acceleration method so that the final addition rate became 4 times the initial addition rate. Then, a 0.2-mol % silver nitrate solution and a NaCl solution were added over 6 minutes in a predetermined addition rate. On this occasion, $K_3IrCl_5$ ($H_2O$) was added to the NaCl solution in an amount sufficient to be $5\times10^{-7}$ mol to the total amount of silver, to dope aquated iridium in the grains.

Furthermore, 0.2 mol of silver nitrate, 0.18 mol of NaCl and a 0.02-mol % KBr solution were added over 6 minutes. On this occasion, $K_4Ru(CN)_6$ and $K_4Fe(CN)_6$ in the amount corresponding to $0.5\times10^{-5}$ mol to the total amount of silver, respectively, were dissolved in the aqueous halogen solution and added to the silver halide grains.

Furthermore, during the last stage of the grain growth, an aqueous KI solution corresponding to 0.001 mol to the total amount of silver, was added to the reaction vessel over 1 minute. The addition was started at the point of time when 93% of all grain formation was completed.

Thereafter, compound (Y), which is a settling agent, was added at 40° C., and the pH of the solution was adjusted to about 3.5 and desalting and washing were performed.

Compound X

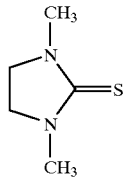

Compound Y

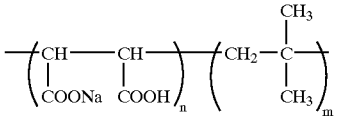

n and m is each an integer.

To the emulsion after the desalting and washing with water, deionized gelatin and aqueous NaCl solution as well as an aqueous. NaOH solution were added, and the temperature of the obtained mixture was elevated to 50° C. and the mixture was adjusted to pAg 7.6 and pH 5.6.

Thus, a gelatin that contained silver halide cubic grains having the halide composition of 98.9 mol % of silver chloride, 1 mol % of silver bromide, and 0.1 mol % of silver iodide, and having the average side length of 0.70 μm with the variation coefficient of side length of 8%, was obtained.

The above-mentioned emulsion grains were maintained at 60° C., and $2.5\times10^{-4}$ mol/Ag mol of spectral sensitizing dye-1 and $2.0\times10^{31\ 4}$ mol/Ag mol of spectral sensitizing dye-2 were added to the emulsion. Furthermore, $1\times10^{31\ 5}$ mol/Ag mol of a thiosulfonic acid compound-1 was added, and then fine grain emulsion having 90 mol % of silver bromide and 10 mol % of silver chloride, having the average grain diameter of 0.05 μm, and doped with iridium hexachloride, was added and the mixture was ripened for 10 minutes. Furthermore, a fine grains having 40 mol % of silver bromide and 60 mol % of silver chloride, and having the average grain diameter of 0.05 μm, were added and the mixture was ripened for 10 minutes. The fine grains were dissolved, thus the silver bromide content of host cubic grains increased to 1.3 mol. The iridium hexachloride was doped in the grains in an amount of $1\times10^{31\ 7}$ mol/Ag mol.

Subsequently, $1\times10^{-5}$ mol/Ag mol of sodium thiosulfate and $2\times10^{31\ 5}$ mol of gold sensitizer-1 were added to the mixture, and immediately the temperature of the mixture was elevated to 60° C., and subsequently ripened for 40 minutes. Thereafter, the temperature of the mixture was lowered to 50° C. Immediately thereafter, mercapto compound-1 and -2 were added to the mixture so that their amount each became $6\times10^{-4}$ mol/Ag mol. Thereafter, after 10 minutes of ripening, an aqueous KBr solution was added to the mixture so that KBr became 0.008 mol per mol of Ag. After 10 minutes of ripening, the temperature of the mixture was decreased and the product was stored.

Thus, a blue sensitive layer high-sensitivity emulsion A-1 was prepared.

In the same manner as the above-mentioned emulsion preparation method, except for the temperature during grain formation, cubic grains having an average side length of 0.55 μm with a variation coefficient of side length of 9% were formed. The temperature during grain formation was 55° C.

Spectral sensitization and chemical sensitization were performed in the same manner as the above, except for correcting the sensitization amounts so as to meet specific surface area (according to the ratio of the side lenghts 0.7/0.55=1.27 fold), to prepare a blue sensitive layer low-sensitivity emulsion A-2.

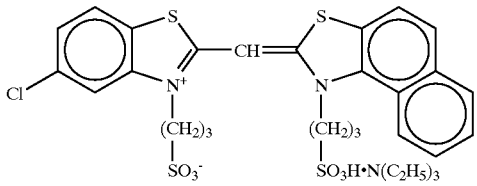

Spectral sensitizing dye-1

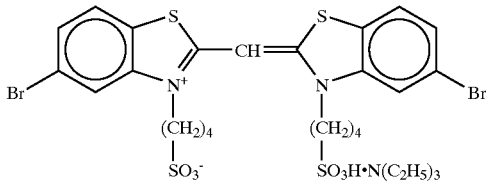

Spectral sensitizing dye-2

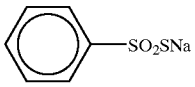

Thiosulfonic acid compound-1

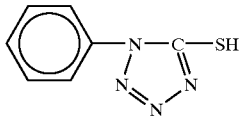

Mercapto compound-1

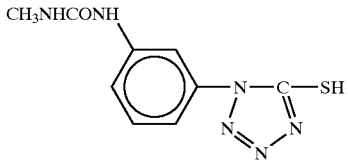

Mercapto compound-2

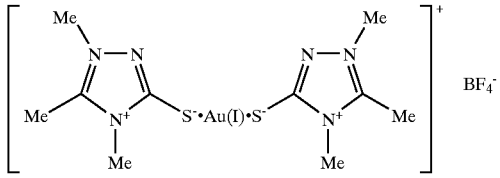

Gold sensitizer-1

(Preparation of Inventive Green Sensitive Layer Emulsions C-1 and C-2)

Under the same preparation conditions for emulsions A-1 and A-2, except that the temperature at the time of forming grains was lowered, and the kind of sensitizing dyes were changed as described below, a green sensitive layer high-sensitivity emulsion C-1 and a green sensitive layer low-sensitivity emulsion C-2 were prepared.

As for the grain size, the high-sensitivity emulsion C-1 had the average side length of 0.40 μm and the low-sensitivity emulsion C-2 had the average side length of 0.30 μm, each with the variation coefficient of average length of 8%.

(Sensitizing dye D)

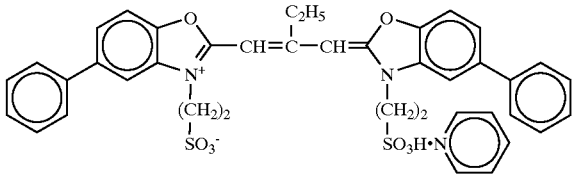

(Sensitizing dye E)

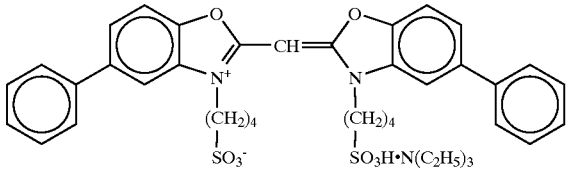

(The sensitizing dye D was added to the large-size emulsion (high-sensitivity emulsion C-1) in an amount of $3.0\times10^{-4}$ mol, and to the small-size emulsion (low-sensitivity emulsion C-2) in an amount of $3.6\times10^{-4}$ mol, per mol of the silver halide; and the sensitizing dye E was added to the large-size emulsion in an amount of $4.0\times10^{-5}$ mol, and to the small-size emulsion in an amount of $7.0\times10^{-5}$ mol, per mol of the silver halide.)

(Preparation of Inventive Red Sensitive Layer Emulsions E-1 and E-2)

Under the same preparation conditions for emulsions A-1 and A-2, except that the temperature at the time of forming grains was lowered, and the kind of sensitizing dye was changed as described below, a red sensitive layer high-sensitivity emulsion E-1 and a red sensitive layer low-sensitivity emulsion E-2 were prepared.

As for the grain size, the high-sensitivity emulsion E-1 had the average side length of 0.38 μm and the low-sensitivity emulsion E-2 had the average side length of 0.32 μm, and the variation coefficient of average side length were 9% and 10%, respectively.

(Sensitizing dye G)

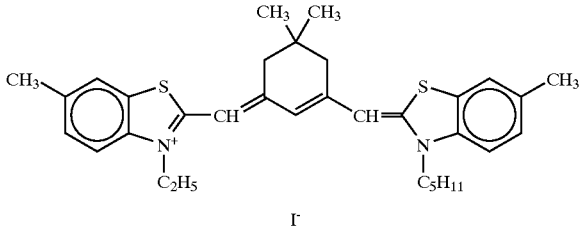

(Sensitizing dye H)

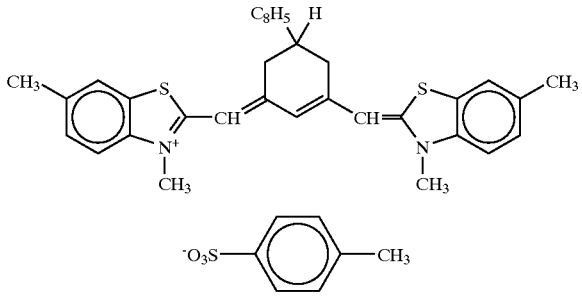

(The sensitizing dyes G and H were added to the large-size emulsion (high-sensitivity emulsion E-1) in an amount of $8.0\times10^{-5}$ mol, respectively, per mol of silver halide, and to the small-size emulsion (low-sensitivity emulsion E-2) in an amount of $10.7\times10^{-5}$ mol, respectively, per mol of silver halide. Further, the following compound I was added to the red-sensitive emulsion layer in an amount of $3.0\times10^{-3}$ mol per mol of the silver halide.)

(Compound I)

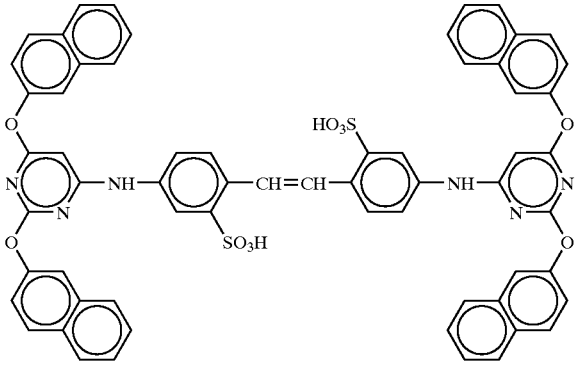

Note that when the emulsions A-1, A-2, C-1, C-2, E-1 and E-2 were each analyzed for iodide ion concentration distribution and bromide ion concentration distribution, with an etching/TOF-SIMS method. It was revealed that, in each emulsion, iodide ions had maximum concentration on the surface of the grains with the concentration being attenuated inward, and the silver iodide-containing phase was formed in a layer form around the grain center, and that the silver bromide-containing phase was present below the silver iodide-containing phase in a layer form and around the grain center.

(Preparation of a Coating Solution for the First Layer)

Into 21 g of a solvent (Solv-1) and 80 ml of ethyl acetate were dissolved 57 g of a yellow coupler (ExY), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions A-1 and A-2 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1)

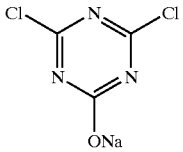

Hardener
(used in an amount of 1.4 mass % per gelatin)

(H-2)

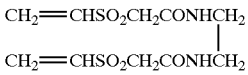

Hardener (H-3)

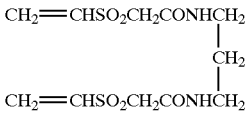

Hardener (Ab-1)

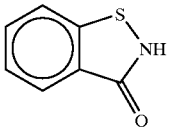

Antiseptic (Ab-2)

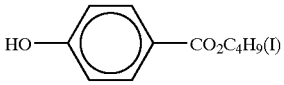

Antiseptic (Ab-3)

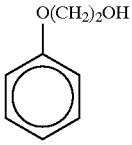

Antiseptic (Ab-4)

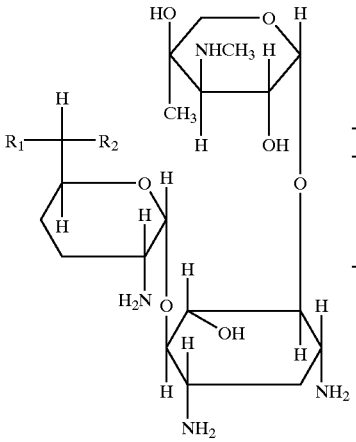

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

Antiseptic

A mixture in 1:1:1:1 (molar ratio) of a, b, c and d

Further, to the second layer, the fourth layer, the sixth layer, and the seventh layer, was added 1-(3-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in weight ratio; average molecular weight, 200,000 to 400,000) in an amount of 0.05 g/m$^2$.

Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively.

Further, in order to prevent irradiation, the following dyes (coating amounts are shown in parentheses) were added.

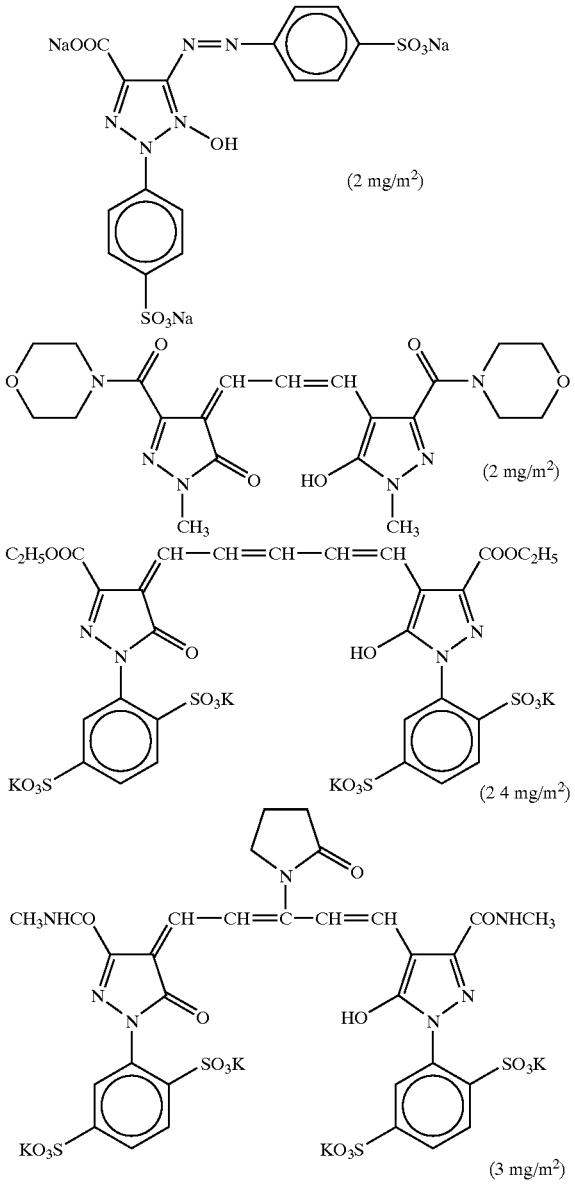

(Layer Constitution)

The composition of each layer is shown below. The numbers show coating amounts (g/m$^2$). In the case of the silver halide emulsion, the coating amount is in terms of silver.

Support

Polyethylene resin-laminated paper

[The polyethylene resin on the first layer side contained a white pigment ($TiO_2$; content of 16 wt %, ZnO; content of 4 wt %), a fluorescent whitening agent (4,4'-bis(5-methylbenzoxazolyl)stilbene; content of 0.03 wt %) and a bluish dye (ultramarine; content of 0.33 wt %). The amount of the polyethylene resin was 29.2 g/m$^2$]

| | |
|---|---|
| First Layer (Blue-Sensitive Emulsion Layer) | |
| Silver chloroiodobromide emulsion A (gold-sulfur sensitized cubes, a 3:7 mixture of the large-size emulsion A-1 and the small-size emulsion A-2 (in terms of mol of silver)) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 1.15 |
| Color-mixing inhibitor (Cpd-4) | 0.10 |
| Color-image stabilizer (Cpd-5) | 0.018 |
| Color-image stabilizer (Cpd-6) | 0.13 |
| Color-image stabilizer (Cpd-7) | 0.07 |
| Solvent (Solv-1) | 0.04 |
| Solvent (Solv-2) | 0.12 |
| Solvent (Solv-5) | 0.11 |
| Third Layer (Green-Sensitive Emulsion Layer) | |
| Silver chloroiodobromide emulsion C (gold-sulfur sensitized cubes, a 1:3 mixture of the large-size emulsion C-1 and the small-size emulsion C-2 (in terms of mol of silver)) | 0.14 |
| Gelatin | 1.21 |
| Magenta coupler (ExM) | 0.15 |
| Ultraviolet absorbing agent (UV-A) | 0.14 |
| Color-image stabilizer (Cpd-2) | 0.003 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-3) | 0.09 |
| Solvent (Solv-4) | 0.18 |
| Solvent (Solv-5) | 0.17 |
| Fourth Layer (Color-Mixing Inhibiting Layer) | |
| Gelatin | 0.68 |
| Color-mixing inhibitor (Cpd-4) | 0.06 |
| Color-image stabilizer (Cpd-5) | 0.011 |
| Color-image stabilizer (Cpd-6) | 0.08 |
| Color-image stabilizer (Cpd-7) | 0.04 |
| Solvent (Solv-1) | 0.02 |
| Solvent (Solv-2) | 0.07 |
| Solvent (Solv-5) | 0.065 |
| Fifth Layer (Red-Sensitive Emulsion Layer) | |
| Silver chloroiodobromide emulsion E (gold-sulfur sensitized cubes, a 5:5 mixture of the large-size emulsion E-1 and the small-size emulsion E-2 (in terms of mol of silver)) | 0.16 |
| Gelatin | 0.95 |
| Cyan coupler (ExC-1) | 0.023 |
| Cyan coupler (ExC-2) | 0.05 |
| Cyan coupler (ExC-3) | 0.17 |
| Ultraviolet absorbing agent (UV-A) | 0.055 |
| Color-image stabilizer (Cpd-1) | 0.22 |
| Color-image stabilizer (Cpd-7) | 0.003 |
| Color-image stabilizer (Cpd-9) | 0.01 |
| Color-image stabilizer (Cpd-12) | 0.01 |
| Solvent (Solv-8) | 0.05 |

-continued

| Sixth Layer (Ultraviolet Absorbing Layer) | |
|---|---|
| Gelatin | 0.46 |
| Ultraviolet absorbing agent (UV-B) | 0.35 |
| Compound (Sl-4) | 0.0015 |
| Solvent (Solv-7) | 0.18 |
| **Seventh Layer (Protective Layer)** | |
| Gelatin | 1.00 |
| Acryl-modified copolymer of polyvinyl alcohol (modification degree: 17%) | 0.4 |
| Liquid paraffin | 0.02 |
| Surface-active agent (Cpd-13) | 0.02 |

(ExY) Yellow coupler

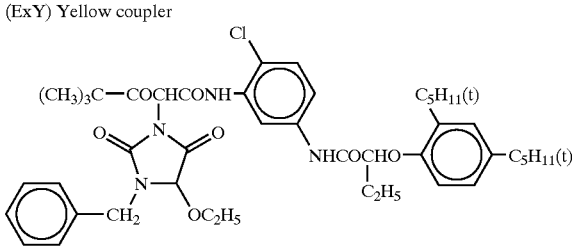

(ExM) Magenta coupler

A mixture in 40:40:20 (molar ratio) of

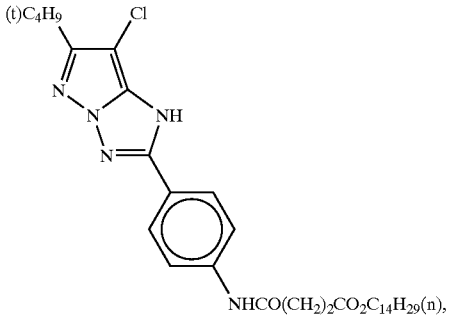

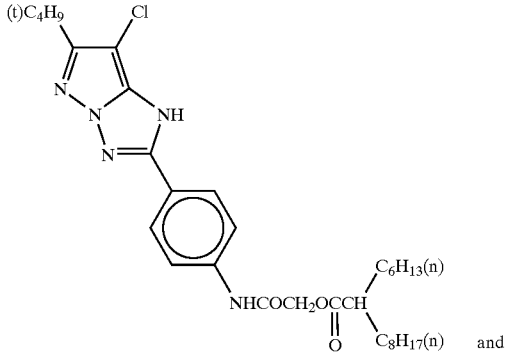

and

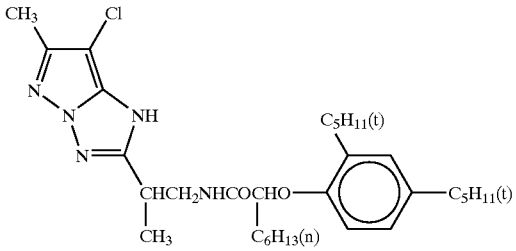

-continued (ExC-1) Cyan coupler

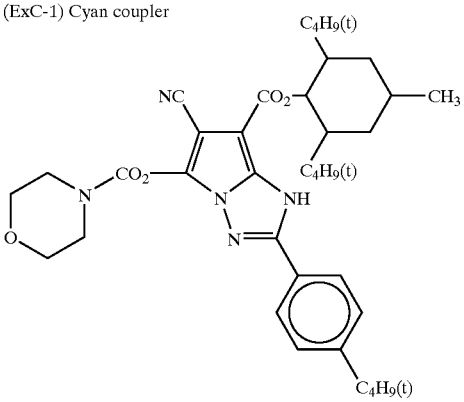

(ExC-2) Cyan coupler

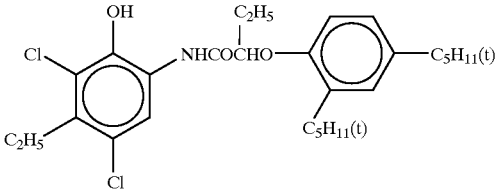

(ExC-3) Cyan coupler

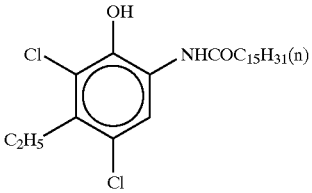

(Cpd-1) Color-image stabilizer

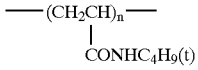

number-average molecular weight 60,000

(Cpd-2) Color-image stabilizer

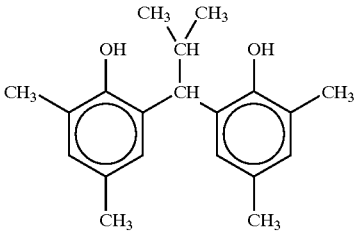

(Cpd-3) Color-image stabilizer

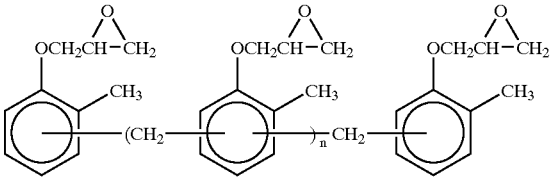

n = 7~8
(average value)

-continued
(Cpd-4) Color-mixing inhibitor
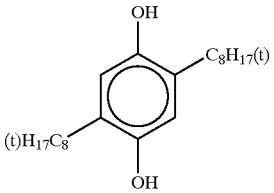
(Cpd-5) Color-image stabilizer
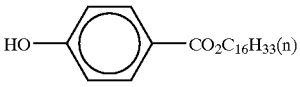
(Cpd-6) Color-image stabilizer
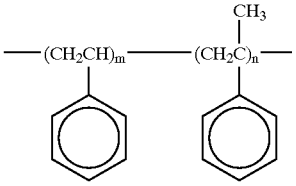
number-average molecular weight 600
m/n = 10/90
(Cpd-7) Color-image stabilizer
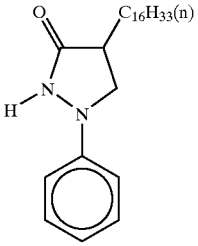
(Cpd-8) Color-image stabilizer
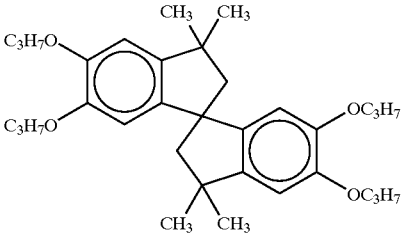
(Cpd-9) Color-image stabilizer
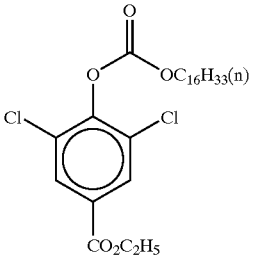
-continued
(Cpd-10) Color-image stabilizer
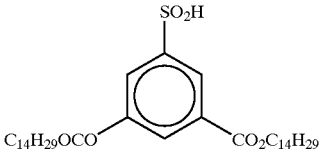
(Cpd-11)
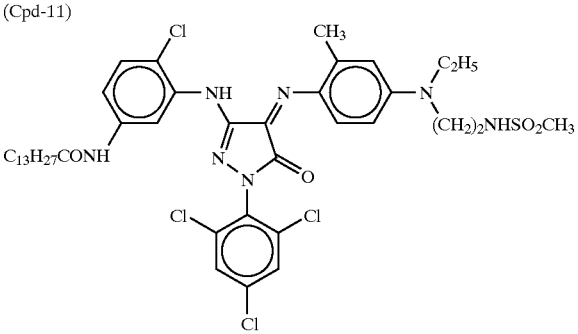
(Cpd-12)
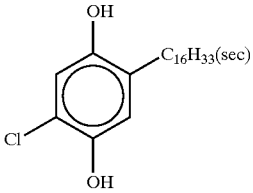
(Cpd-13) Surface-active agent
A mixture in 7:3 (molar ratio) of
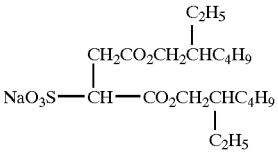
and
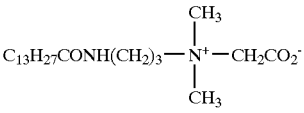
(Cpd-14)
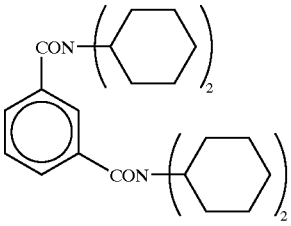
(Cpd-15)
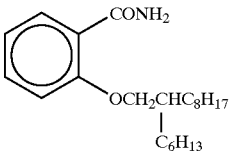

-continued
(Cpd-16)
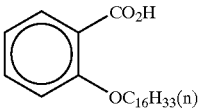
(Cpd-17)
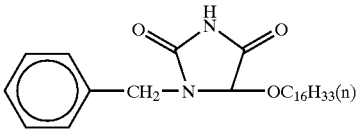
(Cpd-18)
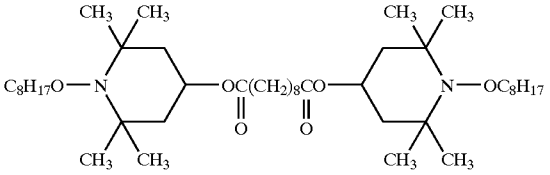
(Cpd-19) Color-mixing inhibitor
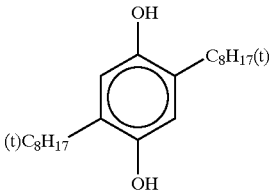
(Cpd-20)
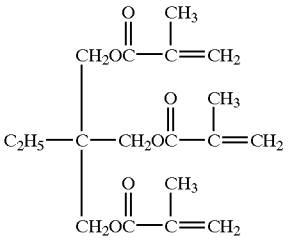
(Solv-1)
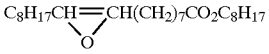
(Solv-2)
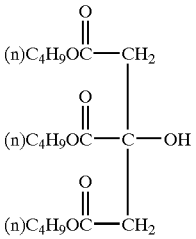
(Solv-3)
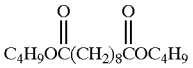
(Solv-4)
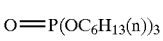
-continued
(Solv-5)
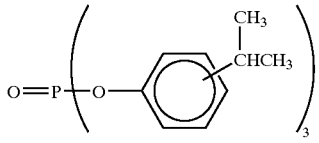
(Solv-7)
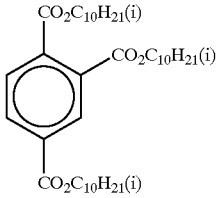
(Solv-8)
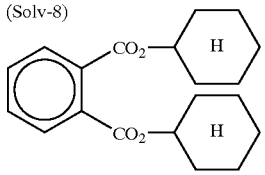
(S1-4)
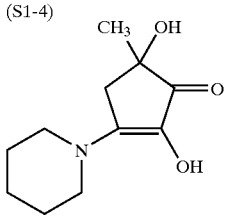
(UV-1) Ultraviolet absorbing agent
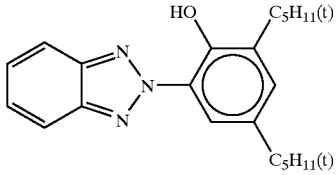
(UV-2) Ultraviolet absorbing agent
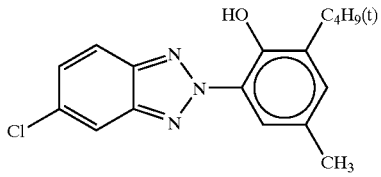
(UV-3) Ultraviolet absorbing agent
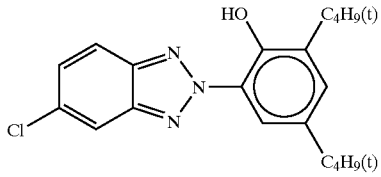

-continued (UV-5) Ultraviolet absorbing agent

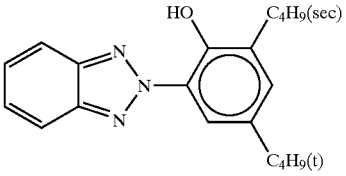

(UV-6) Ultraviolet absorbing agent

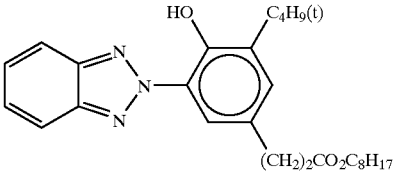

(UV-7) Ultraviolet absorbing agent

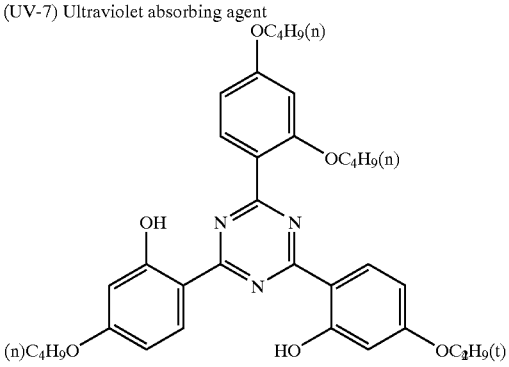

UV-A: A mixture of UV-1/UV-2/UV-3 = 7/2/2 (mass ratio)
UV-B: A mixture of UV-1/UV-2/UV-3/UV-5/UV-6 = 13/3/3/5/3 (mass ratio)
UV-C: A mixture of UV-1/UV-3 = 9/1 (mass ratio)

Sample 101 thus prepared (with using the gold-sulfur sensitized emulsion that contained the high silver chloride grains having the AgI-content-high region and the AgBr-content-high region) was modified as described below to prepare Sample 102.

Preparation of Sample 102—(with using a gold-sulfur sensitized emulsion containing high silver chloride grains having a higher AgBr region)

Sample 102 was prepared in the same manner as Sample 101, except that the silver halide emulsions in the first, third and fifth layers of Sample 101 were changed as follows.

First Layer Silver Halide Emulsion

Silver chlorobromide emulsion B (In preparation of the emulsion A, an aqueous KBr solution corresponding to 0.02 mol was added in place of the aqueous KI solution corresponding to 0.001 mol, for both the large grain size emulsion and small grain size emulsion).

Third Layer Silver Halide Emulsion

Silver chlorobromide emulsion D (In preparation of the emulsion C, an aqueous KBr solution corresponding to 0.05 mol was added in place of the aqueous KI solution corresponding to 0.001 mol, for both the large grain size emulsion and small grain size emulsion).

Fifth Layer Silver Halide Emulsion

Silver chlorobromide emulsion F (In preparation of the emulsion E, an aqueous KBr solution corresponding to 0.02 mol was added in place of the aqueous KI solution corresponding to 0.001 mol, for both the large grain size emulsion and small grain size emulsion).

Note that each emulsion contained grains, in which, around the silver chloride core, the first shell (silver bromide-containing phase) and the second shell (silver bromide-containing phase on the grain surface side) were formed in a layer form.

Example 2

Using the photosensitive materials described in Example 1, the scanning exposure described below was performed, based on digital data obtained by reading information formed on negative with a scanner. As a result, it was confirmed that a photosensitive material that obtains excellent white background, can be obtained according to the present invention. As to the entire image, good evaluations were obtained from persons who tested it.

For the scanning exposure, the scanning exposure apparatus shown in FIG. 1 of JP-A-8-16238 was used. As the light source, a semiconductor laser was used to obtain a light source at 688 nm (R light), a semiconductor laser was combined with SHG to obtain a light source at 532 nm (G light) and a light source at 473 nm (B light). The quantity of light was modulated with using an outer modulator, and scanning exposure was performed to a sample moving in a direction orthogonal to the scanning direction, by reflecting the light on a rotating polygon. The scanning exposure was performed at the density of 400 dpi and the average exposure time per 1 pixel was $8\times10^{-8}$ second. The temperature of the semiconductor laser was kept constant, with using a Peltier element, in order to prevent the change in quantity of light due to change in temperature.

Processing Step A

The processing using the following running processing solution was named Processing A.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Notes)
*Replenishment rate per $m^2$ of the light-sensitive material to be processed.
**A rinse cleaning system RC50D, trade name, manufactured by Fuji Photo Film Co. Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated liquid was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows.

| | (Tank solution) | (Replenisher) |
|---|---|---|
| (Color developer) | | |
| Water | 800 ml | 800 ml |
| Fluorescent whitening agent (FL-1) | 2.2 g | 5.1 g |
| Fluorescent whitening agent (FL-2) | 0.35 g | 1.75 g |

-continued

| | (Tank solution) | (Replenisher) |
|---|---|---|
| Triisopropanolamine | 8.8 g | 8.8 g |
| Polyethyleneglycol (Average molecular weight 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-amino-3-methyl-N-ethyl-N-(β-methanesulfonamidoethyl)aniline .3/2 sulfate.monohydrate | 4.8 g | 14.0 g |
| Potassium carbonate | 26.3 g | 26.3 g |
| Water to make | 1000 ml | 1000 ml |
| pH (25° C., adjusted using sulfuric acid and potassium hydroxide) | 10.15 | |
| (Bleach-fixing solution) | | |
| Water | 800 ml | 800 ml |
| Ammonium thiosulfate (750 g/l) | 107 ml | 214 ml |
| m-Carboxymethylbenzenesulfinic acid | 8.3 g | 16.5 g |
| Ammonium iron (III) ethylenediamine tetraacetic acid | 47.0 g | 94.0 g |
| Ethylenediaminetetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.5 | 6.5 |
| (Rinse solution) | | |
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Processing Step B

Sample 101 was processed into a form of a roll with a width of 127 mm, and the photosensitive material was imagewise exposed from a negative film of average density, by using a laboratory processor obtained by modifying Mini Labo Printer Processor PP350 manufactured by Fuji Photo Film Co., Ltd. so that the processing time and processing temperature could be changed, and continuous processing (running test) was performed until the volume of the color developer replenisher used in the following processing step became double the volume of the color developer tank. The processing using this running processing solution was named processing B.

| Processing step | Temperature | Time | Replenishment rate* |
|---|---|---|---|
| Color development | 45.0° C. | 20 sec | 45 ml |
| Bleach-fixing | 40.0° C. | 20 sec | 35 ml |
| Rinse (1) | 40.0° C. | 8 sec | — |
| Rinse (2) | 40.0° C. | 8 sec | — |

-continued

| Processing step | Temperature | Time | Replenishment rate* |
|---|---|---|---|
| Rinse (3)** | 40.0° C. | 8 sec | — |
| Rinse (4)** | 38.0° C. | 8 sec | 121 ml |
| Drying | 80° C. | 15 sec | |

(Notes)

*Replenishment rate per $m^2$ of the light-sensitive material to be processed.

**A rinse cleaning system RC50D, trade name, manufactured by Fuji Photo Film Co. Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated liquid was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows.

| | (Tank solution) | (Replenisher) |
|---|---|---|
| (Color developer) | | |
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-amino-3-methyl-N-ethyl-N-(β-methanesulfonamidoethyl)aniline .3/2 sulfate.monohydrate | 7.0 g | 19.0 g |
| Potassium carbonate | 26.3 g | 26.3 g |
| Water to make | 1000 ml | 1000 ml |
| pH (25° C., adjusted using sulfuric acid and potassium hydroxide) | 10.25 | 12.6 |
| (Bleach-fixing solution) | | |
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.00 | 6.00 |
| (Rinse solution) | | |
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Processing step C

A processing formulation, in a form of concentrated liquid, for color developing, was prepared as follows.

(1) Preparation of color development composition

| | |
|---|---|
| Compound P-3 | 25 mmol |
| Compound S-3 | 35 mmol |
| Triisopropanolamine | 40.0 g |
| Ethylenediamine tetraacetic acid | 15.0 g |
| Sodium sulfite | 0.80 g |
| Sodium 4,5-dihydroxybenzene-1,3-disulfonate | 2.0 g |
| Disodium-N,N-bis(sulfonatoethyl) hydroxylamine | 55.0 g |
| 4-amino-3-methyl-N-ethyl-N-(β-methanesulfonamidoethyl)aniline .3/2 sulfate.monohydrate | 70.0 g |
| Potassium hydroxide | 34.5 g |
| Sodium hydroxide | 25.0 g |
| Potassium carbonate | 100.0 g |
| Water to make | 1000 ml |
| pH | 13.2 |

A processing was performed in quite the same manner as processing step B, except that the color developer replenisher in processing step B was changed to a replenisher obtained by diluting the above concentrated liquid to a concentration 3.84 times that of the above-mentioned concentrated liquid. (This step was named processing step C.)

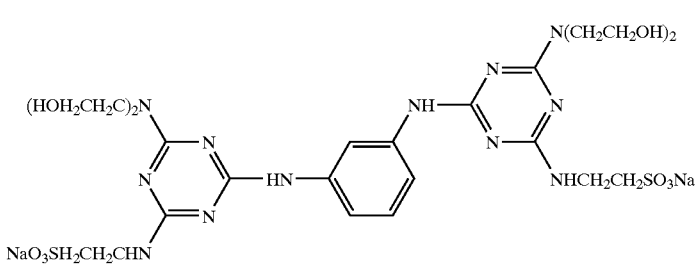

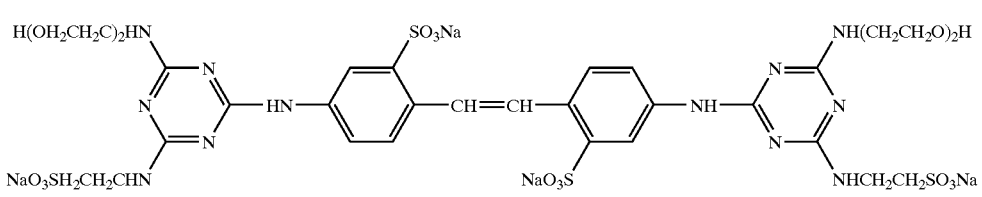

Processing Step D

A processing was performed in quite the same manner as processing step A, except that both optical brighteners FL-1 and FL-2 in processing step A, were omitted. (This step was named processing step D.)

Using the photosensitive materials 101 and 102 described in Example 1, evaluations on quality of practice image, whiteness of unexposed portion, and character reproduction were performed.

Quality of practice image was evaluated as follows: A gray image having a density of 1.5 was outputted on 500 sheets each of the photosensitive materials 101 and 102, of a quarter size (10×12-inch size), with a Frontier 350 (trade name), manufactured by Fuji Photo Film Co., Ltd. Then, a design of red, blue, and green balls, arranged on a gray background having a gray density of 1.0, was produced on 10 sheets of print. The thus-obtained prints were subjected to sensorial evaluation on the degree of unevenness and defects. The whiteness was evaluated by performing colorimetry according to CIELAB (L*). Further, character reproduction was evaluated by sensorial evaluation on visibility (degree of visual discrimination) of the Japanese character "轟" by naked eyes, printed in 6-point Mincho-tai font with white color on a black background.

Further, 10 sheets of print of the same design were also produced by the area modulation method, by conducting dot exposure of 60-line resolution with the exposure apparatus described in Example 3.

In the sensorial evaluation of the practice image, the obtained prints were evaluated according to the following three grades, and the evaluation value was obtained by taking the average of the grades obtained from 10 panelists:

3, no unevenness or defects observed;

2, unevenness and defects slightly observed, but there was no practical problem;

1, unevenness and defects noticeably observed.

Further, character reproduction was evaluated by picking up the most frequent answer among 10 panelists who graded the print according to the following:

"○", sufficiently visible with discrimination;

"Δ", slightly hard to discriminate but still visible;

"X", possibly misunderstood with another character.

The results are shown in Table 3.

TABLE 3

| Exposure system | | Photosensitive material 101 Practice image | Whiteness | Character | Photosensitive material 102 Practice image | Whiteness | Character | Remarks |
|---|---|---|---|---|---|---|---|---|
| Density modulation (Frontier) | Processing step A | 2.5 | 92.6 | Δ | 1.9 | 92.4 | Δ | Comparative example |
| | Processing step B | 2.6 | 92.2 | Δ | 2.1 | 91.9 | Δ | Comparative example |
| | Processing step C | 2.5 | 92.4 | Δ | 1.9 | 92.3 | Δ | Comparative example |
| | Processing step D | 2.3 | 91.4 | X | 1.3 | 90.7 | X | Comparative example |
| Area modulation (Dot exposure) | Processing step A | 2.8 | 92.6 | ○ | 2.7 | 92.4 | ○ | This invention |
| | Processing step B | 2.9 | 92.2 | ○ | 2.8 | 91.9 | ○ | This invention |
| | Processing step C | 2.7 | 92.4 | ○ | 2.6 | 92.3 | ○ | This invention |
| | Processing step D | 2.5 | 91.4 | X | 1.8 | 90.7 | X | Comparative example |

FL-1

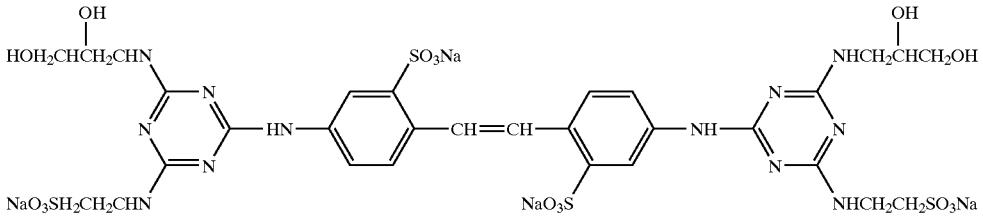

FL-2

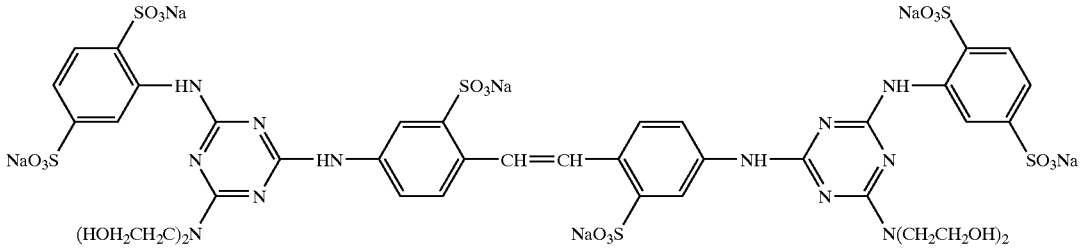

FL-3

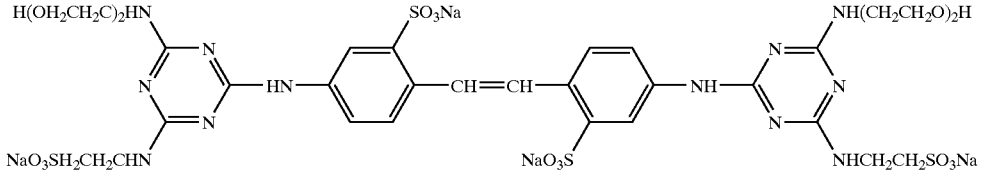

SR-1

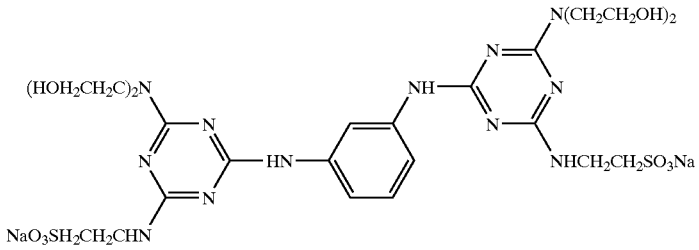

It is understood that, by conducting the Processings A, B, and C, which utilized the compounds for use in the present invention, prints excellent in whiteness and improved in character recognition were obtained. This tendency was remarkable in the area modulation exposure.

Example 3

Preparation of a Color Photosensitive Material for Color Proof

After subjecting a polyethylene-double laminated paper support (107 μm) (basis weight of raw paper, 81 g/m$^2$; front polyethylene laminate, 15 μm thick; back polyethylene laminate, 13 μm thick; the total thickness, 107 μm) to corona discharge treatment on its front side, a gelatin subbing layer containing sodium dodecylbenzenesulfonate was provided thereon, and further, various photographic constitutional layers were coated, to prepare a sample 001 having the following layer structure.

Coating solutions of respective photographic constitutional layers were prepared as follows. Preparation of the coating solution for the third layer Into 300 g of a high-boiling point organic solvent (Solv-3), 600 g of a high-boiling point organic solvent (Solv-4), 300 g of a high-boiling point organic solvent (Solv-5), and 700 ml of ethyl acetate, were dissolved 600 g of a yellow coupler (ExY-1), 2 g of a cyan coupler (ExC-2), 20 g of a color-mixing inhibiting agent (Cpd-4), 40 g of color-image stabilizer (Cpd-11), and 40 g of a color-image stabilizer (Cpd-12). This solution was emulsified and dispersed in 5000 g of a 20 % aqueous gelatin solution with 80 g of surface-active agent (W-3). Water was added thereto, to prepare 12000 g of an emulsified dispersion A.

On the other hand, a silver chlorobromide emulsion G (cubic; an average grain size of 0.60 μm. The deviation coefficient of the grain size distribution was 0.10. Each had 0.3 mol % of silver bromide locally contained in part of the grain surface whose substrate was made up of silver chloride. Herein, to the silver bromide localized part, iridium hexachloride was doped in an amount of $1\times10^{-7}$ mol/Ag mol to the total amount of silver in the silver halide grain.) was prepared.

a) Blue-sensitive Emulsion

To this emulsion, the sensitizing dyes A and C were added in an amount of $0.50\times10^{-4}$ mol per mol of silver halide, respectively, and the sensitizing dye B was added in an amount of $4.1\times10^{-4}$ mol per mol of silver halide.

Further, the chemical ripening of this emulsion was carried out by adding a sulfur sensitizer and a gold sensitizer.

The above emulsified dispersion A and the silver chlorobromide emulsion G were mixed, and the third-layer coating solution was prepared so that it would have the composition shown below. The coating amount of the emulsion is in terms of silver.

Preparation of coating solutions for the first layer, the second layer and the fourth layer to the eighth layer The coating solutions for the first layer, the second layer and the fourth layer to the seventh layer were prepared in the similar manner as the third-layer coating solution.

As a gelatin hardener for each layer, H-1, H-2 and H-3 described below was used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1)

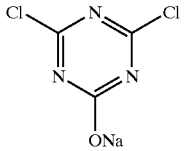

Hardener
(used in an amount of 0.5 mass % per gelatin)

-continued (H-2)

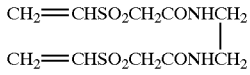

Hardener
(used in an amount of 1.2 mass % per gelatin)

(H-3)

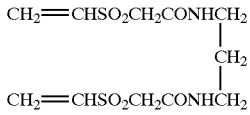

Hardener
(used in amount of 0.4 mass % per gelatin)

(Ab-1)

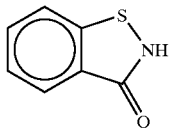

Antiseptic (Ab-2)

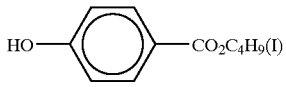

Antiseptic (Ab-3)

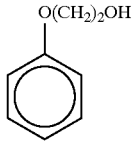

Antiseptic (Ab-4)

A mixture in 1:1:1:1 (molar ratio) of a, b, c, and d

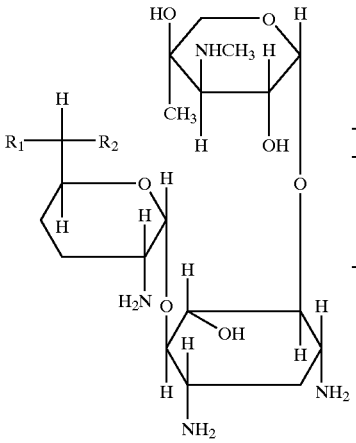

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

Antiseptic

For the silver chlorobromide emulsion in each photosensitive emulsion layer, the following spectral sensitizing dyes in the amounts described above or below, and crystal phase controlling agent 1 in an optimal amount were used.

(Sensitizing dye A)

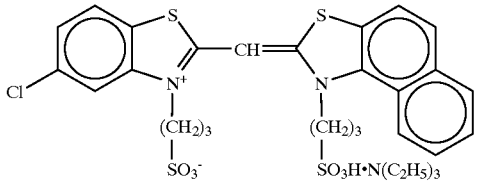

(Sensitizing dye B)

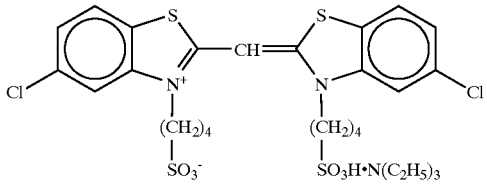

(Sensitizing dye C)

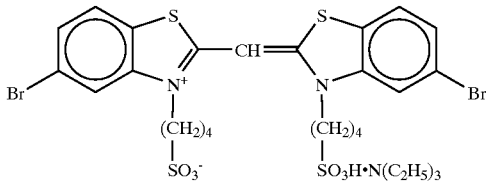

Crystal habit controlling agent 1

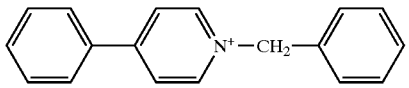

b) Green-sensitive Emulsion

An emulsion H was prepared in the same manner as the emulsion G, except that the conditions in grain formation were changed and the kind of sensitizing dye was changed as shown below.

The sensitizing dye D was added to the emulsion in an amount of $3.6\times10^{-4}$ mol, the sensitizing dye E was added to the emulsion in an amount of $7.0\times10^{-5}$ mol, and the sensitizing dye F was added to the emulsion in an amount of $2.8\times10^{-4}$ mol, respectively per mol of silver halide. Herein, to the silver bromide localized part, iridium hexachloride was doped in an amount $1\times10^{-7}$ mol/Ag mol to the total amount of silver in the silver halide grain.

Further, the chemical ripening of this emulsion was carried out by adding a sulfur sensitizer and a gold sensitizer.

c) Red-sensitive Emulsion

An emulsion I was prepared in the same manner as the emulsion G, except that the conditions on grain formation were changed and the kind of sensitizing dye was changed as shown below.

(Sensitizing dye G)

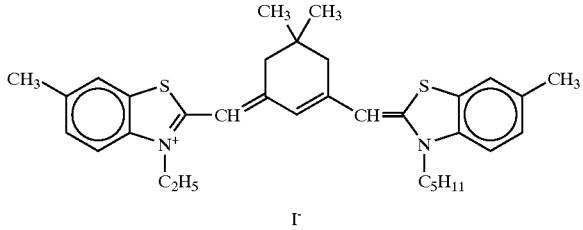

(Sensitizing dye H)

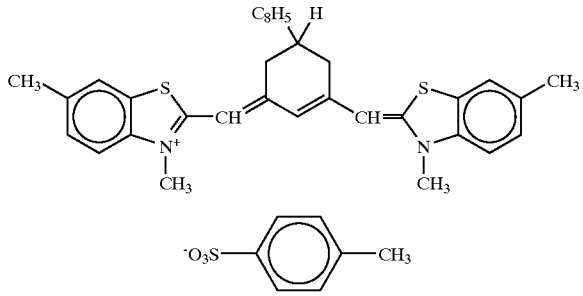

(Sensitizing dye D)

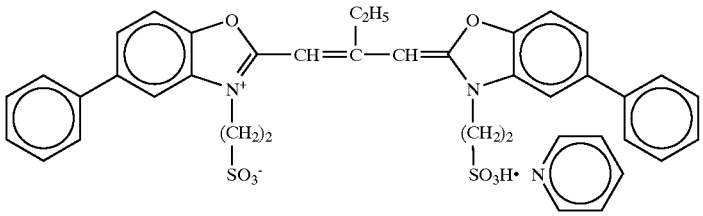

(Sensitizing dye E)

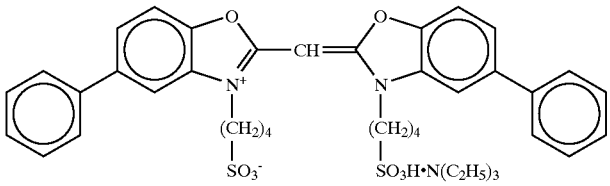

(Sensitizing dye F)

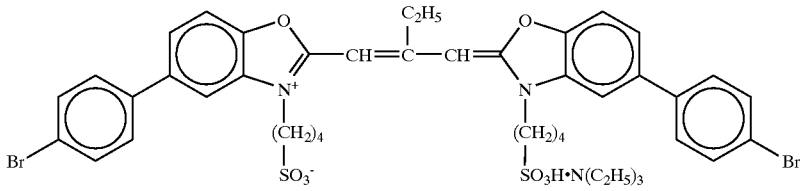

The sensitizing dyes G and H were added in an amount of $1.1\times10^{-4}$ mol, respectively per mol of silver halide.

In addition, the compound I described below was added to the red-sensitive emulsion layer in an amount of $3.0\times10^{-3}$ mol per mol of silver halide. Herein, to the silver bromide localized part, iridium hexachloride was doped in an amount $1\times10^{-7}$ mol/Ag mol to the total amount of silver in the silver halide grain.

Further, the chemical ripening of this emulsion was carried out by adding a sulfur sensitizer and a gold sensitizer.

(Compound I)

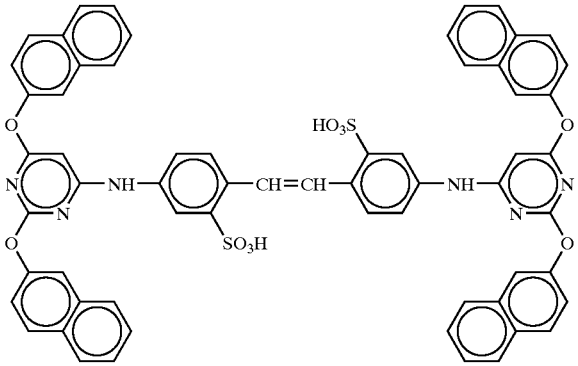

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $3.0\times10^{-4}$ mol, respectively, per mol of the silver halide. Further, the compound was also added to the first layer, the forth layer, the fifth layer, and the sixth layer, in amounts of 3.0 mg/m$^2$, 0.2 mg/m$^2$, 0.2 mg/m$^2$, and 0.2 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the fourth layer, and the sixth layer, was added disodium catechol-3,5-disulfonate in amounts of 44 mg/m$^2$, and 39 mg/m$^2$, respectively.

(Layer Constitution)

The composition of each layer is shown below. The numbers show coating amounts (g/m$^2$). In the case of the silver halide emulsion, the coating amount is in terms of silver.

Support

Polyethylene resin-laminated paper

[The polyethylene resin on the first layer side contained a white pigment ($TiO_2$; content of 17 wt %).

The whiteness on the first layer side was L*=96.5, a*=0.1, and b*=0.8.]

| First Layer (antihalation layer) | |
|---|---|
| Black colloidal silver | 0.11 |
| Gelatin | 1.04 |
| Color-mixing inhibitor (Cpd-1) | 0.047 |
| Color-image stabilizer (Cpd-2) | 0.003 |
| Color-image stabilizer (Cpd-3) | 0.030 |
| Color-mixing inhibitor (Cpd-4) | 0.003 |
| High-boiling organic solvent (Solv-1) | 0.044 |
| High-boiling organic solvent (Solv-2) | 0.077 |

-continued

| Second Layer (Intermediate layer) | |
|---|---|
| Gelatin | 1.40 |
| Irradiation neutralizing dye (A-I) | 0.007 |
| Irradiation neutralizing dye (A-II) | 0.004 |
| Third layer (Blue-sensitive emulsion layer) | |
| The silver chlorobromide emulsion G (cubes, an average grain size of 0.60 μm. The deviation coefficient of the grain size distribution was 0.10. The emulsion had 0.3 mol % of silver bromide contained locally in part of the grain surface whose substrate was made up of silver chloride. Herein, to the silver bromide localized part, iridium hexachloride was doped in an amount $1\times10^{-7}$ mol/Ag mol to the total amount of silver in the silver halide grain.) (in terms of silver) | 0.26 |
| Gelatin | 1.19 |
| Yellow coupler (ExY-1) | 0.34 |
| Cyan coupler (ExC-2) | 0.001 |
| High-boiling organic solvent (Solv-4) | 0.34 |
| High-boiling organic solvent (Solv-5) | 0.34 |
| Color-mixing inhibitor (Cpd-4) | 0.01 |
| Color-image stabilizer (Cpd-11) | 0.02 |
| Color-image stabilizer (Cpd-12) | 0.02 |
| Fourth (Color-Mixing Inhibiting Layer) | |
| Gelatin | 1.04 |
| Color-mixing inhibitor (Cpd-1) | 0.13 |
| Color-image stabilizer (Cpd-2) | 0.008 |
| Color-image stabilizer (Cpd-3) | 0.10 |
| color-mixing inhibitor (Cpd-4) | 0.009 |
| High-boiling organic solvent (Solv-1) | 0.13 |
| High-boiling organic solvent (Solv-2) | 0.22 |
| Irradiation neutralizing dye (A-III) | 0.003 |
| Irradiation neutralizing dye (A-IV) | 0.011 |
| Fifth Layer (Green-Sensitive Emulsion Layer) | |
| The silver chlorobromide emulsion H (cubes, an average grain size of 0.39 μm. The deviation coefficient of the grain size distribution was 0.08, respectively. The emulsion had 0.7 mol % of silver bromide contained locally in part of the grain surface whose substrate was made up of silver chloride. Herein, to the silver bromide localized part, iridium hexachloride was doped in an amount $1\times10^{-7}$ mol/Ag mol to the total amount of silver in the silver in the silver halide grain.) (in terms of silver) | 0.25 |
| Gelatin | 1.24 |
| Magenta coupler (ExM-1) | 0.11 |
| Yellow coupler (ExY-2) | 0.05 |
| High-boiling organic solvent (Solv-3) | 0.40 |
| Color-mixing inhibitor (Cpd-1) | 0.02 |
| Color-image stabilizer (Cpd-9) | 0.014 |
| Color-image stabilizer (Cpd-10) | 0.023 |
| Color-image stabilizer (Cpd-8) | 0.04 |
| Color-image stabilizer (Cpd-11) | 0.004 |
| Color-mixing inhibitor (Cpd-4) | 0.02 |
| Color-image stabilizer (Cpd-3) | 0.945 |
| Ultraviolet absorbing agent (UV-1) | 0.01 |
| Ultraviolet absorbing agent (UV-2) | 0.05 |
| Ultraviolet absorbing agent (UV-3) | 0.06 |
| Additive (Cpd-14) | 0.001 |
| Sixth Layer (Color-Mixing Inhibiting Layer) | |
| Gelatin | 0.91 |
| Color-mixing inhibitor (Cpd-1) | 0.12 |
| Color-image stabilizer (Cpd-2) | 0.007 |
| Color-image stabilizer (Cpd-3) | 0.07 |
| Color-mixing inhibitor (Cpd-4) | 0.008 |
| High-boiling organic solvent (Solv-1) | 0.12 |
| High-boiling organic solvent (Solv-2) | 0.19 |
| Irradiation neutralizing dye (A-III) | 0.002 |
| Irradiation neutralizing dye (A-IV) | 0.010 |

-continued

| Seventh Layer (Red-Sensitive Emulsion Layer) | |
|---|---|
| The silver chlorobromide emulsion I (cubes, an average grain size of 0.50 μm. The deviation coefficient of the grain size distribution was 0.09. The emulsion had 0.8 mol % of silver bromide contained locally in part of the grain surface whose substrate was made up of silver chloride. Herein, to the silver bromide localized part, iridium hexachloride was doped in an amount $1 \times 10^{-7}$ mol/Ag mol to the total amount of silver in the silver halide grain.) (in terms of silver) | 0.19 |
| Gelatin | 0.76 |
| Cyan coupler (ExC-1) | 0.11 |
| High-boiling organic solvent (Solv-6) | 0.16 |
| Color-image stabilizer (Cpd-3) | 0.03 |
| Color-image stabilizer (Cpd-5) | 0.05 |
| Color-image stabilizer (Cpd-6) | 0.05 |
| Color-image stabilizer (Cpd-7) | 0.01 |
| Color-image stabilizer (Cpd-13) | 0.01 |
| Color-image stabilizer (Cpd-8) | 0.02 |
| Color-mixing inhibitor (Cpd-4) | 0.02 |
| Ultraviolet absorbing agent (UV-2) | 0.04 |
| Ultraviolet absorbing agent (UV-3) | 0.13 |
| Color-mixing inhibitor (Cpd-1) | 0.03 |
| Eighth Layer (Protective Layer) | |
| Acid processed gelatin | 1.67 |
| Acryl-modified copolymer of polyvinyl alcohol (modification degree: 17%) | 0.04 |
| Polymethylmethacrylate | 0.05 |
| Surface-active agent (W-1) | 0.009 |
| Surface-active agent (W-2) | 0.009 |
| The first layer on the back side (protective layer) | |
| Gelatin | 5.5 |
| The second layer on the back side (protective layer) | |
| Gelatin | 1.2 |
| Polymethylmethacrylate | 0.05 |

Hereinbelow, the compounds used are shown.

(A-I)

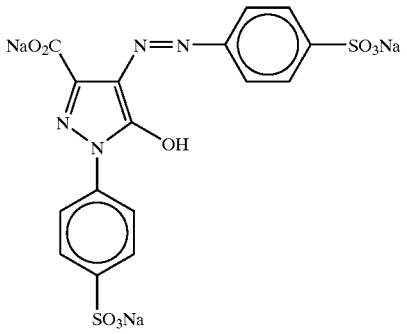

Irradiation neutralizing dye (A-II)

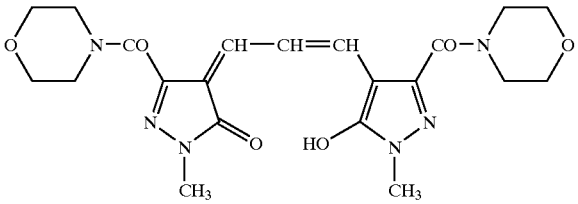

Irradiation neutralizing dye

-continued (A-III)

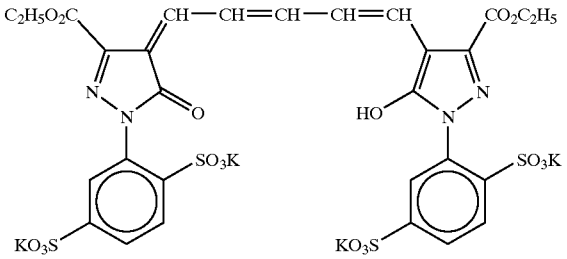

Irradiation neutralizing dye (A-IV)

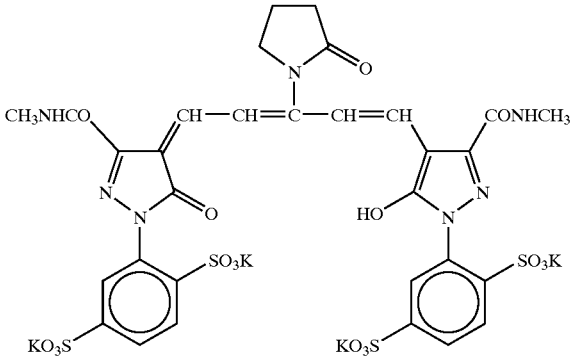

Irradiation neutralizing dye (ExY-1)

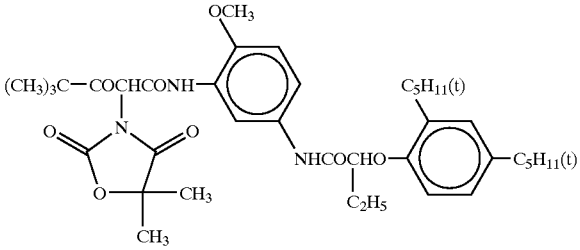

Yellow coupler (ExY-2)

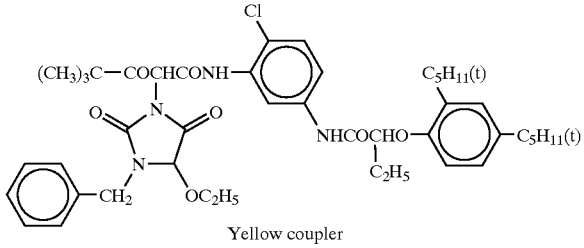

Yellow coupler (ExY-3)

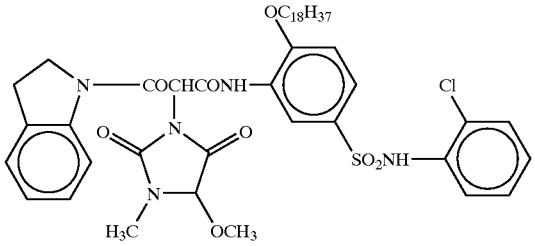

Yellow coupler

-continued
(ExM-1)
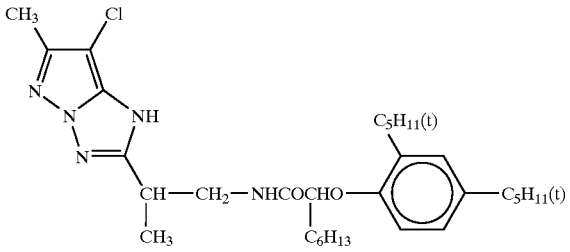
Magenta coupler
(ExC-1)
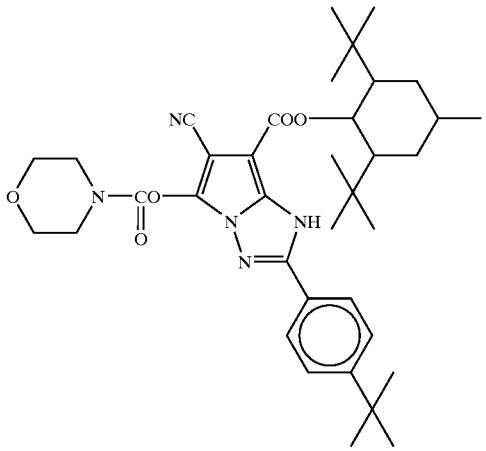
Cyan coupler
(ExC-2)
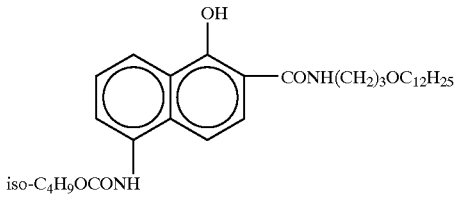
Cyan coupler
(Cpd-1)
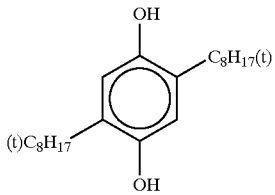
Color-mixing inhibitor
(Cpd-2)
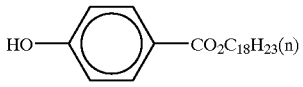
Color-image stabilizer
-continued
(Cpd-3)
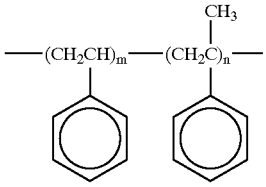
Color-image stabilizer
number-average
molecular weight
600 m/n = 10/90
(Cpd-4)
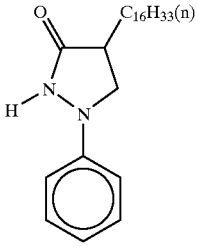
Color-mixing inhibitor
(Cpd-5)
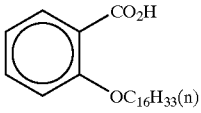
Color-image stabilizer
(Cpd-6)
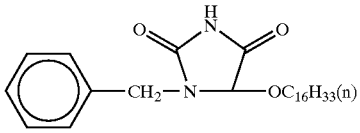
Color-image stabilizer
(Cpd-7)
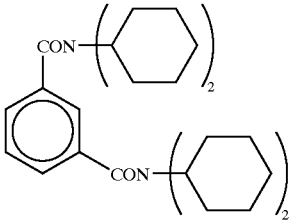
Color-image stabilizer
(Cpd-8)
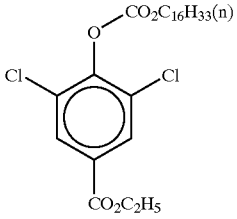
Color-image stabilizer -continued
(Cpd-9)
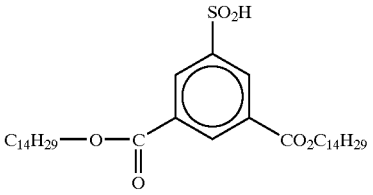
Color-image stabilizer
(Cpd-10)
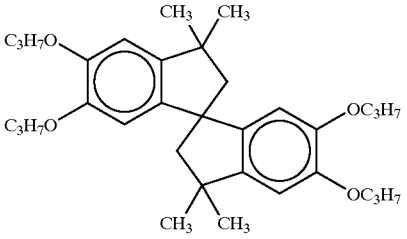
Color-image stabilizer
(Cpd-11)
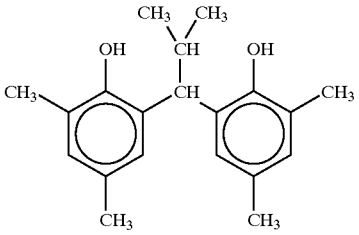
Color-image stabilizer
(Cpd-12)
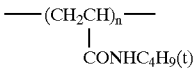
Color-image stabilizer number-average molecular weight 60,000
(Cpd-13)
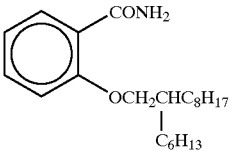
Color-image stabilizer
-continued
(Cpd-14)
A mixture in 3:1 (mass ratio) of
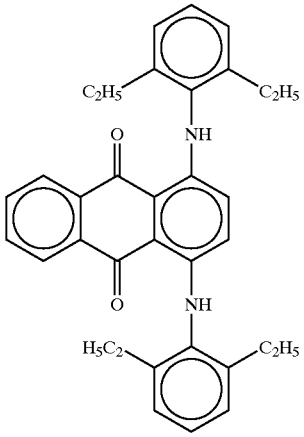
Additive and
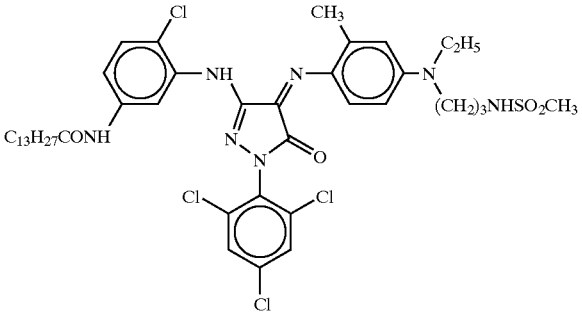
(UV-1)
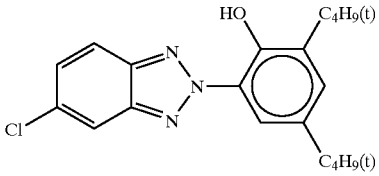
Ultraviolet absorbing agent
(UV-2)
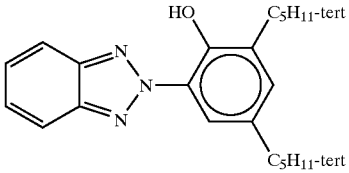
Ultraviolet absorbing agent
(UV-3)
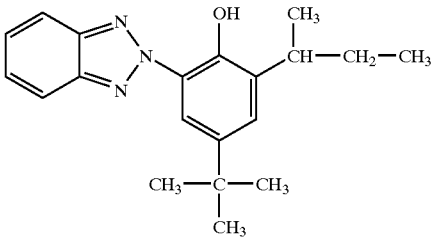
Ultraviolet absorbing agent -continued (Solv-1)

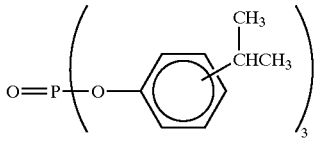

(Solv-2)

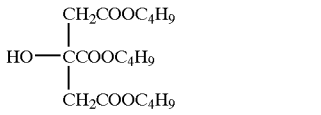

(Solv-3)

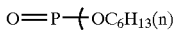

(Solv-4)

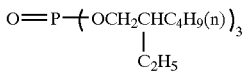

(Solv-5)

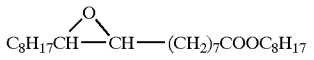

(Solv-6)

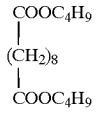

(W-1)

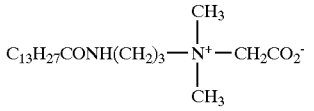

Surface-active agent (W-2)

A mixture in 6:2:2 of

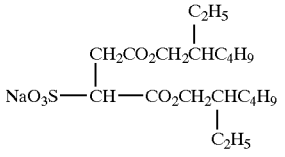

Surface-active agent

-continued (W-3)

A mixture in 1:4 (molar ratio) of

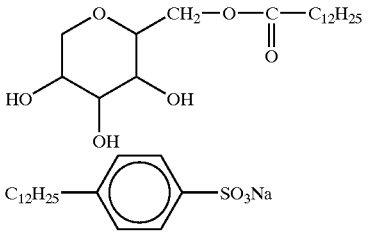

and

Surface-active agent

Sample 001 obtained as described above was closely wound around a rotary drum of 30 cm in diameter by suction adhesion, and while rotating the drum at 270 rpm, the sample was exposed to light with R (699 nm), G (525 nm), and B (465 nm) light beams from LED array (with 64 LEDs for each wavelength). Each light source was irradiated by using a 30-$\mu$m wide spot having a trapezoid intensity distribution, for an exposure time per beam of 30 $\mu$sec. Multiple exposure was performed by shifting the beam by a 10-$\mu$m interval, so that the exposure beam overlapped 20 $\mu$m long on the photosensitive side of the photosensitive material.

After the exposure, color development processing was performed by the following processing step.

| Processing step | Temperature | Time | Replenishment rate* | Tank volume |
|---|---|---|---|---|
| Color development | 38.5° C. | 73 sec | 320 ml | 17 liter |
| Bleach-fixing | 38° C. | 74 sec | 88 ml | 17 liter |
| Rinse (1) | 38° C. | 33 sec | — | 7.5 liter |
| Rinse (2) | 38° C. | 33 sec | — | 7.5 liter |
| Rinse (3) | 38° C. | 41 sec | 385 ml | 7.9 liter |
| Dry | 60 to 80° C. | 57 sec | | |

*Replenishment rate per $m^2$ of the light-sensitive material to be processed.

(The rinse was made in a tank counter-current system from (3) to (1).)

The composition of each processing solution was as follows.

| | (Tank solution) | (Replenisher) |
|---|---|---|
| (Color developer) | | |
| Water | 700 ml | 700 ml |
| Fluorescent whitening agent (FL-1) | 5.0 g | 7.5 g |
| Triisopropanolamine | 8.8 g | 8.8 g |
| Sodium paratoluenesulfonate | 10.0 g | 18.0 g |
| Sodium paratoluenesulfinate | 5.0 g | 6.0 g |
| Ethylenediamine tetraacetic acid | 4.0 g | 4.0 g |

-continued

| | (Tank solution) | (Replenisher) |
|---|---|---|
| Sodium sulfite | 0.10 g | 0.10 g |
| Potassium chloride | 8.6 g | — |
| Sodium 4,5-dihydroxybenzene-1,3-disulfonate | 0.50 g | 0.50 g |
| Disodium-N,N-bis (sulfonatoethyl) hydroxylamine | 12.1 g | 14.8 g |
| 4-amino-3-methyl-N-ethyl-N-(β-methanesulfonamidoethyl)aniline.3/2 sulfate acid.1 hydrate | 4.8 g | 8.5 g |
| Potassium carbonate | 26.3 g | 26.3 g |
| Water to make | 1000 ml | 1000 ml |
| pH (25° C.) | 10.15 | 11.95 |

FL-1

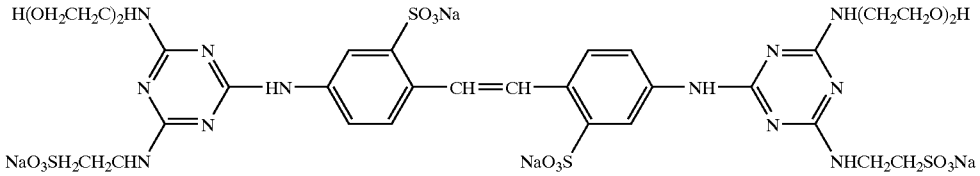

| | | |
|---|---|---|
| (Bleach-fixing solution) | | |
| Water | 800 ml | 800 ml |
| Ammonium thiosulfate (750 g/l) | 140 ml | 187 ml |
| m-Carboxybenzene sulfinic acid | 20.4 g | 27.2 g |
| Ammonium iron (III) ethylenediaminetetraacetate | 71.4 g | 95.4 g |
| Ethylenediamine tetraacetic acid | 1.4 g | 1.4 g |
| Nitric acid (67%) | 20.8 g | 41.7 g |
| Imidazole | 14.6 g | 19.7 g |
| Ammonium sulfite | 27.3 g | 36.4 g |
| Ammonium bromide | 30.0 g | 40.0 g |
| Water to make | 1000 ml | 1000 ml |
| pH (25° C.) (adjusted using acetic acid and aqueous ammonia) | 6.13 | 5.5 |
| (Rinse solution) | | |
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Example 4

Next, the same processing as in Example 3 was performed, except that the optical brightener FL-1 contained in the color developer was omitted. Then, the whiteness of unexposed portion was evaluated. Further, character reproduction was evaluated by sensorial evaluation on visibility (degree of visual discrimination) of the Japanese character "轟" by naked eyes, printed in 4-point Mincho-tai font with white color on a black background. The most frequent answer among 10 panelists was picked up as the evaluation result. The character on the prints was graded according to the following:

"○", sufficiently visible with discrimination;

"Δ", slightly hard to discriminate but still visible;

"X", possibly misunderstood with another character.

The results are shown in Table 4.

TABLE 4

| Color developer | Whiteness | Visibility | Remarks |
|---|---|---|---|
| FL-1 included | L* = 93.2 | ○ | This invention |
| FL-1 not included | L* = 91.7 | X | Comparative example |
| JC Japan color | L* = 93.5 | — | Desired whiteness of proof |

From the results shown in Table 4, it was understood that the image forming method of the present invention attained prints with excellent whiteness and high visibility of a small-size character.

Example 5

The evaluation in Examples 3 and 4 was performed employing the sample that prepared with emulsions A', C', and E' obtained by changing the kinds and amounts of sensitizing dyes in the emulsions A, C and E prepared in Example 1, respectively, so as to be identical to those in the corresponding emulsions G, H, and I. As a result, the whiteness and the visibility after color development in the case where the sample was processed with the color developer including FL-1, was superior to that obtained in the preceding examples.

Having described our invention as related to the present embodiments, it is our intention that the invention not be limited by any of the details of the description, unless otherwise specified, but rather be construed broadly within its spirit and scope as set out in the accompanying claims.

What we claim is:

1. A color image forming method, comprising:

subjecting a silver halide color photosensitive material to exposure, and processing the silver halide color photosensitive material with a processing solution;

wherein the silver halide color photosensitive material comprises, on a support, at least one silver halide emulsion layer containing a yellow dye-forming coupler, at least one silver halide emulsion layer containing a magenta dye-forming coupler, at least one silver halide emulsion layer containing a cyan dye-forming coupler, a color mixing prevention layer, and a protective layer;

wherein a silver halide emulsion in at least one of the silver halide emulsion layers contains at least one kind of silver halide grains selected from the group consisting of silver chlorobromide grains, silver chloroiodide grains, and silver chloroiodobromide grains, each having a silver chloride content of 95 mol % or more, and each having a region where at least one of a silver bromide content and a silver iodide content is higher than those in other regions of the silver halide grain; and wherein the exposure is performed based on digital image data that has been modulated into data for area modulation and converted into exposure-device-dependent digital data for exposure, and wherein the processing solution contains at least one compound selected from the group consisting of a compound represented by formula (I) and a compound represented by formula (II):

formula (I)

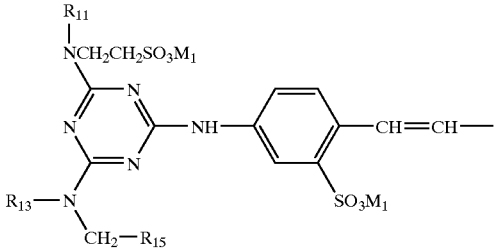

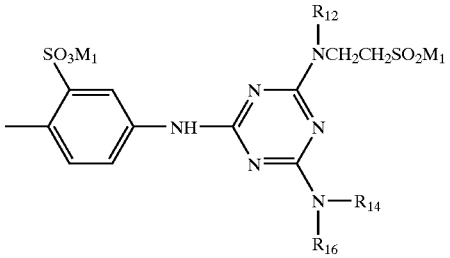

wherein $R_{11}$ and $R_{12}$ each independently represent a hydrogen atom or an alkyl group; $R_{13}$ and $R_{14}$ each independently represent a hydrogen atom, an alkyl group or an aryl group; $R_{15}$ represents an alkyl group having at least one asymmetric carbon or a group represented by formula (I-a); $R_{16}$ represents an alkyl group having at least one asymmetric carbon or a group represented by formula (I-b); $M_1$ represents a hydrogen atom, an alkali metal atom, an alkaline earth metal atom, an ammonium group, or a pyridinium group; and $R_{13}$ and $R_{15}$, and $R_{14}$ and $R_{16}$ may combine each other to form a ring;

$$—CH_2O(CH_2CH_2O)_{n_{11}}H \qquad \text{formula (I-a)}$$

wherein $n_{11}$ is an integer of 1 to 3;

$$—(CH_2CH_2O)_{n_{12}}H \qquad \text{formula (I-b)}$$

wherein $n_{12}$ is an integer of 2 to 4;

formula (II)

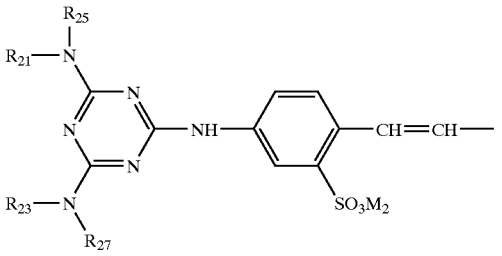

-continued

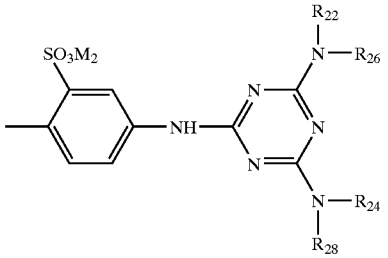

wherein $R_{21}$, $R_{22}$, $R_{23}$, and $R_{24}$ each independently represent a hydrogen atom, an alkyl group, or an aryl group; $R_{25}$ and $R_{26}$ each independently represent an alkyl group having at least one asymmetric carbon or a group represented by formula (II-a); $R_{27}$ and $R_{28}$ each independently represent an alkyl group having at least one asymmetric carbon; $M_2$ represents a hydrogen atom, an alkali metal atom, an alkaline earth metal atom, an ammonium group, or a pyridinium group; and $R_{21}$ and $R_{25}$, $R_{22}$ and $R_{26}$, $R_{23}$ and $R_{27}$, and $R_{24}$ and $R_{28}$ may combine each other to form a ring;

$$—(CH_2CH_2O)_{n_{21}}H \qquad \text{formula (II-a)}$$

wherein $n_{21}$ is an integer of 2 to 4.

2. The color image forming method as claimed in claim 1, wherein a color processing composition containing at least one compound selected from the group consisting of the compound represented by formula (I) in which at least one of $R_{15}$ and $R_{16}$ has at least one hydroxyl group and the compound represented by formula (II) in which at least one of $R_{25}$, $R_{26}$, $R_{27}$, and $R_{28}$ has at least one hydroxyl group, is used.

3. The color image forming method as claimed in claim 1, wherein the silver halide color photosensitive material is for color proof.

4. The color image forming method as claimed in claim 1, wherein the exposure is performed by scanning exposure using at least one light emission source selected from the group consisting of a gas laser, a light-emitting diode, a semiconductor laser, a solid laser, and a combination of any of these with a second harmonic generation light source.

5. The color image forming method as claimed in claim 1, wherein the exposure is performed through a multi-channel comprising a plurality of exposure light sources emitting light at the same wavelength.

6. The color image forming method as claimed in claim 1, wherein the silver halide grains contain an iridium compound.

7. The color image forming method as claimed in claim 1, wherein the silver halide grains have a silver bromide-containing phase having a maximum silver bromide concentration inside the grains.

8. The color image forming method as claimed in claim 1, wherein the silver halide grains have a silver iodide-containing phase having a maximum silver iodide concentration on surfaces of the grains.

9. The color image forming method as claimed in claim 1, wherein the silver halide grains have a silver bromide-localized phase and a silver iodide-containing phase inside the grains, the silver bromide-localized phase being formed more inner than the silver iodide containing phase.

10. The color image forming method as claimed in claim 1, wherein the processing solution is a color developer.

* * * * *